US007137944B2

(12) United States Patent
Suzuki et al.

(10) Patent No.: US 7,137,944 B2
(45) **Date of Patent: *Nov. 21, 2006**

(54) SHEET FINISHER AND IMAGE FORMING SYSTEM USING THE SAME

(75) Inventors: Nobuyoshi Suzuki, Tokyo (JP); Kenji Yamada, Tokyo (JP); Masahiro Tamura, Kanagawa (JP); Hiromoto Saitoh, Kanagawa (JP); Hiroki Okada, Kanagawa (JP); Junichi Iida, Kanagawa (JP); Shuuya Nagasako, Tokyo (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 11/130,118

(22) Filed: May 17, 2005

(65) Prior Publication Data

US 2005/0206071 A1 Sep. 22, 2005

Related U.S. Application Data

(63) Continuation of application No. 10/339,304, filed on Jan. 10, 2003, now Pat. No. 6,921,069.

(30) Foreign Application Priority Data

Jan. 10, 2002 (JP) ..... 2002-003650
Jan. 25, 2002 (JP) ..... 2002-017257
Dec. 3, 2002 (JP) ..... 2002-351507

(51) Int. Cl.
*B31B 1/26* (2006.01)
*B31L 43/00* (2006.01)
*B31F 1/10* (2006.01)

(52) U.S. Cl. ..... 493/405; 493/444; 270/32; 271/207

(58) Field of Classification Search ..... 493/442, 493/444, 445, 405, 416, 424, 425, 431, 434, 493/435; 270/3, 4, 20.1, 32; 271/207
See application file for complete search history.

(56) References Cited

U.S. PATENT DOCUMENTS 4,812,195 A 3/1989 Vijuk (Continued)

FOREIGN PATENT DOCUMENTS

EP 0 748 756 A2 12/1996

(Continued)

OTHER PUBLICATIONS

U.S. Appl. No. 11/273,301, filed Nov. 15, 2005, Iida et al.

*Primary Examiner*—Rinaldi I. Rada
*Assistant Examiner*—John Paradiso
(74) *Attorney, Agent, or Firm*—Oblon, Spivak, McClelland, Maier & Neustadt, P.C.

(57) ABSTRACT

A folding device of the present invention includes a fold plate and a fold roller pair for folding a sheet or a sheet stack conveyed thereto. A controller causes the fold roller pair to move back and forth while nipping the folded portion of the sheet or that of the sheet stack at its nip for thereby continuously exerting pressure on the folded portion. The fold roller pair is rotated in opposite directions for thereby sharpening the fold of the sheet or that of the sheet stack.

41 Claims, 50 Drawing Sheets

U.S. PATENT DOCUMENTS

| | | | |
|---|---|---|---|
| 5,779,232 | A | 7/1998 | Ochsner |
| 5,876,027 | A | 3/1999 | Fukui et al. |
| 6,004,254 | A | 12/1999 | Murata |
| 6,276,677 | B1 | 8/2001 | Hommochi et al. |
| 6,905,118 | B1 | 6/2005 | Yamada et al. |
| 2004/0104525 | A1 | 6/2004 | Suzuki et al. |
| 2004/0254054 | A1 | 12/2004 | Suzuki et al. |
| 2005/0206071 | A1 | 9/2005 | Suzuki et al. |

FOREIGN PATENT DOCUMENTS

| | | |
|---|---|---|
| JP | 2-66068 | 3/1990 |
| JP | 9-183568 | 7/1997 |
| JP | 09-183568 | 7/1997 |
| JP | 2000-198613 | 7/2000 |
| JP | 2002-145516 | 5/2002 |
| JP | 2002-348032 | 12/2002 |

SORT-STACK MODE

STAPLE MODE

CENTER STAPLE & FOLD MODE

FIG. 45
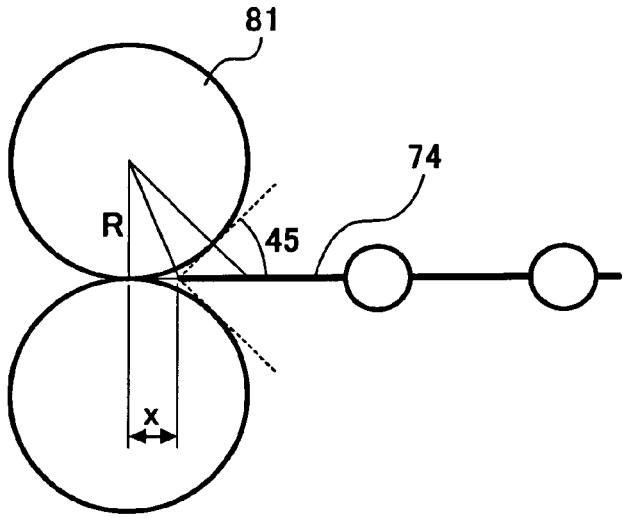
FIG. 46A
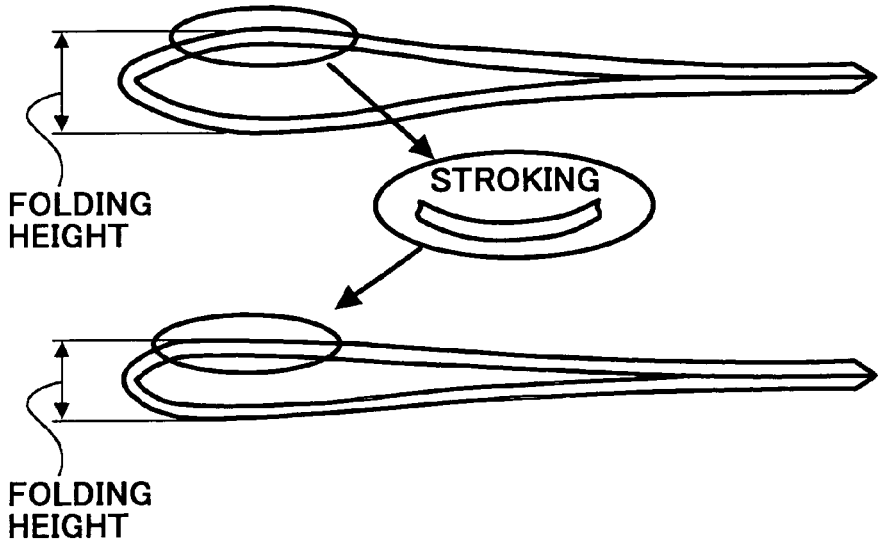
FIG. 46B

CENTER STAPLE & FOLD MODE

SHEET FINISHER AND IMAGE FORMING SYSTEM USING THE SAME

CROSS-REFERENCE TO RELATED APPLICATIONS

The present application is a continuation of U.S. application Ser. No. 10/339,304 filed on Jan. 10, 2003, now U.S. Pat. No. 6,921,069, and in turn claims priority to JP 2002-003650 filed on Jan. 10, 2002, JP 2002-017527 filed on Jan. 25, 2002, and JP 2002-351507 filed on Dec. 3, 2002, the entire contents of each of which are hereby incorporated herein by reference.

BACKGROUND OF THE INVENTION

1. Field of the Invention

The present invention relates to a folding device mounted on or operatively connected to a copier, printer or similar image forming apparatus for folding a sheet or recording medium or a sheet stack carrying images thereon or a sheet finisher for folding, sorting, stacking, stapling, center-stapling or otherwise finishing the sheet or the sheet stack, and an image forming system consisting of the sheet finisher and image forming apparatus.

2. Description of the Background Art

A sheet finisher positioned at the downstream side of an image forming apparatus for stapling or otherwise finishing a sheet stack is well known in the art. To meet the increasing demand for multiple functions, a sheet finisher having a center-stapling capability in addition to the conventional edge-stapling capability has recently been proposed. Further, a sheet finisher with a center-folding capability in addition to the center-stapling capability has been proposed to fold a center-stapled sheet stack at the center for thereby producing a pamphlet.

A sheet finisher with the binding capability mentioned above uses, in many cases, one or more pairs of fold rollers to fold a sheet stack. In this type of sheet finisher, a flat fold plate is caused to contact the stapled position of a sheet stack and push it into the nip of each fold roller pair, thereby folding the sheet stack.

When the fold plate is used to push a sheet stack into the nip of each fold roller, it is necessary to locate the sheet stack at a position where it faces the fold roller. Therefore, the fold roller pair located at the first stage is exposed to a sheet conveyance path, so that the sheet stack must be conveyed via the position where the fold roller pair is exposed. At this instant, if the sheet stack is relatively thick, then it is likely that the leading edge of the sheet stack facing the fold roller pair is caused to abut against the rollers or to be caught by the rollers and bent thereby.

In light of the above, it has been customary to use means for preventing a sheet stack from contacting the rollers, e.g., a shutter. The shutter prevents the leading edge of a sheet stack from contacting the rollers until it reaches a preselected position. However, the shutter or similar movable member must be driven by a mechanism arranged in the vicinity of the conveyance path, making the sheet finisher bulky. Moreover, the shutter slides on the surface of a sheet when operated, lowering the quality of an image printed on the sheet.

On the other hand, when a sheet stack is relatively thick, the folding device of the type described is apt to fail to sharply fold the sheet stack, leaving a swell in the sheet stack. To solve this problem, Japanese Patent Laid-Open Publication No. 9-2735, for example, discloses a folding system configured to pass a relatively thick, center-folded sheet stack through the nip of a fold roller pair, reverse the rotation of the fold roller pair to again pass the sheet stack through the above nip, and repeat such a procedure a plurality of times. This system, however, has a drawback that the sheet stack, passed through the nip of the fold roller pair a plurality of times, is smeared around the fold due to sliding contact with the fold roller pair, failing to achieve high quality when implemented as a pamphlet.

To protect a sheet stack from smearing mentioned above, Japanese Patent Laid-Open Publication No. 10-218483, for example, proposes a system that lowers a speed at which a sheet stack is pulled out at the time of reversal of rotation of the fold roller pair, thereby efficiently obviating the swell of the sheet stack. This system, however, cannot fully free a sheet stack from smears although reducing them.

Japanese Patent Laid-Open Publication Nos. 2000-72320 and 2001-146363 each teach a system in which two fold roller pairs are arranged such that the former fold roller pair folds a sheet stack, and then the latter fold roller pair makes the fold of the sheet stack more firm. Although this kind of scheme almost frees a sheet stack form smears, it cannot sharply fold a relatively thick sheet stack and therefore fails to solve the problem of swell. Further, the system is not satisfactory as to productivity and whether or not a desired degree of fold can be formed.

Of course, for a given degree of pressure, the fold of a sheet stack becomes dull as the number or sheets constituting the sheet stack increases. In light of this, Japanese Patent Laid-Open Publication No. 3,254,363, for example, proposes a system including selecting means for selecting either one of a first and a second mode and counting means for counting sheets constituting a single sheet stack. In the first mode, a fold roller pair is rotated only in the forward direction to fold a sheet stack one time while, in the second mode, it is rotated in the forward direction and then in the reverse direction to fold the sheet stack two times. The second mode is selected in accordance with the output of the counting means, thereby sharpening the fold of the sheet stack when the sheet stack has more than a preselected number of sheets.

Technologies relating to the present invention are also disclosed in, e.g., Japanese Patent Laid-Open Publication Nos. 9-183568 and 2000-198613.

SUMMARY OF THE INVENTION

It is a first object of the present invention to provide a sheet finisher capable of preventing the leading edge portion of a sheet stack from bending, insuring high-quality folding and high-quality center folding and binding without resorting to a shutter or similar special member, and an image forming system including the same.

It is a second object of the present invention to provide a folder and a sheet finisher capable of efficiently obviating the swell of a sheet stack without smearing it and therefore insuring a high-quality bound sheet stack, and an image forming system including the same.

A folding device of the present invention includes a fold plate and a fold roller pair for folding a sheet or a sheet stack conveyed thereto. A controller causes the fold roller pair to move back and forth while nipping the folded portion of the sheet or that of the sheet stack at its nip for thereby continuously exerting pressure on the folded portion. The fold roller pair is rotated in opposite directions for thereby sharpening the fold of the sheet or that of the sheet stack.

A sheet finisher including the folding device and an image forming system consisting of the sheet finisher and an image forming apparatus are also disclosed.

BRIEF DESCRIPTION OF THE DRAWINGS

The above and other objects, features and advantages of the present invention will become more apparent from the following detailed description taken with the accompanying drawings in which:

FIG. 45 shows the fold plate held in a stand-by position;

FIGS. 46A and 46B respectively show a sheet stack not subjected to sharpening operation and a sheet stack subjected to the same.

DESCRIPTION OF THE PREFERRED EMBODIMENTS

Preferred embodiments of the sheet finisher and image forming system in accordance with the present invention will be described hereinafter.

First Embodiment

Figure 1:
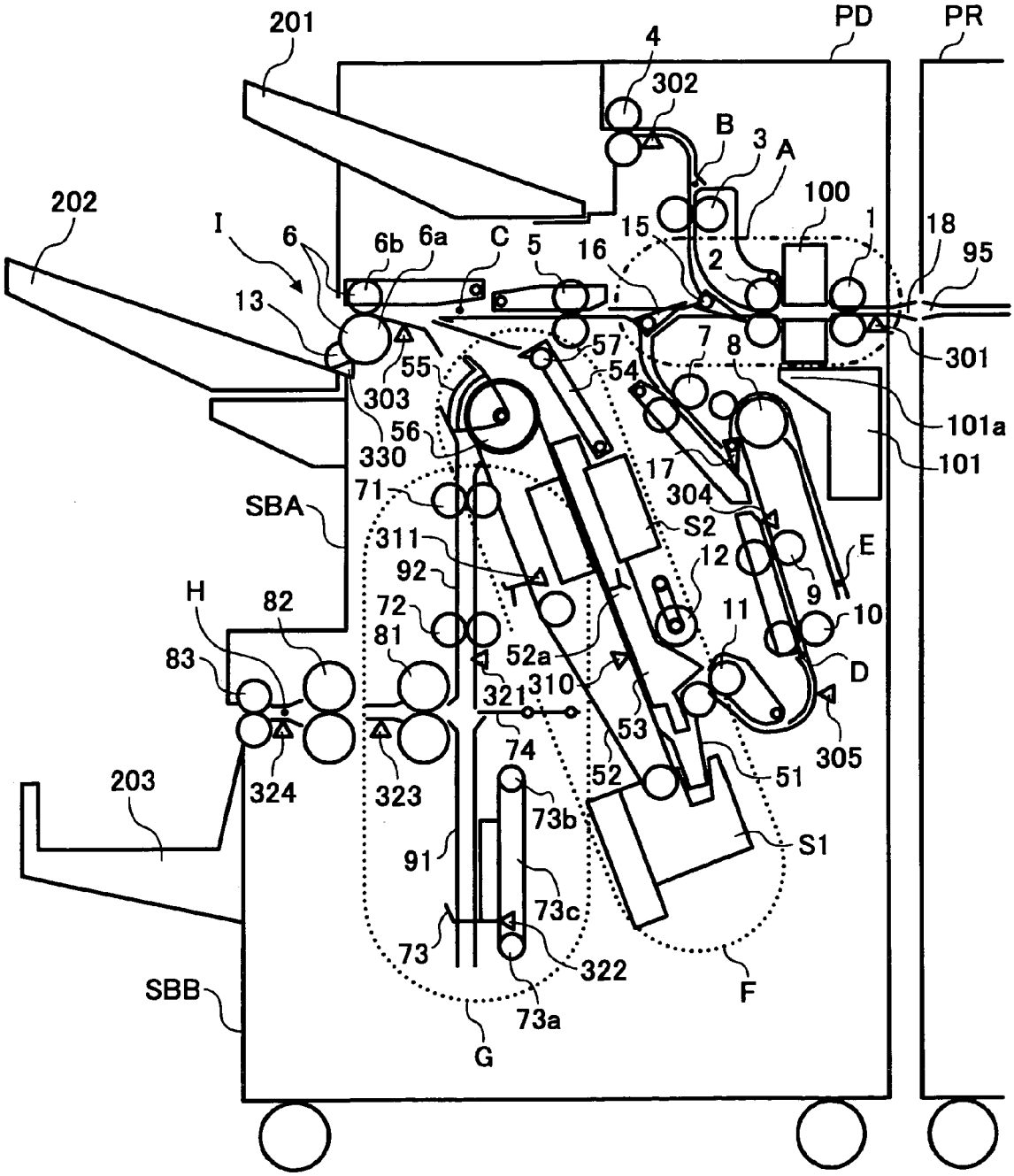
FIG. 1 is a view showing an image forming system including a sheet finisher embodying the present invention and an image forming apparatus.

Referring to FIG. 1 of the drawings, an image forming system embodying the present invention is shown and directed mainly toward the first object. As shown, the image forming system is generally made up of an image forming apparatus PR and a sheet finisher PD operatively connected to one side of the image forming apparatus PR. A sheet or recording medium driven out of the image forming apparatus PR via an outlet 95 is introduced in the sheet finisher PD via an inlet 18. In the sheet finisher PD, a path A extends from the inlet 18 and includes finishing means for finishing a single sheet. In the illustrative embodiment, this finishing means is implemented as a punch unit or punching means 100. Path selectors 15 and 16 steer the sheet coming in through the path A to any one of a path B terminating at an upper tray 201, a path C terminating at a shift tray 202, and a processing tray F. The processing tray F is used to position, staple or otherwise process a sheet or sheets and, in this sense, will sometimes be referred to as a staple tray hereinafter.

The image forming apparatus PR includes at least an image processor, an optical writing unit, a developing unit, an image transferring unit, and a fixing unit although not shown specifically. The image processor converts an image signal input thereto to image data that can be printed out. The optical writing unit optically scans the surface of a photoconductive element in accordance with the image data output from the image processor, thereby forming a latent image. The developing unit develops the latent image with toner to thereby produce a corresponding toner image. The image transferring unit transfers the toner image to a sheet. The fixing unit fixes the toner image on the sheet. While the image forming apparatus PR is assumed to execute an electrophotographic process, it may alternatively be of the type executing any other conventional image forming process, e.g., an ink-jet or a thermal transfer image forming process. In the illustrative embodiment, the image processor, optical writing unit, developing unit, image transferring unit and fixing unit constitute image forming means in combination.

Sheets sequentially brought to the staple tray F via the paths A and D are positioned one by one, stapled or otherwise processed, and then steered by a guide plate 54 and a movable guide 55 to either one of the path C and another processing tray G. The processing tray G folds or otherwise processes the sheets and, in this sense, will sometimes be referred to as a fold tray hereinafter. The sheets folded by the fold tray G are guided to a lower tray 203 via a path H. The path D includes a path selector 17 constantly biased to a position shown in FIG. 1 by a light-load spring not shown. An arrangement is made such that after the trailing edge of a sheet has moved away from the path selector 17, among a prestack roller 8, rollers 9 and 10 and a staple outlet roller 11, at least the prestack roller 8 and roller 9 are rotated in the reverse direction to convey the trailing edge of the sheet to a prestacking portion E and cause the sheet to stay there. In this case, the sheet can be conveyed together with the next sheet superposed thereon. Such an operation may be repeated to convey two or more sheets together.

On the path A merging into the paths B, C and D, there are sequentially arranged an inlet sensor 301 responsive to a sheet coming into the finisher PD, an inlet roller pair 1, the punch unit 100, a waste hopper 101, roller pair 2, and the path selectors 15 and 16. Springs, not shown, constantly bias the path selectors 15 and 16 to the positions shown in FIG. 1. When solenoids, not shown, are energized, the path selectors 15 and 16 rotate upward and downward, respectively, to thereby steer the sheet to desired one of the paths B, C and D.

More specifically, to guide a sheet to the path B, the path selector 15 is held in the position shown in FIG. 1 while the solenoid assigned thereto is deenergized. To guide a sheet to the path C, the solenoids are energized to rotate the path selectors 15 and 16 upward and downward, respectively. Further, to guide a sheet to the path D, the path selector 16 is held in the position shown in FIG. 1 while the solenoid assigned thereto is turned off; at the same time, the solenoid assigned to the path selector 15 is turned on to rotate it upward.

In the illustrative embodiment, the finisher PD is capable of selectively effecting punching (punch unit 100), jogging and edge stapling (jogger fence 53 and edge stapler S1), sorting (shift tray 202) or folding (fold plate 74 and fold rollers 81 and 82), as desired.

A shift tray outlet section I is located at the most downstream position of the sheet finisher PD and includes a shift outlet roller pair 6, a return roller 13, a sheet surface sensor 330, and the shift tray 202. The shift tray outlet section I additionally includes a shifting mechanism J shown in FIG. 2 and a shift tray elevating mechanism K shown in FIG. 3.

Figure 2:
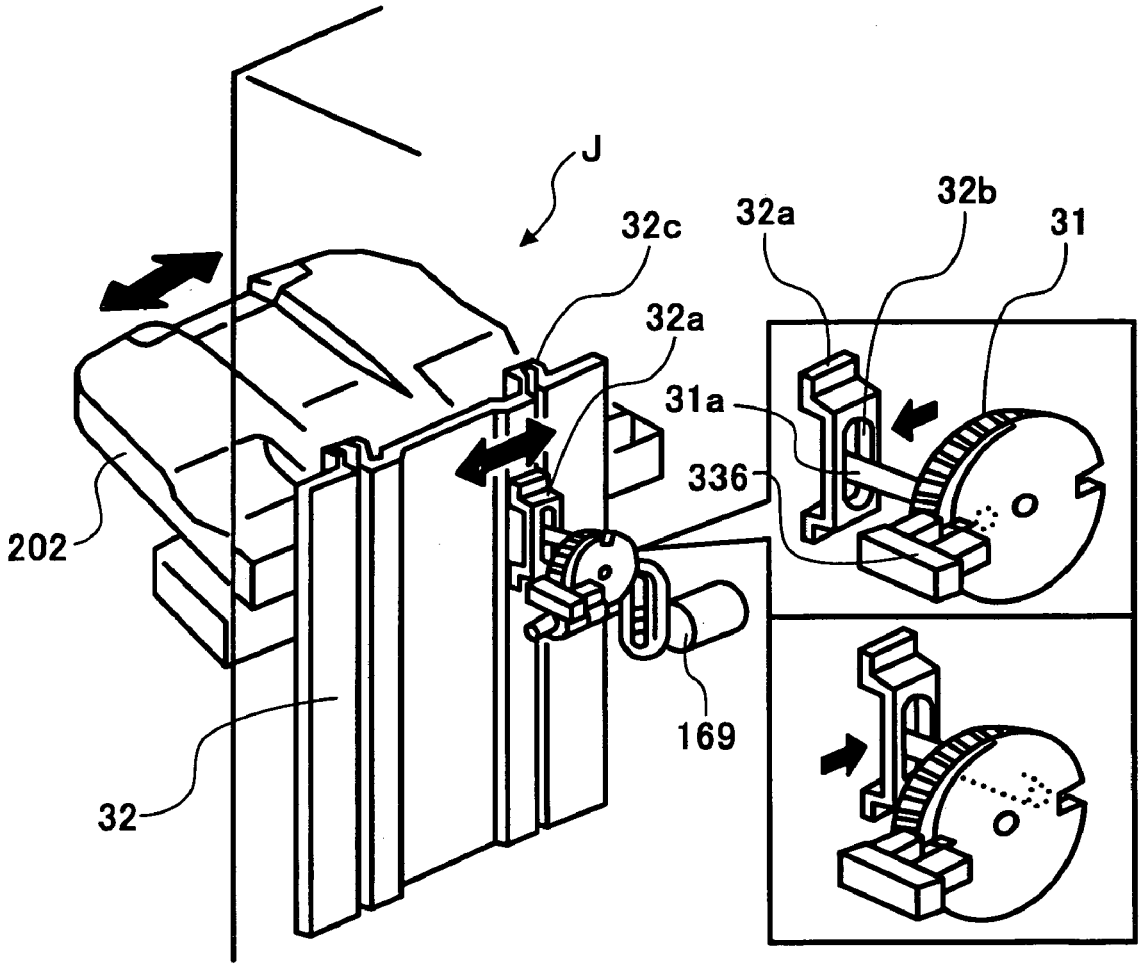
FIG. 2 is a fragmentary, enlarged isometric view showing a shifting mechanism included in the sheet finisher.
Figure 3:
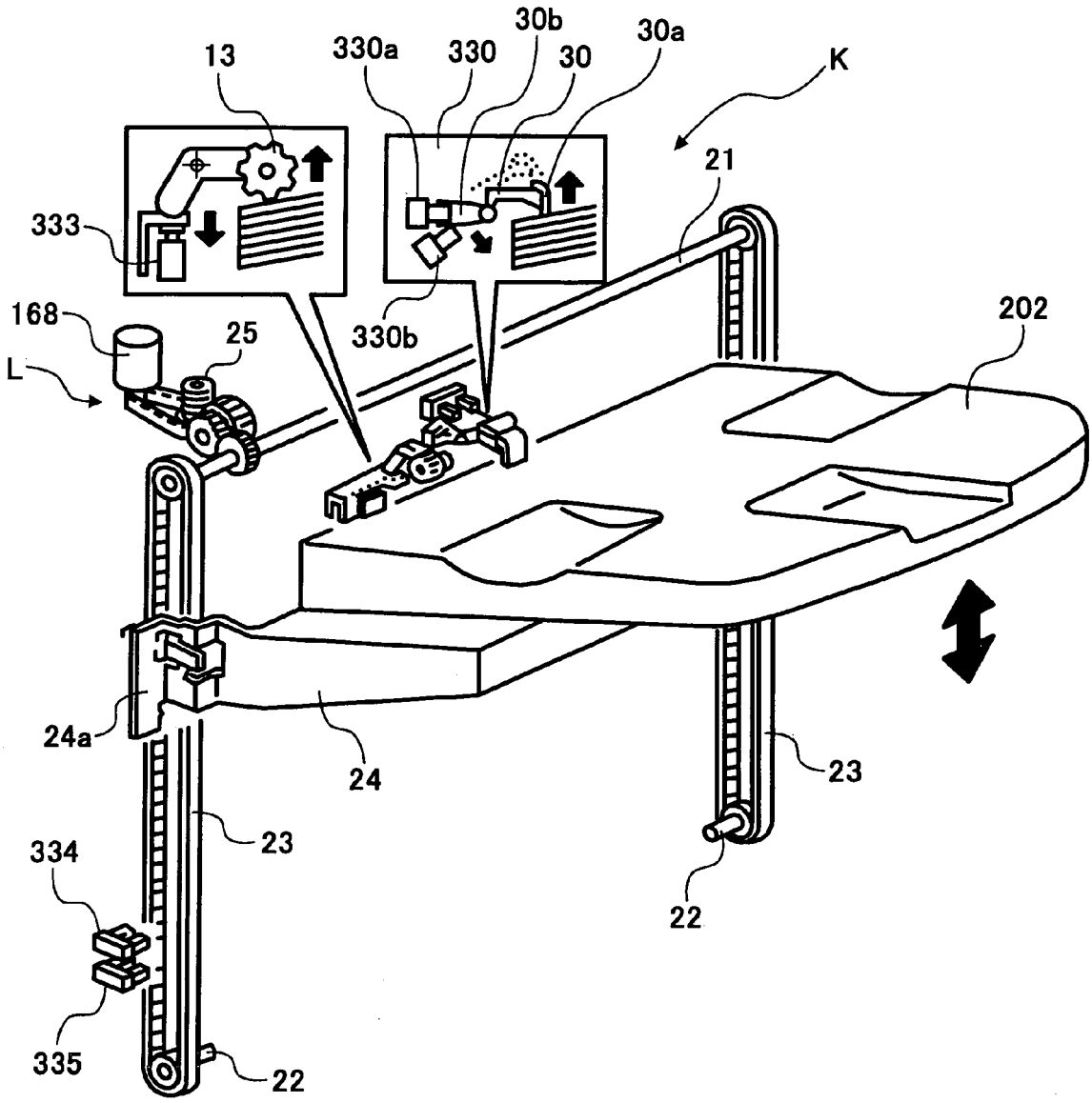
FIG. 3 is a fragmentary, enlarged isometric view showing a shift tray elevating mechanism included in the sheet finisher.

As shown in FIGS. 1 and 3, the return roller 13 contacts a sheet driven out by the shift outlet roller pair 6 and causes the trailing edge of the sheet to abut against an end fence 32 shown in FIG. 2 for thereby positioning it. The return roller 13 is formed of a sponge and is caused to rotate by the shift outlet roller 6. A limit switch 333 is positioned in the vicinity of the return roller 13 such that when the shift tray 202 is lifted and raises the return roller 13, the limit switch 333 turns on, causing a tray elevation motor 168 to stop rotating. This prevents the shift tray 202 from overrunning. As shown in FIG. 1, the sheet surface sensor 330 senses the surface of a sheet or that of a sheet stack driven out to the shift tray 202.

As shown in FIG. 3 specifically, the sheet surface sensor 330 is made up of a lever 30, a sensor 330*a* relating 6 to stapling, and a sensor 330*b* relating to non-stapling. The lever 30 is angularly movable about its shaft portion and made up of a contact end 30*a* contacting the top of the trailing edge of a sheet on the shift tray 202 and a sectorial interrupter 30*b*. The upper sensor 330*a* and lower sensor 330*b* are mainly used for staple discharge control and shift discharge control, respectively.

More specifically, in the illustrative embodiment, the sensors 330*a* and 330*b* each turn on when interrupted by the interrupter 30*b* of the lever 30. Therefore, when the shift tray 202 is lifted with the contact end 30*a* of the lever 30 moving upward, the sensor 330*a* turns off. As the shift tray 202 is further lifted, the sensor 330*b* turns off. When the outputs of the sensors 330*a* and 330*b* indicate that sheets are stacked on the shift tray 202 to a preselected height, the tray elevation motor 168 is driven to lower the shift tray 202 by a preselected amount. The top of the sheet stack on the shift tray 202 is therefore maintained at a substantially constant height.

The shift tray elevating mechanism K will be described in detail with reference to FIG. 3. As shown, the mechanism K includes a drive unit L for moving the shift tray 202 upward or downward via a drive shaft 21. Timing belts 23 are passed over the drive shaft 22 and a driven shaft 22 under tension via timing pulleys. A side plate 24 supports the shift tray 202 and is affixed to the timing belts 23. In this configuration, the entire unit including the shift tray 202 is supported by the timing belts 23 in such a manner as to be movable up and down.

The drive unit L includes a worm gear 25 in addition to the tray elevation motor 168, which is a reversible drive source. Torque output from the tray elevation motor 168 is transmitted to the last gear of a gear train mounted on the drive shaft 21 to thereby move the shift tray 202 upward or downward The worm gear 25 included in the driveline allows the shift tray 202 to be held at a preselected position and therefore prevents it from dropping by accident.

An interrupter 24*a* is formed integrally with the side plate 24 of the shift tray 202. A full sensor 334 responsive to the full condition of the shift tray 202 and a lower limit sensor 335 responsive to the lower limit position of the shift tray 202 are positioned below the interrupter 24*a*. The full sensor 334 and lower limit sensor 335, which are implemented by photosensors, each turn off when interrupted by the interrupter 24*a*. In FIG. 3, the shift outlet roller 6 is not shown.

As shown in FIG. 2, the shifting mechanism J includes a shift motor 169 and a cam 31. When the shift motor or drive source 169 causes the cam 31 to rotate, the cam 31 causes the shift tray 202 to move back and forth in a direction perpendicular to a direction of sheet discharge. A pin 31*a* is studded on the shift cam 31 at a position spaced from the axis of the shift cam 31 by a preselected distance. The tip of the pin 31*a* is movably received in an elongate slot 32*b* formed in an engaging member 32*a*, which is affixed to the back of the end fence 32 not facing the shift tray 202. The engaging member 32*a* moves back and forth in a direction perpendicular to the direction of sheet discharge in accordance with the angular position of the pin 31*a*, entraining the shift tray 202 in the same direction The shift tray 202 stops at a front position and a rear position in the direction perpendicular to the sheet surface of FIG. 1 (corresponding to the positions of the shift cam 31 shown in FIG. 2). A shift sensor 336 is responsive to a notch formed in the shift cam 31. To stop the shift tray at the above two positions, the shift motor 169 is selectively energized or deenergized on the basis of the output of the shift sensor 336.

Guide channels 32*c* are formed in the front surface of the end fence 32. The rear edge portions of the shift tray 202 are movably received in the guide channels 32*c*. The shift tray 202 is therefore movable up and down and movable back and forth in the direction perpendicular to the direction of sheet discharged, as needed. The end fence 32 guides the trailing edges of sheets stacked on the shift tray 202 for thereby aligning them.

Figure 4:
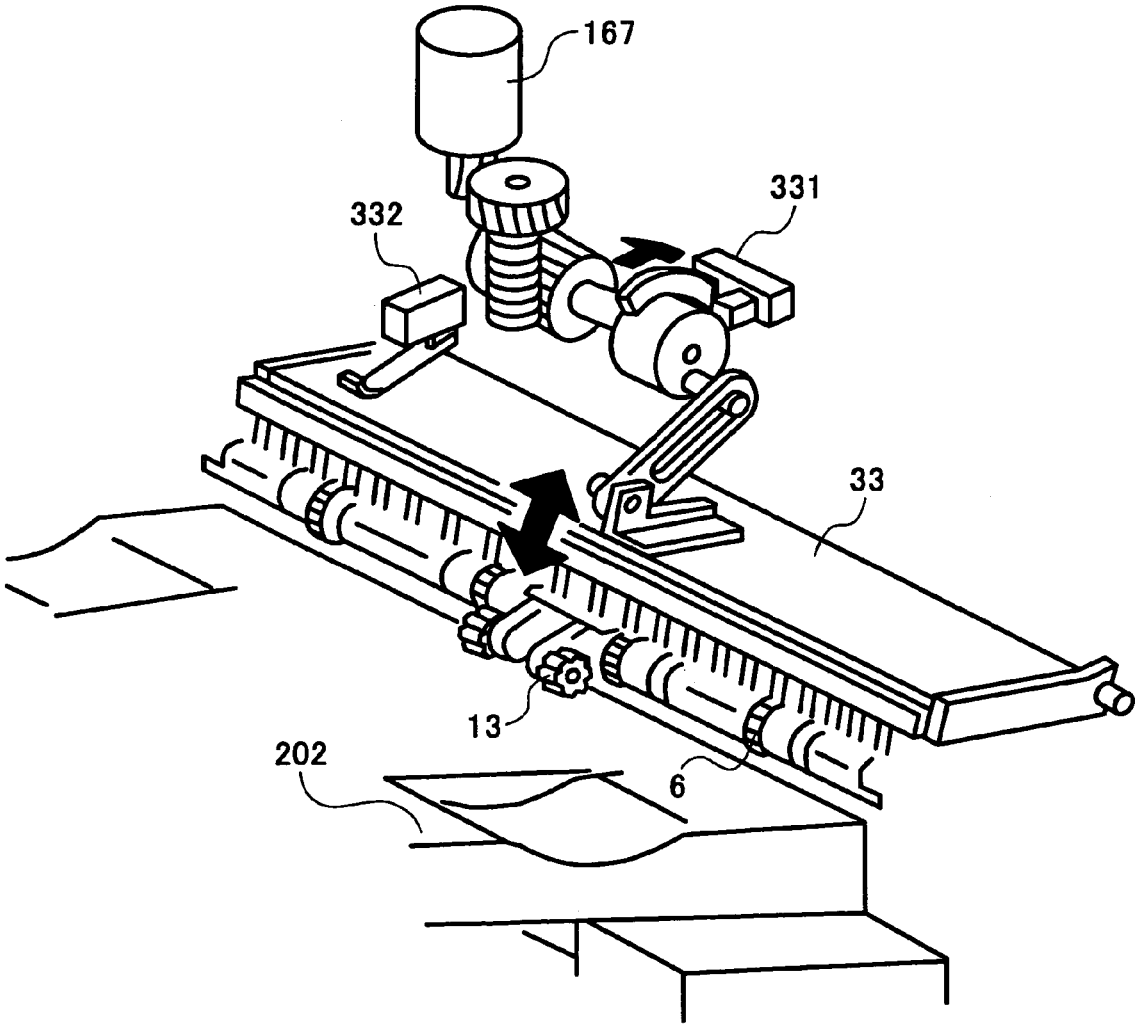
FIG. 4 is an isometric view showing part of the sheet finisher configured to discharge sheets to the shift tray.

FIG. 4 shows a specific configuration of the arrangement for discharging a sheet to the shift tray 202. As shown in FIGS. 1 and 4, the shift roller pair 6 has a drive roller 6*a* and a driven roller 6*b*. A guide plate 33 is supported at its upstream side in the direction of sheet discharge and angularly movable in the up-and-down direction. The driven roller 6*b* is supported by the guide plate 33 and contacts the drive roller 6*a* due to its own weight or by being biased, nipping a sheet between it and the drive roller 6*a*. When a stapled sheet stack is to be driven out to the shift tray 202, the guide plate 33 is lifted and then lowered at a preselected timing, which is determined on the basis of the output of a guide plate sensor 331. A guide plate motor 167 drives the guide plate 33 in such a manner in accordance with the ON/OFF state of a limit switch 332.

Figure 5:
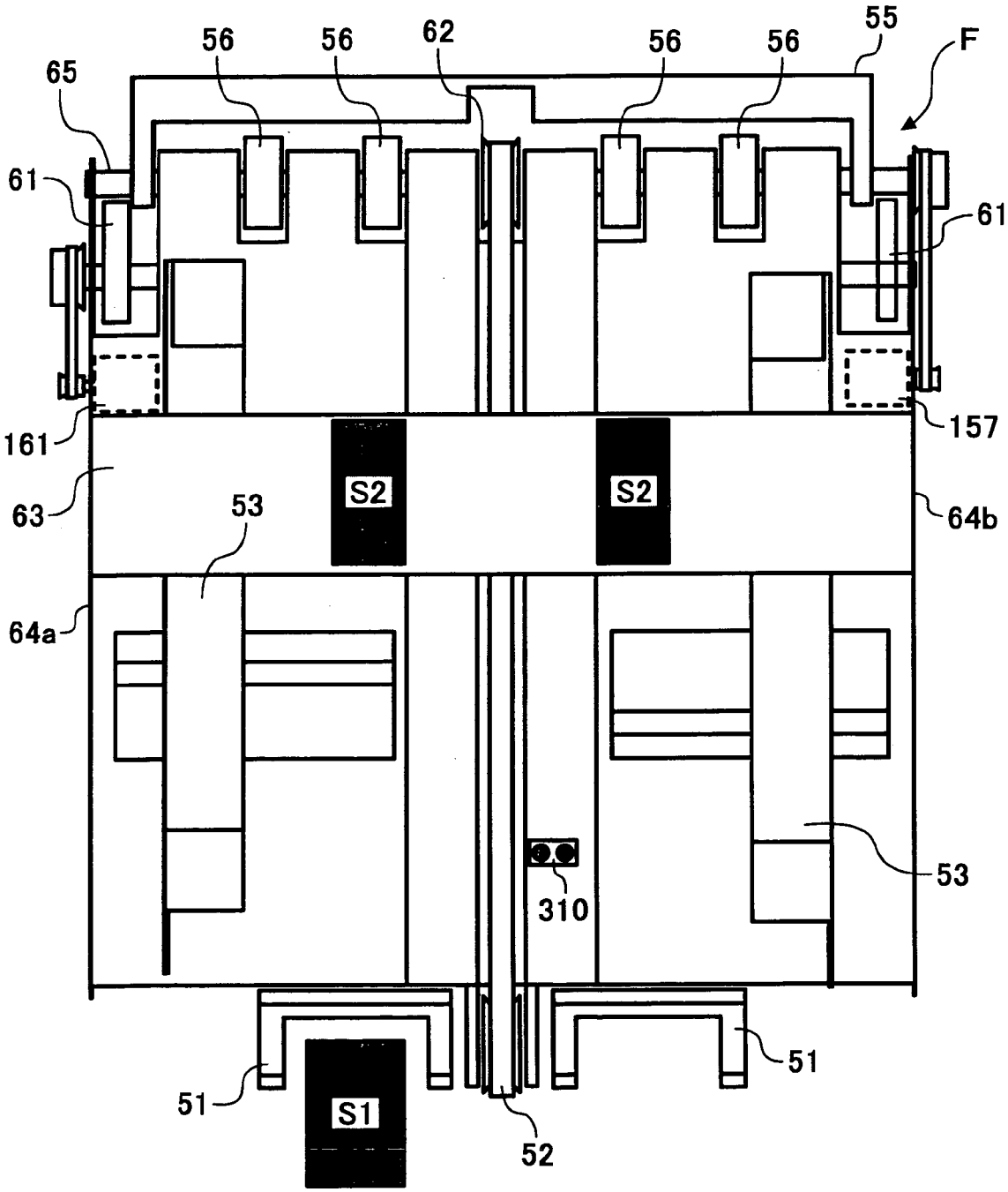
FIG. 5 is a plan view showing a staple tray included in the finisher, as seen in a direction perpendicular to a sheet conveying surface.
Figure 6:
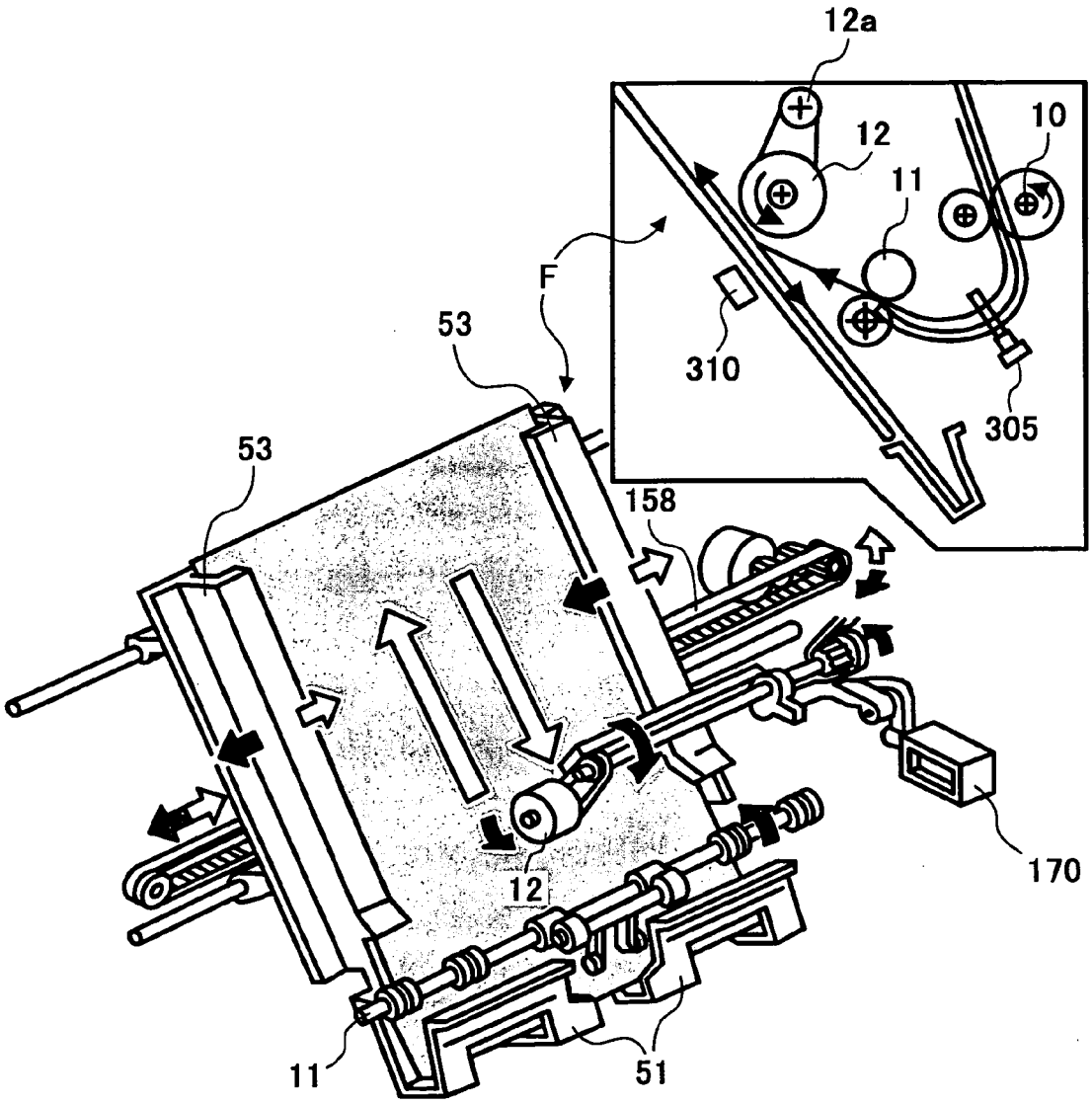
FIG. 6 is an isometric view showing the staple tray and a mechanism for driving it.
Figure 7:
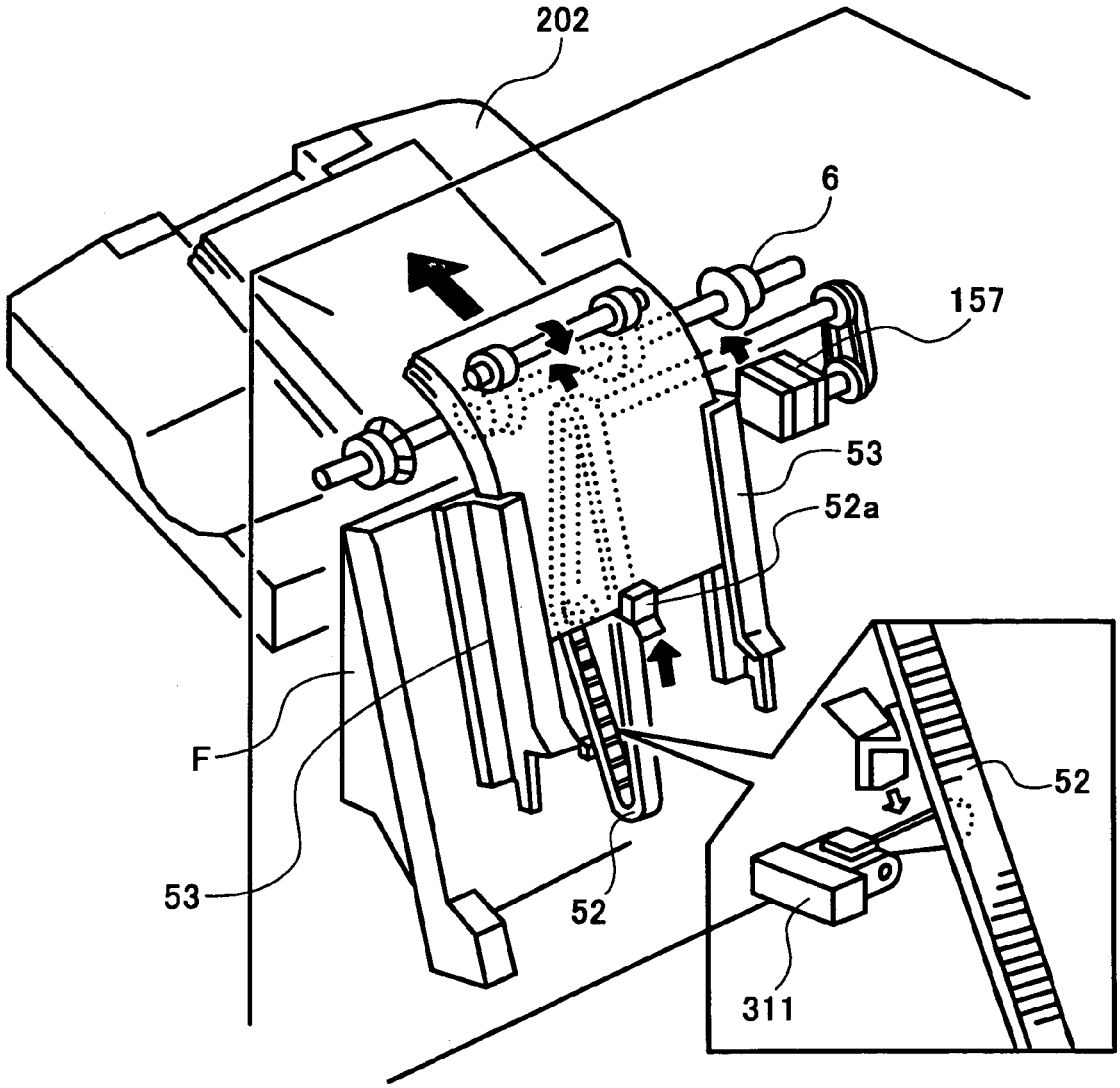
FIG. 7 is an isometric view showing a mechanism included in the sheet finisher for discharging a sheet stack.

FIG. 5 shows the staple tray F as seen in a direction perpendicular to the sheet conveyance plane. FIG. 6 shows a drive mechanism assigned to the staple tray F while FIG. 7 shows a sheet stack discharging mechanism. As shown in FIG. 6, sheets sequentially conveyed by the staple outlet roller pair 11 to the staple tray F are sequentially stacked on the staple tray F. At this instant, a knock roller 12 knocks every sheet for positioning it in the vertical direction (direction of sheet conveyance) while jogger fences 53 position the sheet in the horizontal direction perpendicular to the sheet conveyance (sometimes referred to as a direction of sheet width). Between consecutive jobs, i.e., during an interval between the last sheet of a sheet stack and the first sheet of the next sheet stack, a controller 350 (see FIG. 17) outputs a staple signal for causing an edge stapler S1 to perform a stapling operation. A discharge belt 52 with a hook 52*a* immediately conveys the stapled sheet stack to the shift outlet roller pair 6, so that the shift outlet roller pair 6 conveys the sheet stack to the shift tray 202 held at a receiving position.

As shown in FIG. 7, a belt HP (Home Position) sensor 311 senses the hook 52*a* of the discharge belt 52 brought to its home position. More specifically, two hooks 52*a* and 52*a*' are positioned on the discharge belt 52 face-to-face at spaced locations in the circumferential direction and alternately convey sheet stacks stapled on the staple tray F one after another. The discharge belt 52 may be moved in the reverse direction such that one hook 52*a* held in a stand-by position and the back of the other hook 52*a*' position the leading edge of the sheet stack stored in the staple tray F in the direction of sheet conveyance, as needed. The hook 52*a* therefore plays the role of positioning means at the same time.

As shown in FIG. 5, a discharge motor 157 causes the discharge belt 52 to move via a discharge shaft 65. The discharge belt 52 and a drive pulley 62 therefor are positioned at the center of the discharge shaft 65 in the direction of sheet width. Discharge rollers 56 are mounted on the discharge shaft 65 in a symmetrical arrangement. The discharge rollers 56 rotate at a higher peripheral speed than the discharge belt 52.

More specifically, torque output from the discharge motor 157 is transferred to the discharge belt 52 via a timing belt and the timing pulley 62. The timing pulley (drive pulley) 62 and discharge rollers 56 are mounted on the same shaft, i.e., the discharge shaft 65. An arrangement maybe made such that when the relation in speed between the discharge rollers 56 and the discharge belt 52 should be varied, the discharge rollers 56 are freely rotatable on the discharge shaft 65 and driven by part of the output torque of the discharge motor 157. This kind of scheme allows a desired reduction ratio to be set up.

The surface of the discharge roller 56 is formed of rubber or similar high-friction material. The discharge roller 56 nips a sheet stack between it and a press roller or driven roller 57 due to the weight of the driven roller 57 or a bias, thereby conveying the sheet stack.

A processing mechanism will be described hereinafter. As shown in FIG. 6, a solenoid 170 causes the knock roller 12 to move about a fulcrum 12*a* in a pendulum fashion, so that the knock roller 12 intermittently acts on sheets sequentially driven to the staple tray F and causes their trailing edges to abut against rear fences 51. The knock roller 12 rotates counterclockwise about its axis. A jogger motor 158 drives the jogger fences 53 via a timing belt and causes them to move back and forth in the direction of sheet width.

Figure 8:
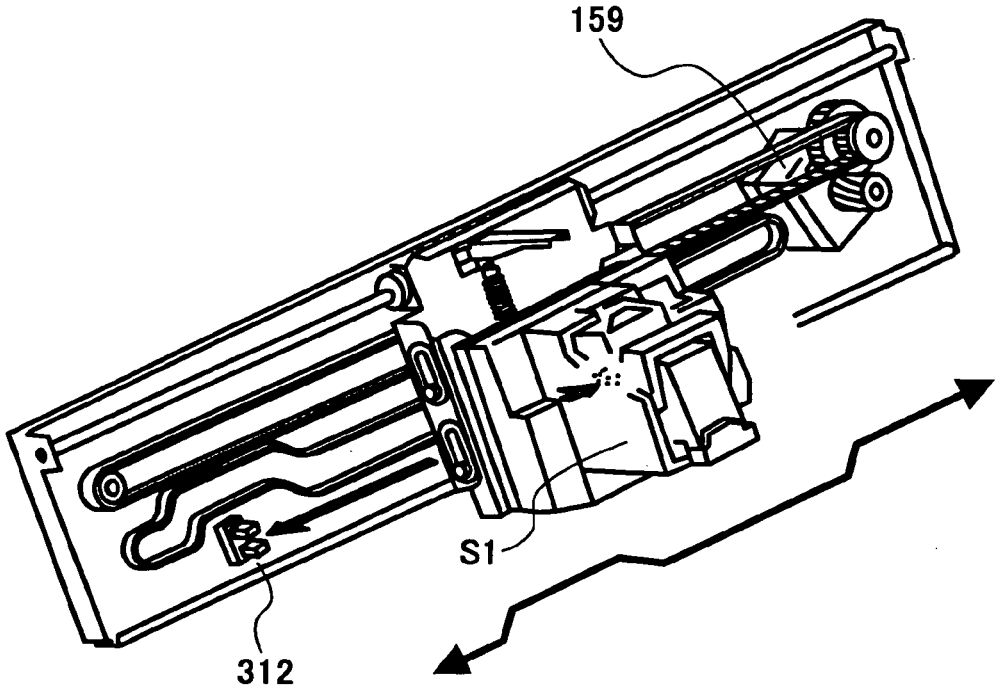
FIG. 8 is an isometric view showing an edge stapler included in the sheet finisher together with a mechanism for moving it.

As shown in. FIG. 8, a mechanism for moving the edge stapler S1 includes a reversible, stapler motor 159 for driving the edge stapler S via a timing belt. The edge stapler S is movable in the direction of sheet width in order to staple a sheet stack at a desired edge position. A stapler HP sensor 312 is positioned at one end of the movable range of the edge stapler S1 in order to sense the stapler S brought to its home position. The stapling position in the direction of sheet width is controlled in terms of the displacement of the edge stapler S1 from the home position.

Figure 9:
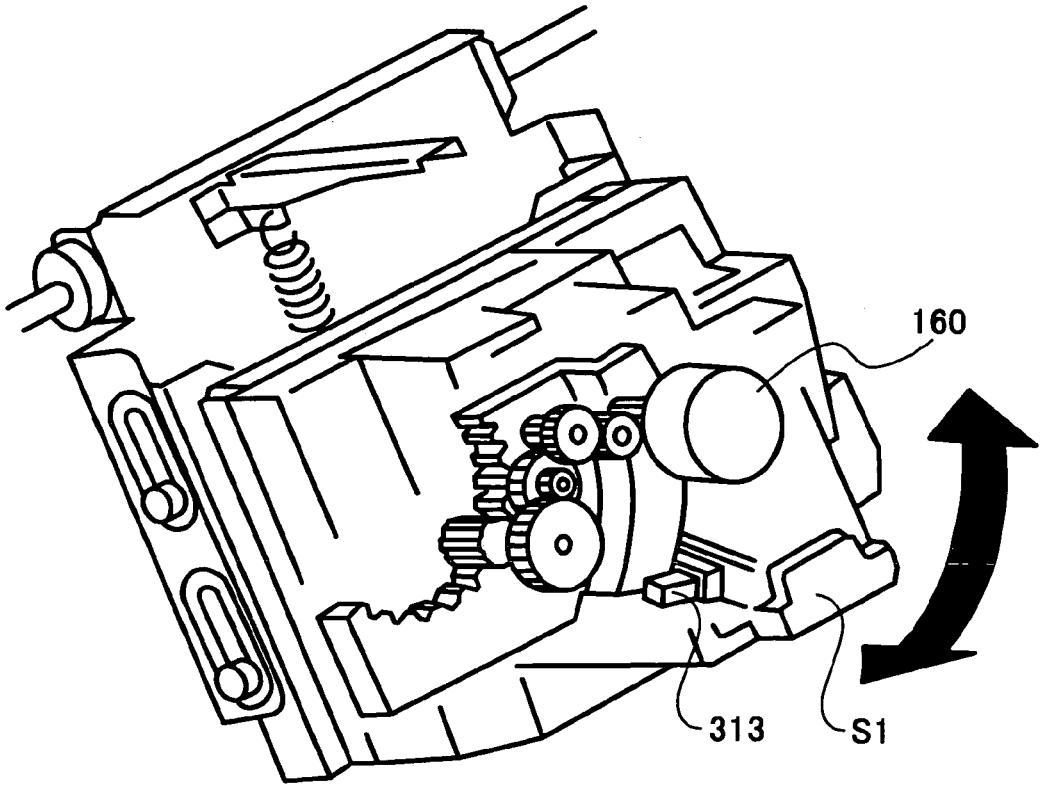
FIG. 9 is an isometric view showing a mechanism for rotating the edge stapler.

As shown in FIG. 9, the edge stapler S1 is capable of selectively driving a staple into a sheet stack in parallel to or obliquely relative to the edge of the sheet stack. Further, at the home position, only the stapling mechanism portion of the edge stapler S1 is rotatable by a preselected angle for the replacement of staples. For this purposes an oblique motor 160 causes the above mechanism of the edge stapler S1 to rotate until a sensor 313 senses the mechanism reached a preselected replacement position. After oblique stapling or the replacement of staples, the oblique motor 160 causes the stapling mechanism portion to return to its original angular position.

As shown in FIGS. 1 and 5, a pair of center staplers S2 are affixed to a stay 63 and are located at a position where the distance between the rear fences 51 and their stapling positions is equal to or greater than one-half of the length of the maximum sheet size, as measured in the direction of conveyance, that can be stapled. The center staplers S2 are symmetrical to each other with respect to the center in the direction of sheet width. The center staplers S2 themselves are conventional and will not be described specifically. Briefly, after a sheet stack has been fully positioned by the jogger fences 53, rear fences 51 and knock roller 5, the discharge belt 52 lifts the trailing edge of the sheet stack with its hook 52 to a position where the center of the sheet stack in the direction of sheet conveyance coincides with the stapling positions of the center staplers S2. The center staplers S2 are then driven to staple the sheet stack. The stapled sheet stack is conveyed to the fold tray G and folded at the center, as will be described in detail later.

There are also shown in FIG. 5 a front side wall 64*a*, a rear side wall 64*b*, and a sensor responsive to the presence/absence of a sheet stack on the staple tray F.

Figure 15:
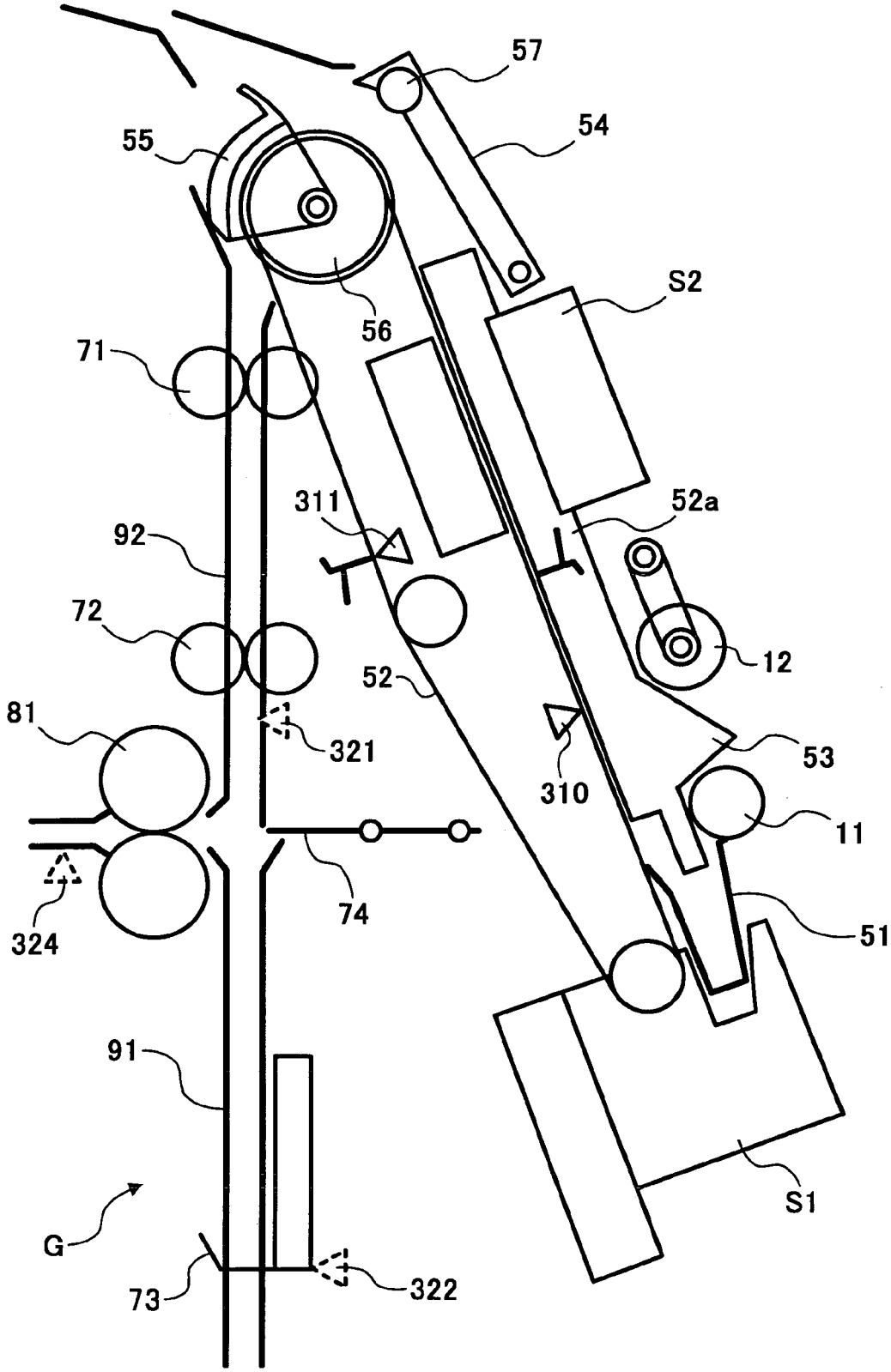
FIG. 15 shows the staple tray and fold tray in detail.

Reference will be made to FIG. 15 as well as to FIG. 1 for describing a mechanism for steering a sheet stack. To allow the sheet stack stapled by the center staplers S2 to be folded at the center on the fold tray G, sheet stack steering means is located at the most downstream side of the staple tray F in the direction of sheet conveyance in order to steer the stapled sheet stack toward the fold tray G.

Figure 10:
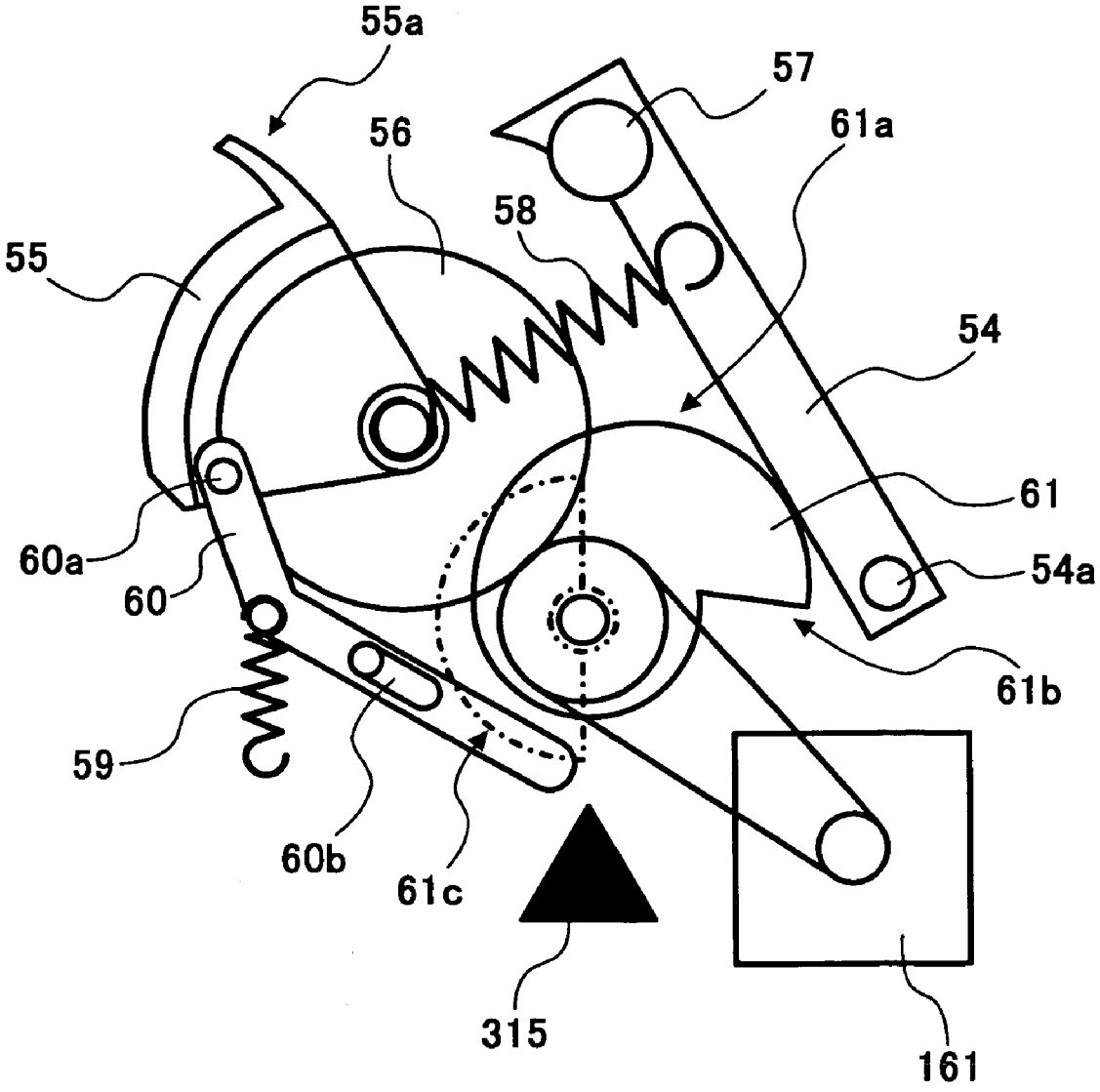
FIGS. 10 through 12 are views demonstrating the consecutive operating conditions of a sheet stack steering mechanism included in the sheet finisher.
Figure 11:
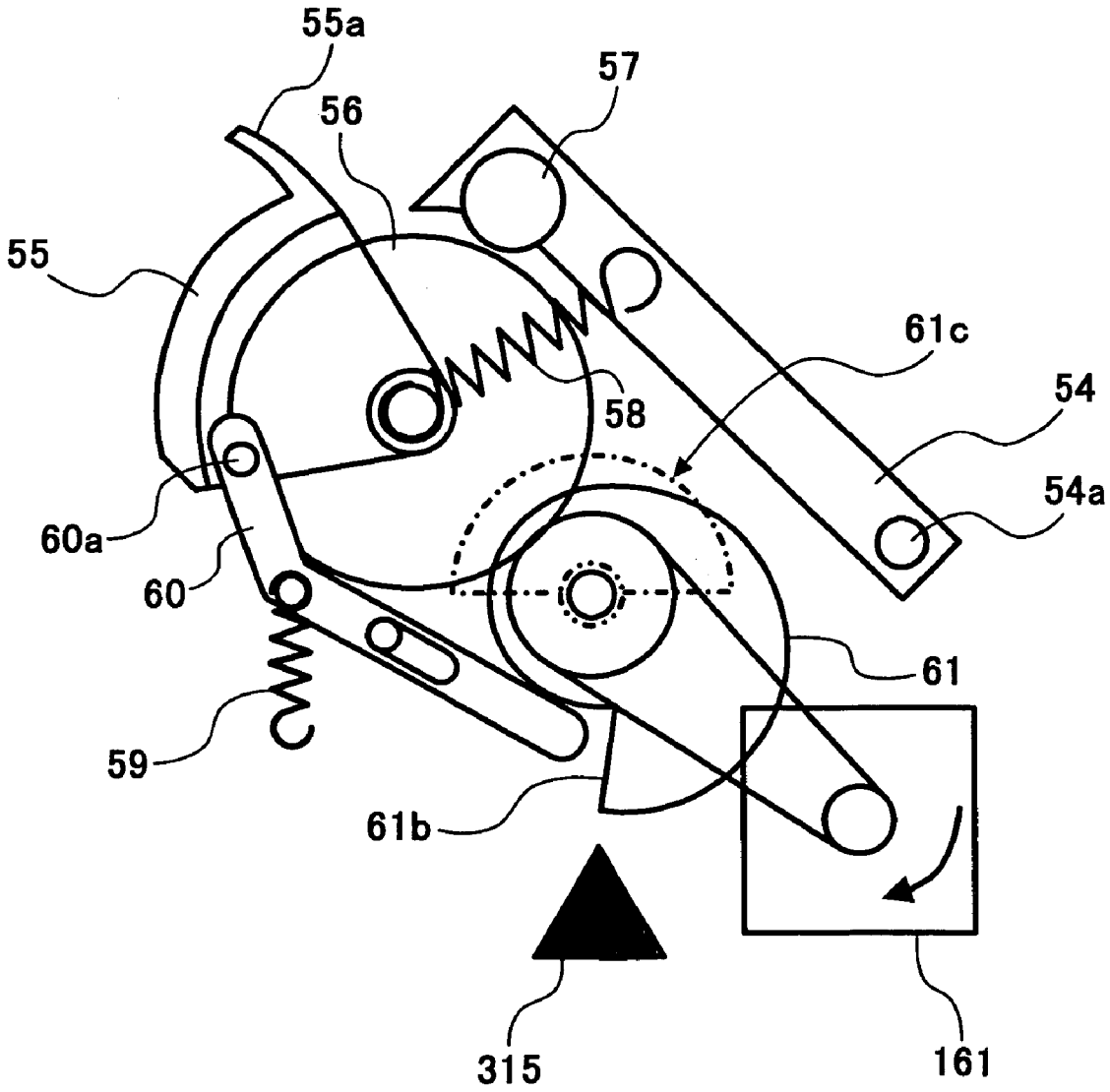
Figure 12:
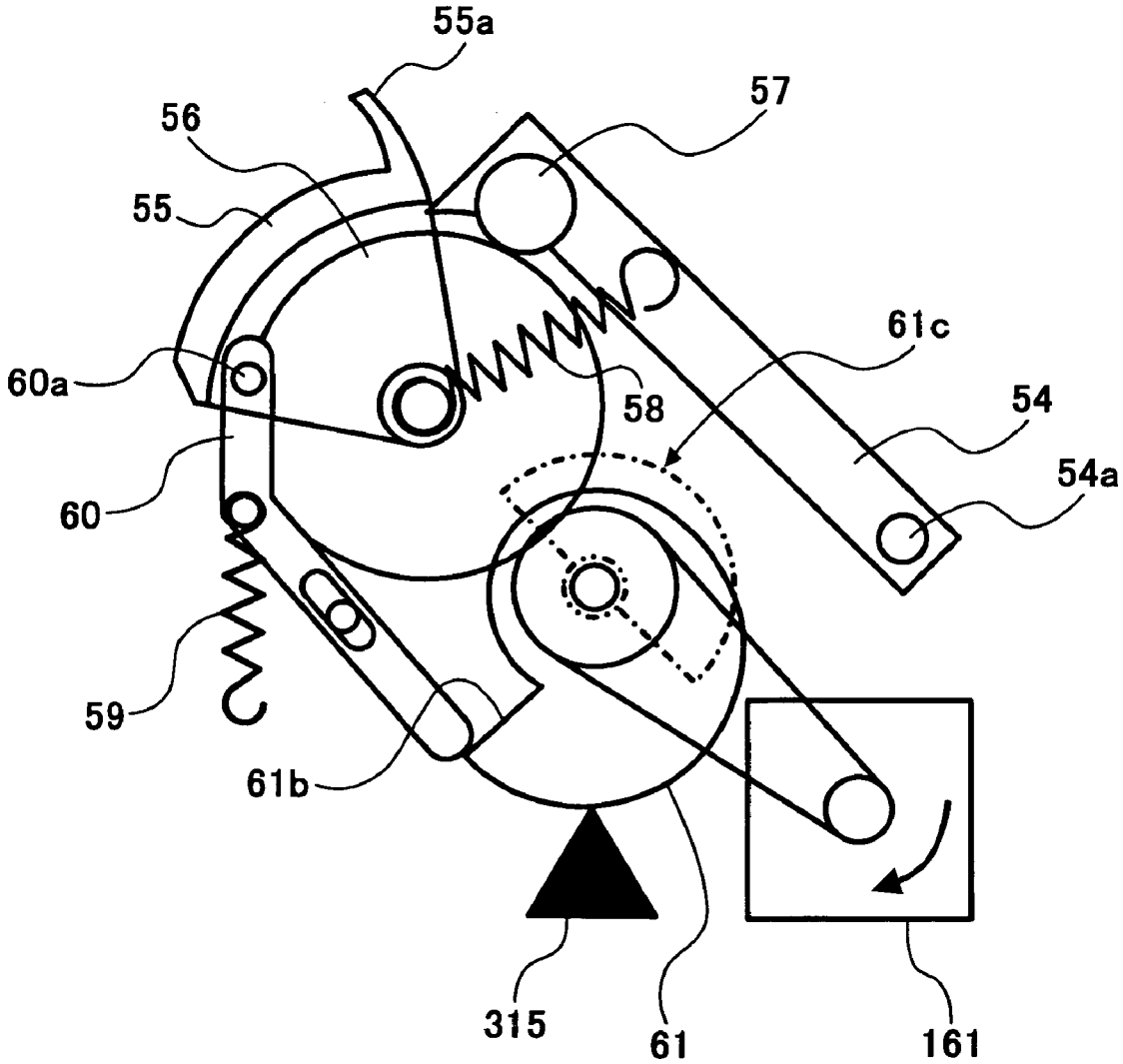

As shown in FIG. 15, the steering mechanism includes the guide plate 54 and movable guide 55 mentioned earlier. As shown in FIGS. 10 through 12, the guide plate 54 is angularly movable about a fulcrum 54*a* in the up-and-down direction and supports the press roller 57, which is freely rotatable, on its downstream end. A spring 58 constantly biases the guide plate 54 toward the discharge roller 56. The guide plate 54 is held in contact with the cam surface 61*a* of a cam 61, which is driven by a steer motor 161.

The movable guide 55 is angularly movably mounted on the shaft of the discharge roller 56. A link arm 60 is connected to one end of the movable guide 55 remote from the guide plate 54 at a joint 60*a*. A pin studded on the front side wall 64*a*, FIG. 5, is movably received in an elongate slot 60*b* formed in the link arm 60, limiting the movable range of the movable guide 55. A spring 59 holds the link arm 60 in the position shown in FIG. 10 When the steer motor 161 causes the cam 61 to rotate to a position where its cam surface 61*b* presses the link arm 60, the movable guide 55 connected to the link arm 60 angularly moves upward along the surface of the discharge roller 56. A guide HP sensor 315 senses the home position of the cam 61 on sensing the interrupter portion 61*c* of the cam 61. Therefore, the stop position of the cam 61 is controlled on the basis of the number of drive pulses input to the steer motor 161 counted from the home position of the cam 61, as will be described later in detail.

FIG. 10 shows a positional relation to hold between the guide plate 54 and the movable guide 55 when the cam 61 is held at its home position. As shown, the guide surface 55*a* of the movable guide 55 is curved and spaced from the surface of the discharge roller 56 by a preselected distance. While part of the guide plate 55 downstream of the press roller 57 in the direction of sheet conveyance is curved complementarily to the surface of the discharge roller 56, the other part upstream of the same is flat in order to guide a sheet stack toward the shift outlet roller 6. In this condition, the mechanism is ready to convey a sheet stack to the path C. More specifically, the movable guide 55 is sufficiently retracted from the route along which a sheet stack is to be conveyed from the staple tray F to the path C. Also, the guide plate 54 is sufficiently retracted from the surface of the discharge roller 56. The guide plate 54 and movable guide 55 therefore open the above route sufficiently wide; the opening width is generally dependent on the stapling ability of the edge stapler S1 and usually corresponds to the thickness of fifty ordinary sheets or less.

When the leading edge of a sheet stack steered by the guide plate 54 contacts the guide surface 55*a* of the movable guide 55, the guide surface 55*a* causes the leading edge to make a hairpin turn with a small diameter R. When the cam 61 is in the home position, the movable guide 55 abuts against a plate, not shown, and biased by the spring 59 in the counterclockwise direction.

FIG. 11 shows a condition wherein the guide plate 54 is moved about the fulcrum 54*a* counterclockwise (downward) by the cam 61 with the press roller 57 pressing the discharge roller 57. As shown, when the cam 61 rotates clockwise, it causes the guide plate 54 to move from the opening position to the pressing position along the cam surface 61*a* of the cam 61. As the cam 61 further rotates clockwise, its cam surface 61*b* raises the link arm 60 and thereby causes the movable guide 55 to move.

FIG. 12 shows a condition wherein the cam 61 has further rotated from the above position to move the movable guide 55 clockwise (upward). In this condition, the guide plate 54 and movable guide 55 form the route extending from the staple tray F toward the fold tray G. FIG. 5 shows the same relation as seen in the direction of depth.

In the condition shown in FIG. 10, a sheet stack positioned and stapled on the staple tray F can be delivered to the shift tray 202 while, in the condition shown in FIG. 12, the sheet stack can be delivered to the fold tray G. The guide surface 55*a* of the movable guide 55 can block the space in which the guide 55 is movable, allowing a sheet stack to be smoothly delivered to the fold tray G. In this manner, the guide plate and movable plate 55 are sequentially moved in this order while overlapping each other, forming a smooth path for conveyance.

In the condition shown in FIG. 12, the guide plate 54 contacts the discharge roller 56 obliquely relative to the direction of sheet conveyance, compared to the condition shown in FIG. 10. The guide plate 54 therefore guides the leading edge of the sheet stack toward the press roller 57 while restricting it in a wedge fashion. Although a sheet stack to be delivered to the fold tray G has been stapled at the center with the leading edge remaining free, such a sheet stack is restricted, as stated above, and pressed by the press roller 57 and then introduced in the gap between the movable guide 55 and discharge roller 66. The leading edge of the sheet stack can therefore enter the above gap without becoming loose. The movable guide 55 steers, or turns, the sheet stack toward the fold tray G. It follows that the angle of conveyance can be freely selected in terms of the angle θ of the movable guide 55, i.e., the circumferential length of the movable guide 55. However, the maximum angle of conveyance is limited to 180° in relation to the other mechanisms.

Although the path selectors 15 and 16 shown in FIG. 1 are capable of switching the conveyance path, they do not exert a conveying force themselves. Therefore, when the selector 15.or 16 steers a stack of several sheets or several ten sheets by a large angle, the sheet stack is apt to jam the path due to a difference in friction between the outer surface and the inner surface.

While in the illustrative embodiment the guide plate 54 and movable guide 55 share a single drive motor, each of them may be driven by a respective drive motor, so that the timing of movement and stop position can be controlled in accordance with the sheet size and the number of sheets stapled together.

The fold tray G will be described specifically with reference to FIGS. 13 and 14. As shown, the fold tray G includes a fold plate 74 for folding a sheet stack at the center. The fold plate 74 is formed with elongate slots 74*a* each being movably received in one of pins 64*c* studded on each of the front and rear side walls 64*a* and 64*b*. A pin 74*b* studded on the fold plate 74 is movably received in an elongate slot 76*b* formed in a link arm 76. The link arm 76 is angularly movable about a fulcrum 76*a*, causing the fold plate 74 to move in the right-and-left direction as viewed in FIGS. 13 and 14. More specifically, a pin 75*b* studded on a fold plate cam 75 is movably received in an elongate slot 76*c* formed in the link arm 76. In this condition, the link arm 76 angularly moves in accordance with the rotation of the fold plate cam 75, causing the fold plate 74 to move back and forth perpendicularly to a lower guide plate 91 and an upper guide plate 92 (see FIG. 15).

Figure 13:
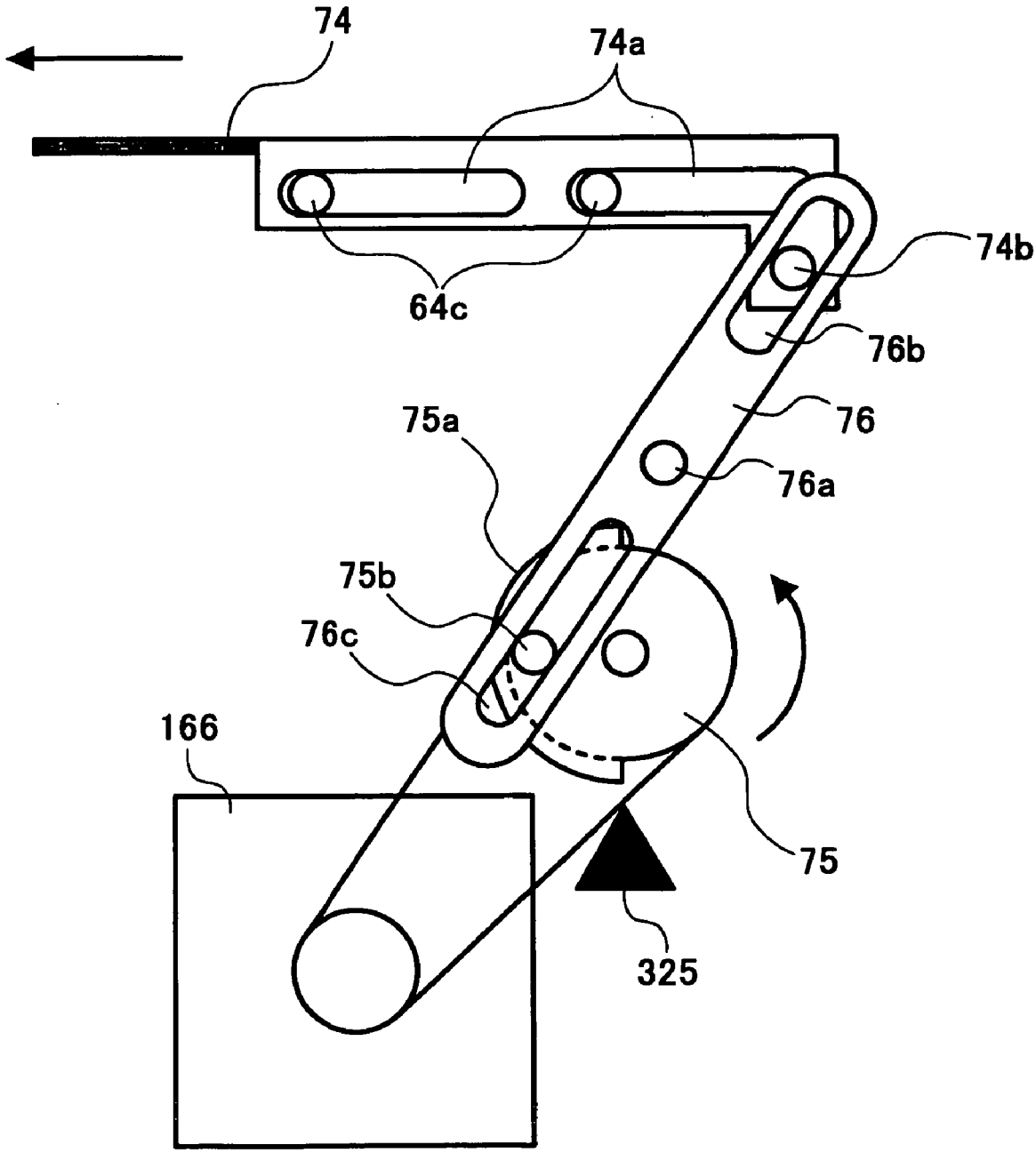
FIGS. 13 and 14 are views demonstrating the consecutive operating conditions of a fold plate included in the sheet finisher.
Figure 14:
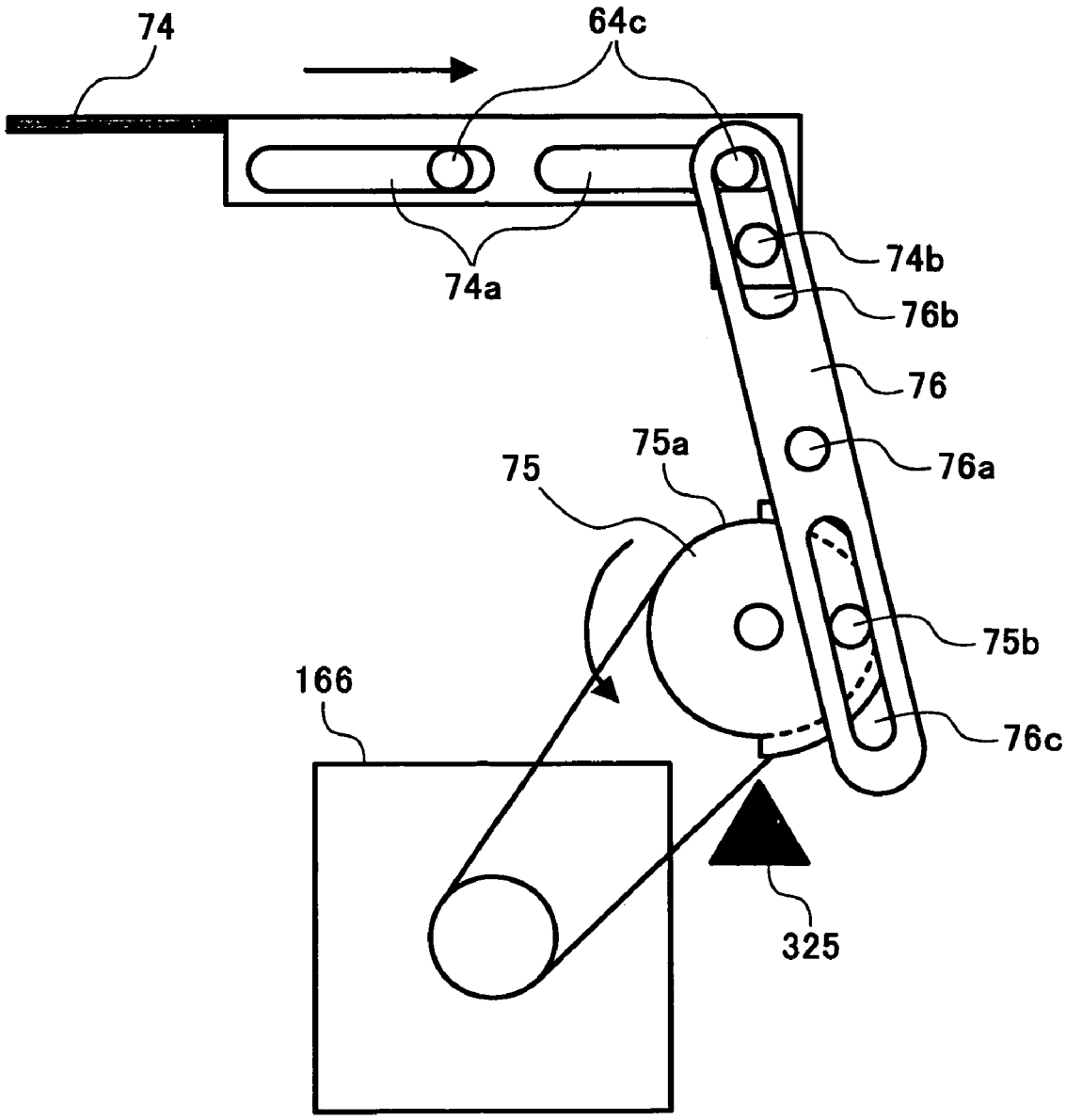

A fold plate motor 166 causes the fold plate cam 75 to rotate in a direction indicated by an arrow in FIG. 13. The stop position of the fold plate cam 75 is determined on the basis of the output of a fold plate HP sensor 325 responsive to the opposite ends of a semicircular interrupter portion 75*a* included in the cam 75.

FIG. 13 shows the fold plate 74 in the home position where the fold plate 74 is fully retracted from the sheet stack storing range of the fold tray G. When the fold plate cam 75 is rotated in the direction indicated by the arrow, the fold plate 74 is moved in the direction indicated by an arrow and enters the sheet stack storing range of the fold tray G. FIG. 14 shows a position where the fold plate 74 pushes the center of a sheet stack on the fold tray G into the nip between a pair of fold rollers 81. When the fold plate cam 75 is rotated in a direction indicated by an arrow in FIG. 14, the fold plate 74 moves in a direction indicated by an arrow out of the sheet stack storing range.

While the illustrative embodiment is assumed to fold a sheet stack at the center, it is capable of folding even a single sheet at the center. In such a case, because a single sheet does not have to be stapled at the center, it is fed to the fold tray G as soon as it is driven out, folded by the fold plate 74 and fold roller pair 81, and then delivered to the lower tray 203, FIG. 1.

Figure 16:
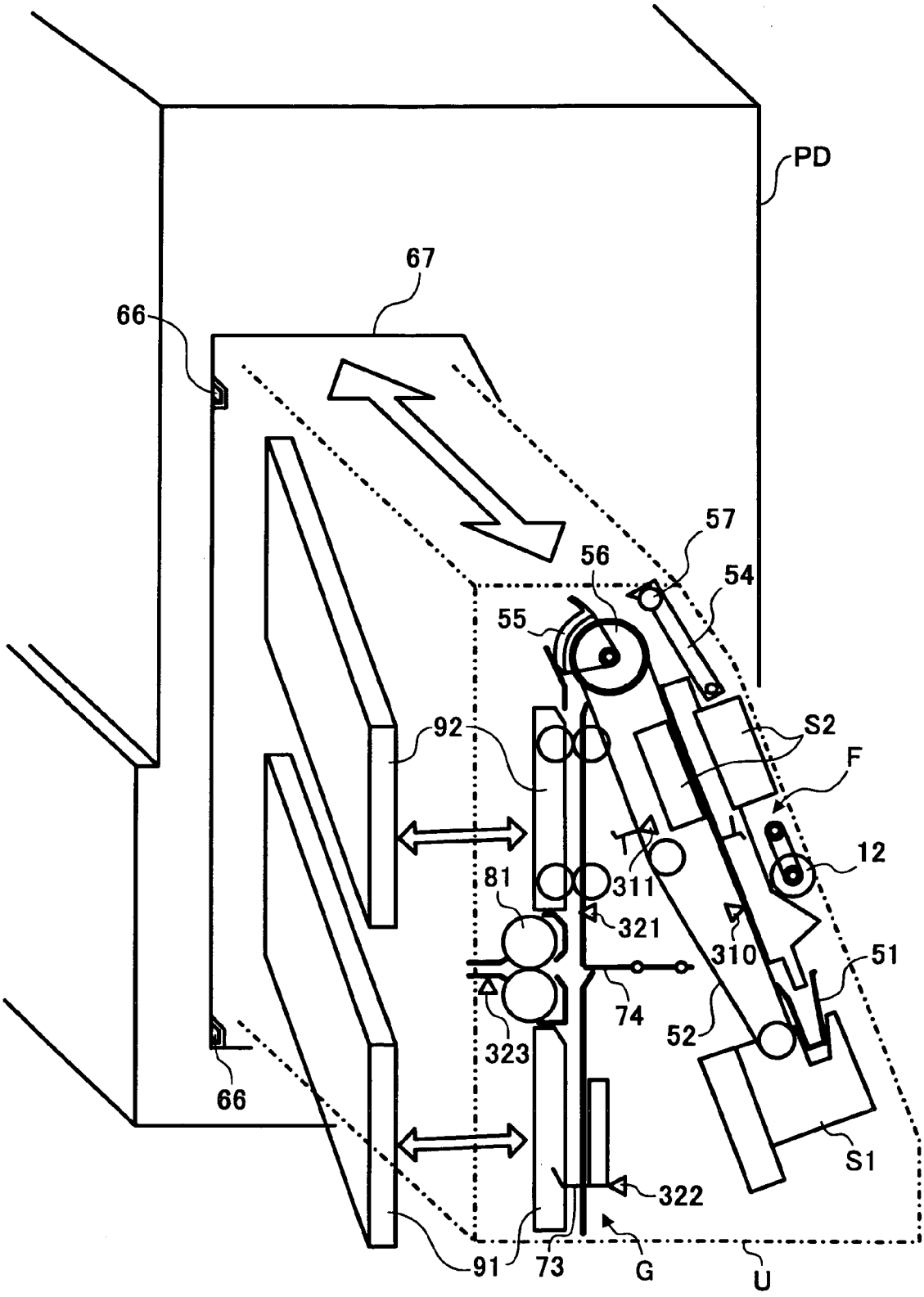
FIG. 16 shows a mechanism supporting the staple tray and fold tray constructed into a unit.

FIG. 16 shows a specific arrangement supporting the staple tray F and processing tray G, FIG. 15, such that they can be pulled out together to facilitate jam processing, maintenance or replacement. As shown, the fold tray G extends perpendicularly from a bent portion, which is the arc of the discharge roller 56, while the staple tray F obliquely extends from the bent portion with an acute angle. While FIG. 16 shows only the end face of the staple tray F and that of the fold tray G, the trays F and G are accommodated in the direction of depth at least in the width of the tray F shown in FIG. 5.

The angle of the staple tray F should preferably be as small as possible in order to reduce the projection area in the vertical direction and therefore the area to be occupied by the sheet finisher PD. However, in the illustrative embodiment, the fold plate 74, link arm 76, fold plate cam 75 and fold plate motor 166 constituting the folding mechanism of FIGS. 13 and 14 are arranged in the space between the fold tray G (guide plates 91 and 92) and the staple tray F. More specifically, the folding mechanism is interposed between the edge stapler S1 and the center staplers S2. The angle of the staple tray F relative to the fold tray G is selected such that none of the structural parts of the folding mechanisms interferes with any one of the structural parts of the staple tray F. The folding mechanism is positioned below the staple tray F so inclined. This arrangement allows the staple tray F, fold tray G and folding means to be arranged within the minimum vertical projection area.

To fold a sheet stack at the center, the center of the sheet stack should be coincident with a folding position assigned to the fold plate 74, as will be described specifically later. For this purpose, in the illustrative embodiment, a movable rear fence 73 is included in the lower guide plate 91 such that the trailing edge of a folded sheet stack (leading edge when the sheet stack is to be conveyed) rests on the fence 73. The movable rear fence 73 is movable upward or downward to bring the center of the sheet stack resting thereon to the folding position.

As shown in FIG. 1, the movable rear fence 73 is affixed to a drive belt 73*c* passed over a drive pulley 73*a* and a driven pulley 73*b* and caused to move upward or downward by a rear fence motor not shown. Such a mechanism for moving the movable rear fence 73, like the folding mechanism, is arranged in the space between the staple tray F and the fold tray G so as not to increase the vertical projection area.

As shown in FIG. 16, a unit U including the staple tray F and fold tray G, which have the relation stated above, is supported by a pair of guide rails 66 extending inward from an opening 67 formed in the finisher PD and can be pulled out of the finisher PD along the guide rails 66. The guide plates 91 and 92 are hinged to the rear end of the unit U with their front ends being openable away from each other. A magnet, for example, may used to lock the openable ends of the guide plates 91 and 92.

The unit U having the above configuration can be pulled out in the event of a jam and allows a jamming sheet to be easily removed. More specifically, when a jam occurs at the fold tray G side, the operator should only pull out the unit U halfway and can rapidly deal with the jam while watching the guide plates 91 and 92 opened away from each other. After the jam processing, when the operator pushes the unit U into the finisher PD, the guide plates 91 and 92 are automatically closed by the edges of the opening 67 and locked by the magnet. This obviates an occurrence that the operator fails to close the guide plates 91 and 92 and makes the next step impracticable.

While the guide rails 66 are positioned at the fold tray G side of the opening 67, they may, of course, be located at any other position, e.g., a position above the guide plates 91 and 92.

In the illustrative embodiment, the staple tray F is inclined by a large angle in relation to the fold tray G and folding mechanism, i.e., positioned obliquely at as small an angle as possible relative to the fold tray G, as stated earlier. In this arrangement, the fold tray G is positioned below the staple tray F, so that the space above the staple tray F is questionable in the aspect of efficient use of space. In light of this, in the illustrative embodiment, the path D and prestacking portion E are positioned in parallel to the staple tray F while a waste receiver 101*a* included in the waste unit 101 is held in an inclined position in the space available in the upper right portion, as seen in FIG. 1. This promotes the efficient use of the limited space available in the finisher PD.

In the above configuration, if the sheet size is large, then a sheet stored in the prestacking portion E waits for the next sheet with its trailing edge in the direction of sheet conveyance protruding from the portion E. At this instant, because the sheet prestacking portion E is positioned in the upper right portion of the finisher PD, a sufficient space is available below the portion E and prevents the sheet from jamming the path.

Further, the folding mechanism of the fold tray G is located between the edge stapler S1 and the center staplers S2, so that a sufficient space is available below the fold plate 74 even when the sheet size is large. Therefore, a sufficient space is guaranteed below the leading edge of a sheet despite that the sheet is conveyed vertically along the guide plates 91 and 92.

Figure 17:
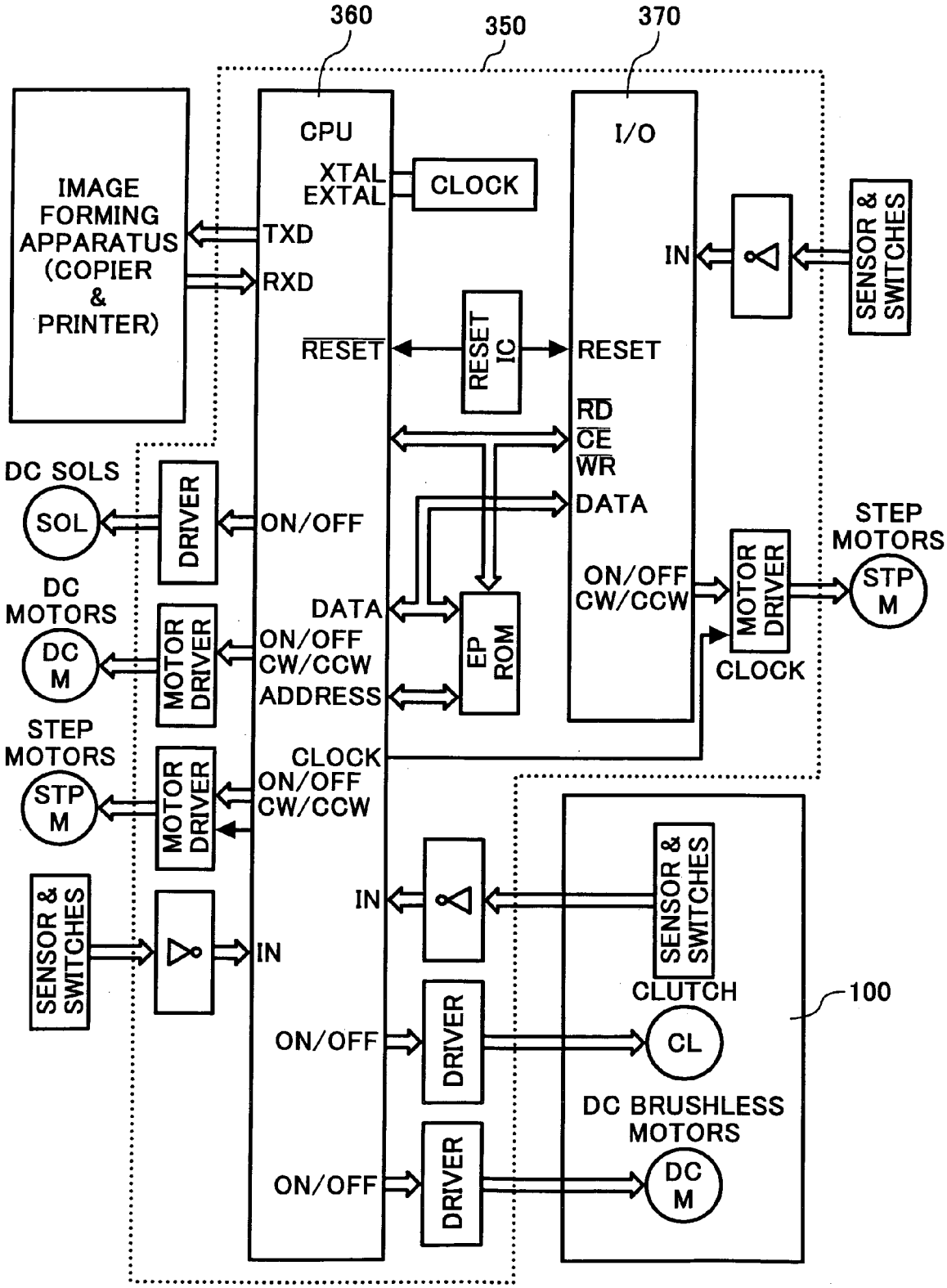
FIG. 17 is a schematic block diagram showing a control system included in the image forming system, particularly control circuitry assigned to the sheet finisher.

Reference will be made to FIG. 17 for describing a control system included in the illustrative embodiment. As shown, the control system includes a control unit 350 implemented as a microcomputer including a CPU (Central Processing Unit) 360 and an I/O (Input/Output) interface 370. The outputs of various switches arranged on a control panel, not shown, mounted on the image forming apparatus PR are input to the control unit 350 via the I/O interface 370. Also input to the control unit 350 via the I/O interface 370 are the output of the inlet sensor 301, the output of an upper outlet sensor 302, the output of a shift outlet sensor 303, the output of a prestack sensor 304, the output of a staple discharge sensor 305, the output of a sheet sensor 310, the output of the belt HP sensor 311, the output of the staple HP sensor 312, the output of the stapler oblique HP sensor 313, the output of a jogger fence HP sensor 314, the output of the guide home position sensor 315, the output of a stack arrival sensor 321, the output of a movable rear fence HP sensor 322, the output of a fold position pass sensor 323, the output of a lower outlet sensor 324, the output of a fold plate HP sensor 325, the output of sheet surface sensors 330, 330*a* and 330*b*, and the output of the guide plate sensor 331.

The CPU 360 controls, based on the above various inputs, the tray motor 168 assigned to the shift tray 202, the guide plate motor 167 assigned to the guide plate, the shift motor 169 assigned to the shift tray 202, a knock roller motor, not shown, assigned to the knock roller 12, various solenoids including the knock solenoid (SOL) 170, motors for driving the conveyor rollers, outlet motors for driving the outlet rollers, the discharge motor 157 assigned to the belt 52, the stapler motor 159 assigned to the edge stapler S1, the jogger motor 158 assigned to the jogger fences 53, the steer motor 161 assigned to the guide plate 54 and movable guide 55, a motor, not shown, assigned to rollers for conveying a sheet stack, a rear fence motor assigned to the movable rear fence 73, and a fold roller motor, not shown, assigned to the fold roller 81. The pulse signals of a staple conveyance motor, not shown, assigned to the staple discharge rollers are input to the CPU 360 and counted thereby. The CPU 360 controls the knock SOL 170 and jogger motor 158 in accordance with the number of pulse signals counted. The fold roller motor is implemented by a stepping motor and controlled by the CPU 360 either directly via a motor driver or indirectly via the I/O 370 and motor driver.

Further, the CPU 360 causes the punch unit 100 to operate by controlling a clutch or a motor. The CPU 360 controls the finisher PD in accordance with a program stored in a ROM (Read Only Memory), not shown, by using a RAM (Random Access Memory) as a work area.

Specific operations to be executed by the CPU 360 in various modes available with the illustrative embodiment will be described hereinafter.

Figure 18:
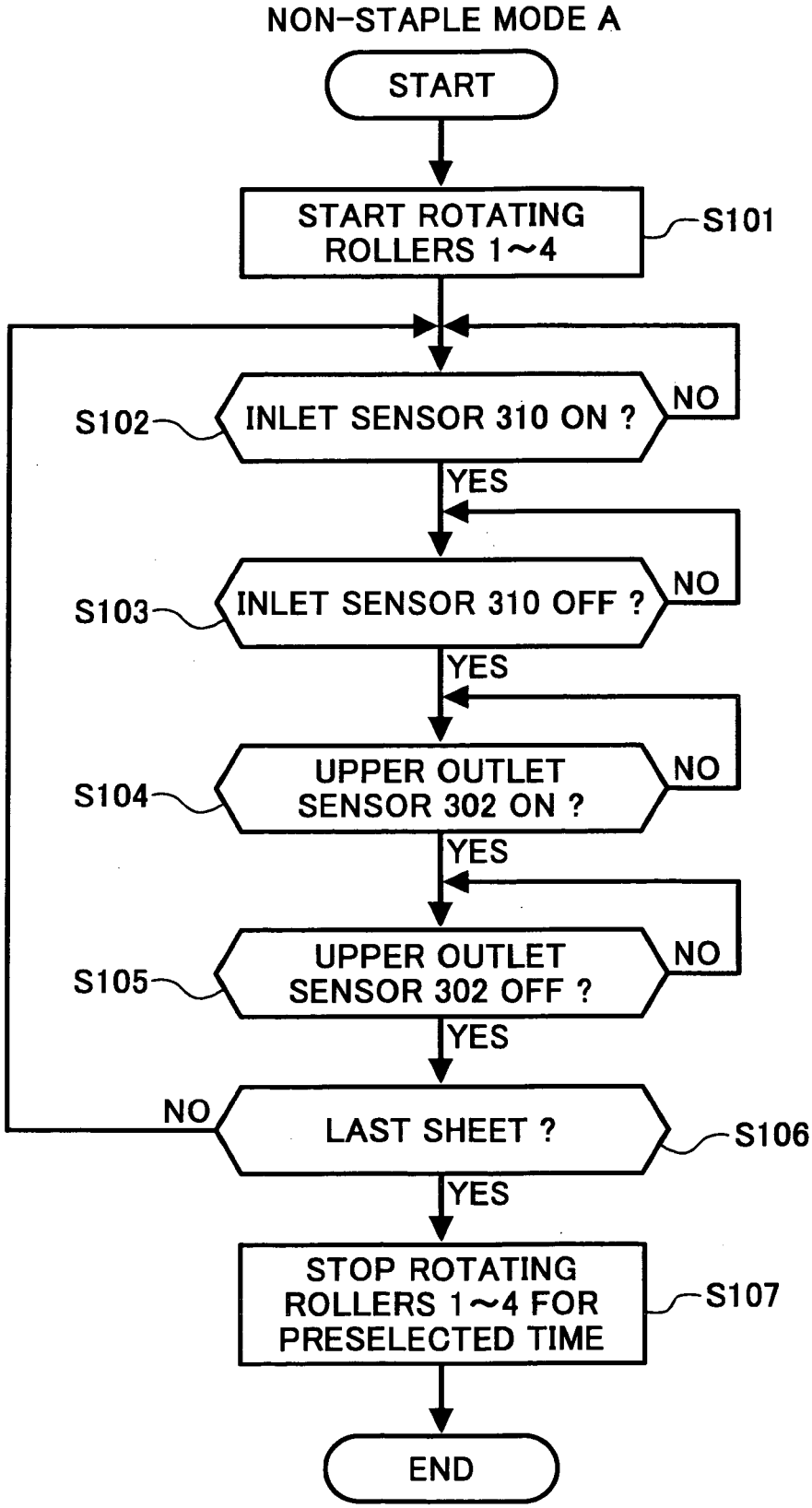
FIG. 18 is a flowchart demonstrating a non-staple mode A available with the sheet finisher.

First, in a non-staple mode A, a sheet is conveyed via the paths A and B to the upper tray 201 without being stapled. To implement this mode, the path selector 15 is moved clockwise, as viewed in FIG. 1, to unblock the path B. The operation of the CPU 360 in the non-staple mode will be described with reference to FIG. 18.

As shown, before a sheet driven out of the image forming apparatus PR enters the finisher PD, CPU 360 causes the inlet roller pair 1 and conveyor roller pair 2 on the path A to start rotating (step S101). The CPU 360 then checks the ON/OFF state of the inlet sensor 301 (steps S102 and S103) and the ON/OFF state of the upper outlet sensor 302 (steps S104 and S105) for thereby confirming the passage of sheets. When a preselected period of time elapses since the passage of the last sheet (YES, step S106), the CPU 360 causes the above rollers to stop rotating (step S107). In this manner, all the sheets handed over from the image forming apparatus PR to the finisher PD are sequentially stacked on the upper tray 201 without being stapled. If desired, the punch unit 100, which intervenes between the inlet roller pair 1 and conveyor roller pair 2, may punch the consecutive sheets.

Figure 19A:
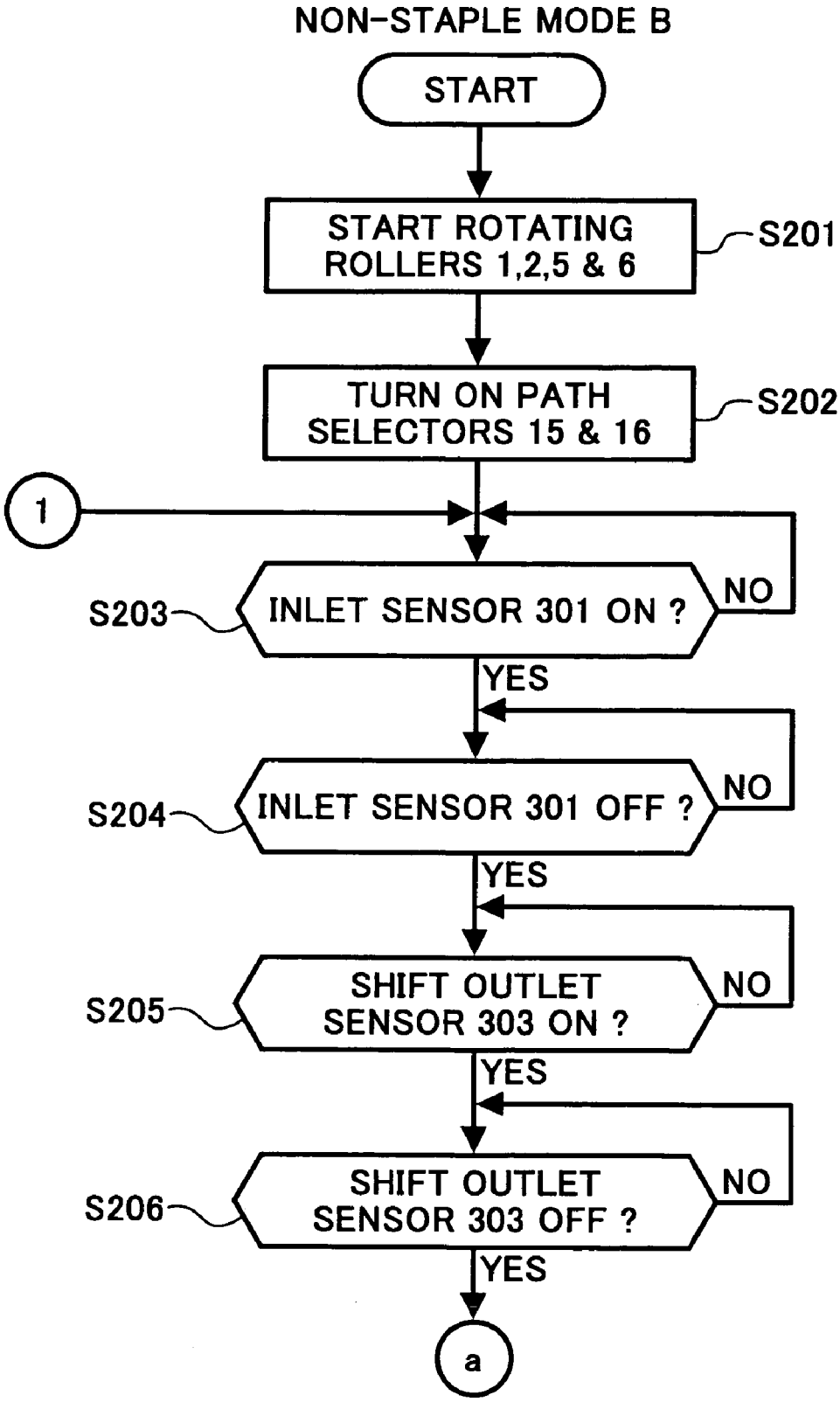
FIGS. 19A and 19B are flowcharts demonstrating a non-staple mode B available with the sheet finisher.
Figure 19B:
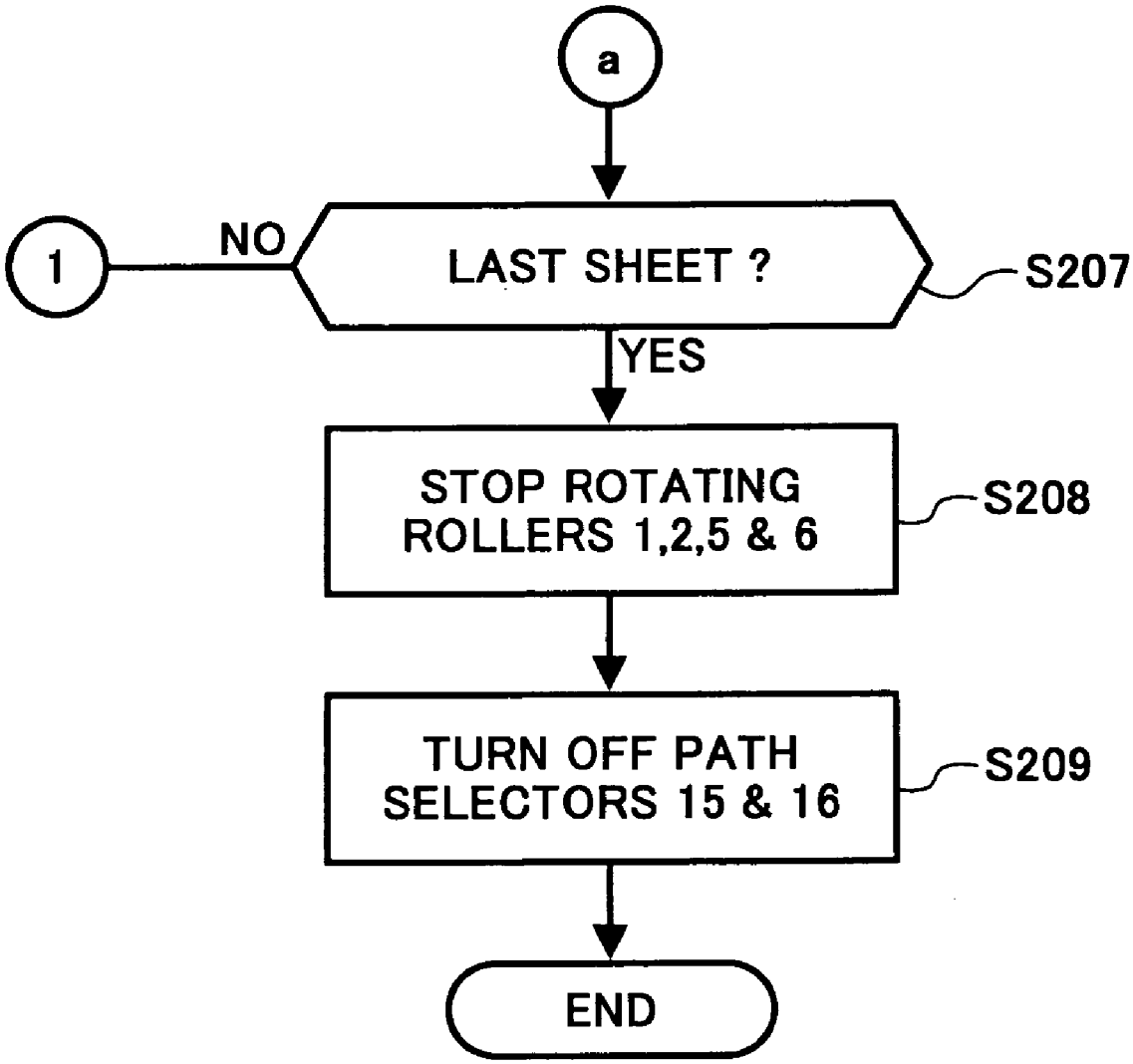

In a non-staple mode B, the sheets are routed through the paths A and C to the shift tray 202. In this mode, the path selectors 15 and 16 are respectively moved counterclockwise and clockwise, unblocking the path C. The non-staple mode B will be described with reference to FIGS. 19A and 19B.

As shown, before a sheet driven out of the image forming apparatus PR enters the finisher PD, CPU 360 causes the inlet roller pair 1 and conveyor roller pair 2 on the path A and the conveyor roller pair 5 and shift outlet roller pair 6 on the path C to start rotating (step S201). The CPU 360 then energizes the solenoids assigned to the path selectors 15 and 16 (step S202) to thereby move the path selectors 15 and 16 counterclockwise and clockwise, respectively. Subsequently, the CPU 360 checks the ON/OFF state of the inlet sensor 301 (steps S203 and S204) and the ON/OFF state of the shift outlet sensor 303 (steps S205 and S206) to thereby confirm the passage of the sheets.

On the elapse of a preselected period of time since the passage of the last sheet (YES, step S207), the CPU 360 causes the various rollers mentioned above to stop rotating (S208) and deenergizes the solenoids (steps 5209). In this manner, all the sheets that have entered the finisher PD are sequentially stacked on the shift tray 202 without being stapled. Again, the punch unit 100 intervening between the inlet roller pair 1 and conveyor roller pair 2 may punch the consecutive sheets, if desired.

Figure 20A:
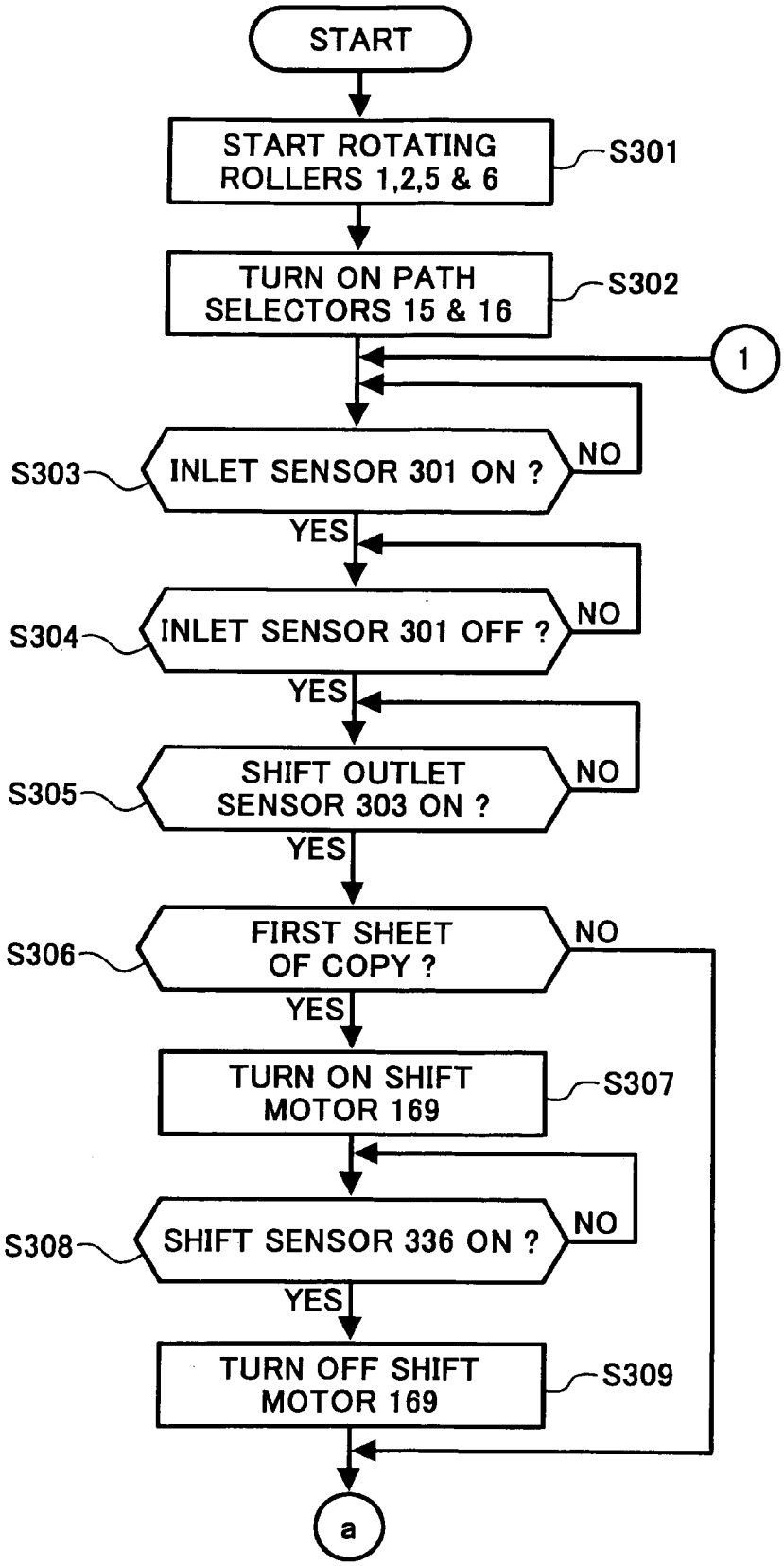
FIGS. 20A and 20B are flowcharts demonstrating a sort/stack mode available with the sheet finisher.
Figure 20B:
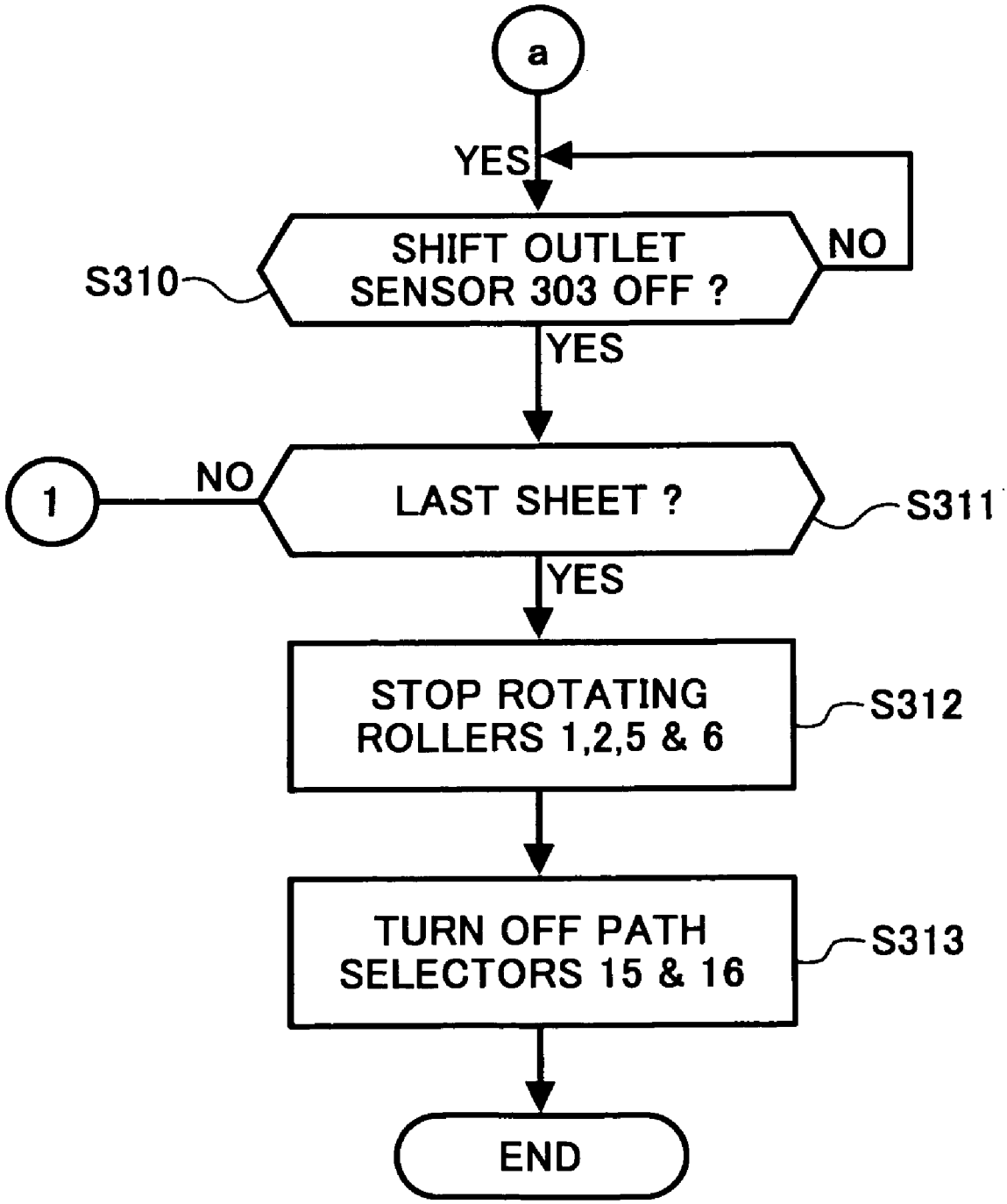

In a sort/stack mode, the sheets are also sequentially delivered from the path A to the shift tray 202 via the path C. A difference is that the shift tray 202 is shifted perpendicularly to the direction of sheet discharge copy by copy in order to sort the sheets. The path selectors 15 and 16 are respectively rotated counterclockwise and clockwise as in the non-staple mode B, thereby unblocking the path C. The sort/stack mode will be described with reference to FIGS. 20A and 20B.

As shown, before a sheet driven out of the image forming apparatus PR enters the finisher PD, CPU 360 causes the inlet roller pair 1 and conveyor roller pair 2 on the path A and the conveyor roller pair 5 and shift outlet roller pair 6 on the path C to start rotating (step S301). The CPU 360 then energizes the solenoids assigned to the path selectors 15 and 16 (step S302) to thereby move the path selectors 15 and 16 counterclockwise and clockwise, respectively. Subsequently, the CPU 360 checks the ON/OFF state of the inlet sensor 301 (steps S303 and S304) and the ON/OFF state of the shift outlet sensor 303 (step S305)

If the sheet that has passed the shift outlet sensor 303 is the first sheet of a copy (YES, step S306), then the CPU 360 turns on the shift motor 169 (step S307) to thereby move the shift tray 202 perpendicularly to the direction of sheet conveyance until the shift sensor 336 senses the tray 202 (steps S308 and S309). When the sheet moves away from the shift outlet sensor 303 (YES, step S310), the CPU 360 determines whether or not the sheet is the last sheet (step S311) If the answer of the step S311 is NO, meaning that the sheet is not the last sheet of a copy, and if the copy is not a single sheet, then the procedure returns to the step S303. If the copy is a single sheet, then the CPU 360 executes a step S312.

If the answer of the step S306 is NO, meaning that the sheet that has passed the shift outlet sensor 303 is not the first sheet of a copy, then the CPU 360 discharges the sheet (step S310) because the shift tray 202 has already been shifted. The CPU 360 then determines whether or not the discharged sheet is the last sheet (step S311). If the answer of the step S311 is NO, then the CPU 360 repeats the step S303 and successive steps with the next sheet. If the answer of the step S311 is YES, then the CPU 360 causes, on the elapse of a preselected period of time, the inlet roller pair 1, conveyor roller pairs 2 and 5 and shift outlet roller pair 6 to stop rotating (step S312) and deenergizes the solenoids assigned to the path selectors 15 and 16 (step S313). In this manner, all the sheets that have sequentially entered the finisher PD are sorted and stacked on the shift tray 202 without being stapled. In this mode, too, the punch unit 100 may punch the consecutive sheets, if desired.

Figure 21A:
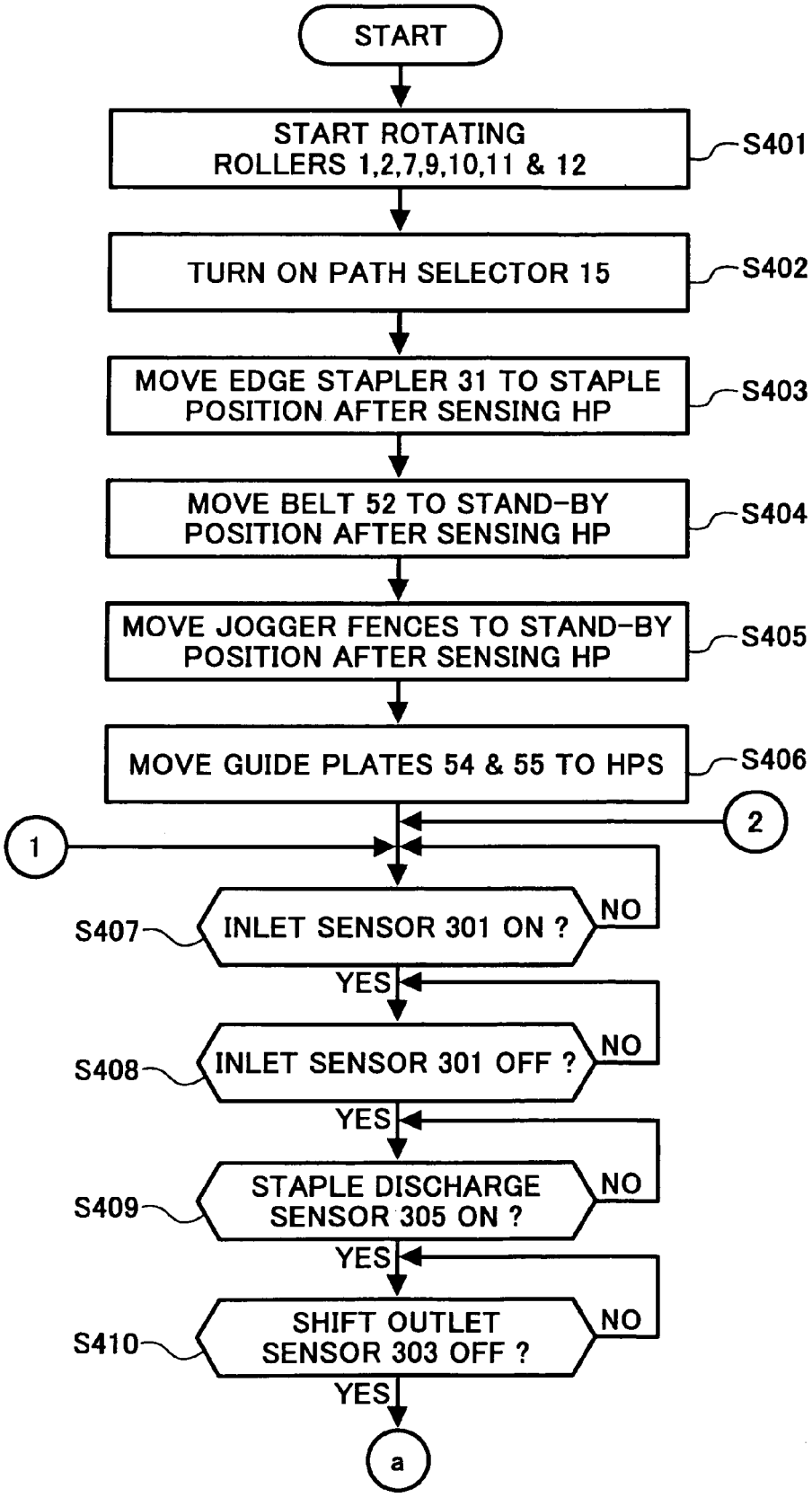
FIGS. 21A through 21C are flowcharts demonstrating a staple mode available with the sheet finisher.
Figure 21B:
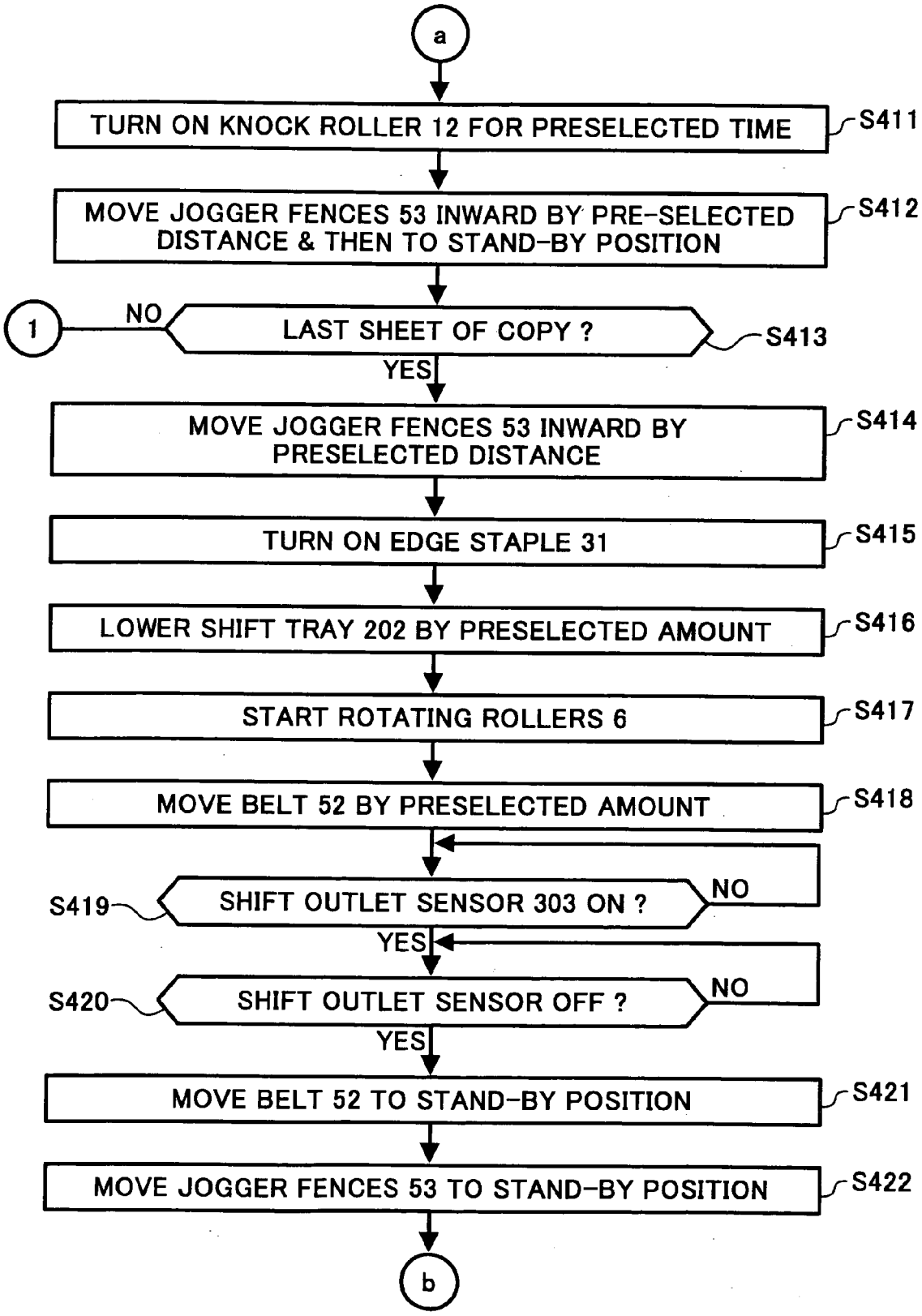
Figure 21C:
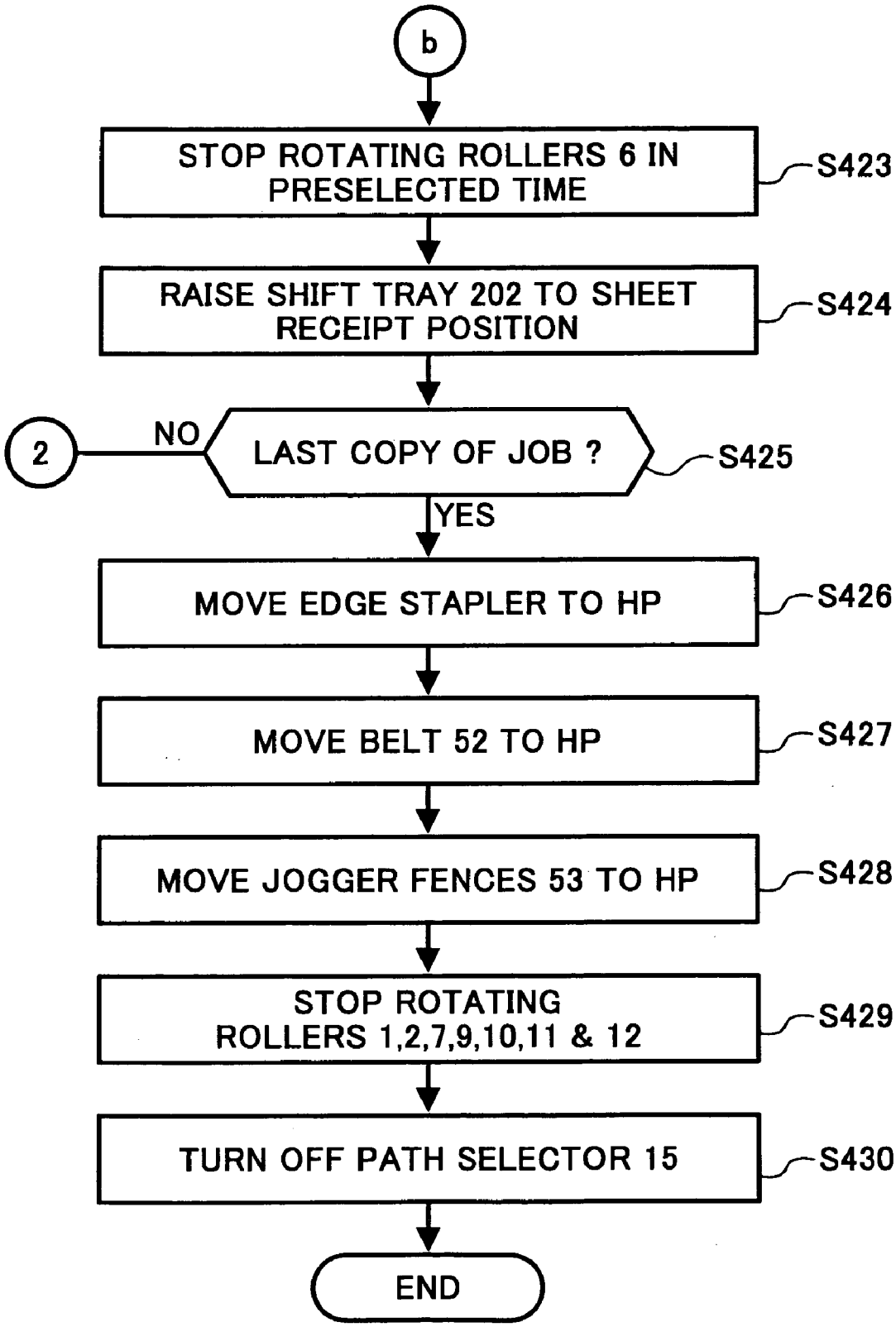

In a staple mode, the sheets are conveyed from the path A to the staple tray F via the path D, positioned and stapled on the staple tray F, and then discharged to the shift tray 202 via the path C. In this mode, the path selectors 15 and 16 both are rotated counterclockwise to unblock the route extending from the path A to the path D. The staple mode will be described with reference to FIGS. 21A through 21C.

As shown, before a sheet driven out of the image forming apparatus PR enters the finisher PD, CPU 360 causes the inlet roller pair 1 and conveyor roller pair 2 on the path A and the conveyor roller pairs 7, 9 and 10 and staple outlet roller 11 on the path D and knock roller 12 to start rotating (step S401). The CPU 360 then energizes the solenoid assigned to the path selector 15 (step S402) to thereby cause the path selector 15 to rotate counterclockwise.

After the stapler HP sensor 312 has sensed the edge stapler S1 at the home position, the CPU 360 drives the stapler motor 159 to move the edge stapler Si to a preselected stapling position (step S403). Also, after the belt HP sensor 311 has sensed the belt 52 at the home position, the CPU 360 drives the discharge motor 157 to bring the belt 52 to a stand-by position (step S404). Further, after the jogger fence motor HP sensor has sensed the jogger fences 53 at the home position, the CPU 360 moves the jogger fences 53 to a stand-by position (step S405). In addition, the CPU 360 causes the guide plate 54 and movable guide 55 to move to their home positions (step S406).

If the inlet sensor 301 has turned on (YES, step S407) and then turned off (YES, step S408), if the staple discharge sensor 305 has turned on (YES, step S409) and if the shift outlet sensor 303 has turned on (YES, step S410), then the CPU 360 determines that a sheet is present on the staple tray F. In this case, the CPU 360 energizes the knock solenoid 170 for a preselected period of time to cause the knock roller 12 to contact the sheet and force it against the rear fences 51, thereby positioning the rear edge of the sheet (step S411). Subsequently, the CPU 360 drives the jogger motor 158 to move each jogger fence 53 inward by a preselected distance for thereby positioning the sheet in the direction of width perpendicular to the direction of sheet conveyance and then returns the jogger fence 53 to the stand-by position (step S412). The CPU 360 repeats the step S407 and successive steps with every sheet. When the last sheet of a copy arrives at the staple tray F (YES, step S413), the CPU 360 moves the jogger fences 53 inward to a position where they prevent the edges of the sheets from being dislocated (step S414). In this condition, the CPU 360 turns on the stapler S1 and causes it to staple the edge of the sheet stack (step S415).

On the other hand, the CPU 360 lowers the shift tray 202 by a preselected amount (step S416) in order to produce a space for receiving the stapled sheet stack. The CPU 360 then drives the shift discharge roller pair 6 via the shift discharge motor (step S417) and drives the belt 52 by a preselected amount via the discharge motor 157 (step S418), so that the stapled sheet stack is raised toward the path C. As a result, the stapled sheet stack is driven out to the shift tray 202 via the shift outlet roller pair 6. After the shift outlet sensor 303 has turned on (step S419) and then turned off (step S420), meaning that the sheet stack has moved away from the sensor 303, the CPU 360 moves the belt 52 and jogger fences 53 to their stand-by positions (steps S421 and S422), causes the shift outlet roller pair 6 to stop rotating on the elapse of a preselected period of time (step S423), and raises the shift tray 202 to a sheet receiving position (step S424). The rise of the shift tray 202 is controlled in accordance with the output of the sheet surface sensor 330 responsive to the top of the sheet stack positioned on the shift tray 202.

After the last copy or set of sheets has been driven out to the shift tray 202, the CPU 360 returns the edge stapler S1, belt 52 and jogger fences 53 to their home positions (steps S426, S427 and S428) and causes the inlet roller pair 1, conveyor roller pairs 2, 7, 9 and 10, staple discharge roller pair 11 and knock roller 12 to stop rotating (step S429). Further, the CPU 360 deenergizes the solenoid assigned to the path selector 15 (step S430. Consequently, all the structural parts are returned to their initial positions. In this case, too, the punch unit 100 may punch the consecutive sheets before stapling.

The operation of the staple tray F in the staple mode will be described more specifically hereinafter. As shown in FIG. 6, when the staple mode is selected, the jogger fences 53 each are moved from the home position to a stand-by position 7 mm short of one end of the width of sheets to be stacked on the staple tray F (step S405). When a sheet being conveyed by the staple discharge roller pair 11 passes the staple discharge sensor 305 (step S409), the jogger fence 53 is moved inward from the stand-by position by 5 mm.

The staple discharge sensor 305 senses the trailing edge of the sheet and sends its output to the CPU 360. In response, the CPU 360 starts counting drive pulses input to the staple motor, not shown, driving the staple discharge roller pair 11. On counting a preselected number of pulses, the CPU 360 energizes the knock solenoid 170 (step S412). The knock solenoid 170 causes the knock roller 12 to contact the sheet and force it downward when energized, so that the sheet is positioned by the rear fences 51. Every time a sheet to be stacked on the staple tray F1 passes the inlet sensor 301 or the staple discharge sensor 305, the output of the sensor 301 or 305 is sent to the CPU 360, causing the CPU 360 to count the sheet.

On the elapse of a preselected period of time since the knock solenoid 170 has been turned off, the CPU 360 causes the jogger motor 158 to move each jogger fence 53 further inward by 2.6 mm and then stop it, thereby positioning the sheet in the direction of width. Subsequently, the CPU 360 moves the jogger fence 53 outward by 7.6 mm to the stand-by position and then waits for the next sheet (step S412). The CPU 360 repeats such a procedure up to the last page (step S413). The CPU 360 again causes the jogger fences 53 to move inward by 7 mm and then stop, thereby causing the jogger fences 53 to retain the opposite edges of the sheet stack to be stapled. Subsequently, on the elapse of a preselected period of time, the CPU 360 drives the edge stapler S1 via the staple motor for thereby stapling the sheet stack (step S415). If two or more stapling positions are designated, then the CPU 360 moves, after stapling at one position, the edge stapler S1 to another designated position along the rear edge of the sheet stack via the stapler motor 159. At this position, the edge stapler S1 again staples the sheet stack. This is repeated when three or more stapling positions are designated.

After the stapling operation, the CPU 360 drives the belt 52 via the discharge motor 157 (step S418). At the same time, the CPU 360 drives the outlet motor to cause the shift outlet roller pair 6 to start rotating in order to receive the stapled sheet stack lifted by the hook 52*a* (step S417). At this instant, the CPU 360 controls the jogger fences 53 in a different manner in accordance with the sheet size and the number of sheets stapled together. For example, when the number of sheets stapled together or the sheet size is smaller than a preselected value, then the CPU 360 causes the jogger fences 53 to constantly retain the opposite edges of the sheet stack until the hook 52*a* fully lifts the rear edge of the sheet stack. When a preselected number of pulses are output since the turn-on of the sheet sensor 310 or the belt HP sensor 311, the CPU 360 causes the jogger fences 53 to retract by 2 mm and release the sheet stack. The preselected number of pulses corresponds to an interval between the time when the hook 52*a* contacts the trailing edge of the sheet stack and the time when it moves away from the upper ends of the jogger fences 53.

On the other hand, when the number of sheets stapled together or the sheet size is larger than the preselected value, the CPU 360 causes the jogger fences 53 to retract by 2 mm beforehand. In any case, as soon as the stapled sheet stack moves away from the jogger fences 53, the CPU 360 moves the jogger fences 53 further outward by 5 mm to the stand-by positions (step S422) for thereby preparing it for the next sheet. If desired, the restraint to act on the sheet stack may be controlled on the basis of the distance of each jogger fence from the sheet stack.

Figure 25:
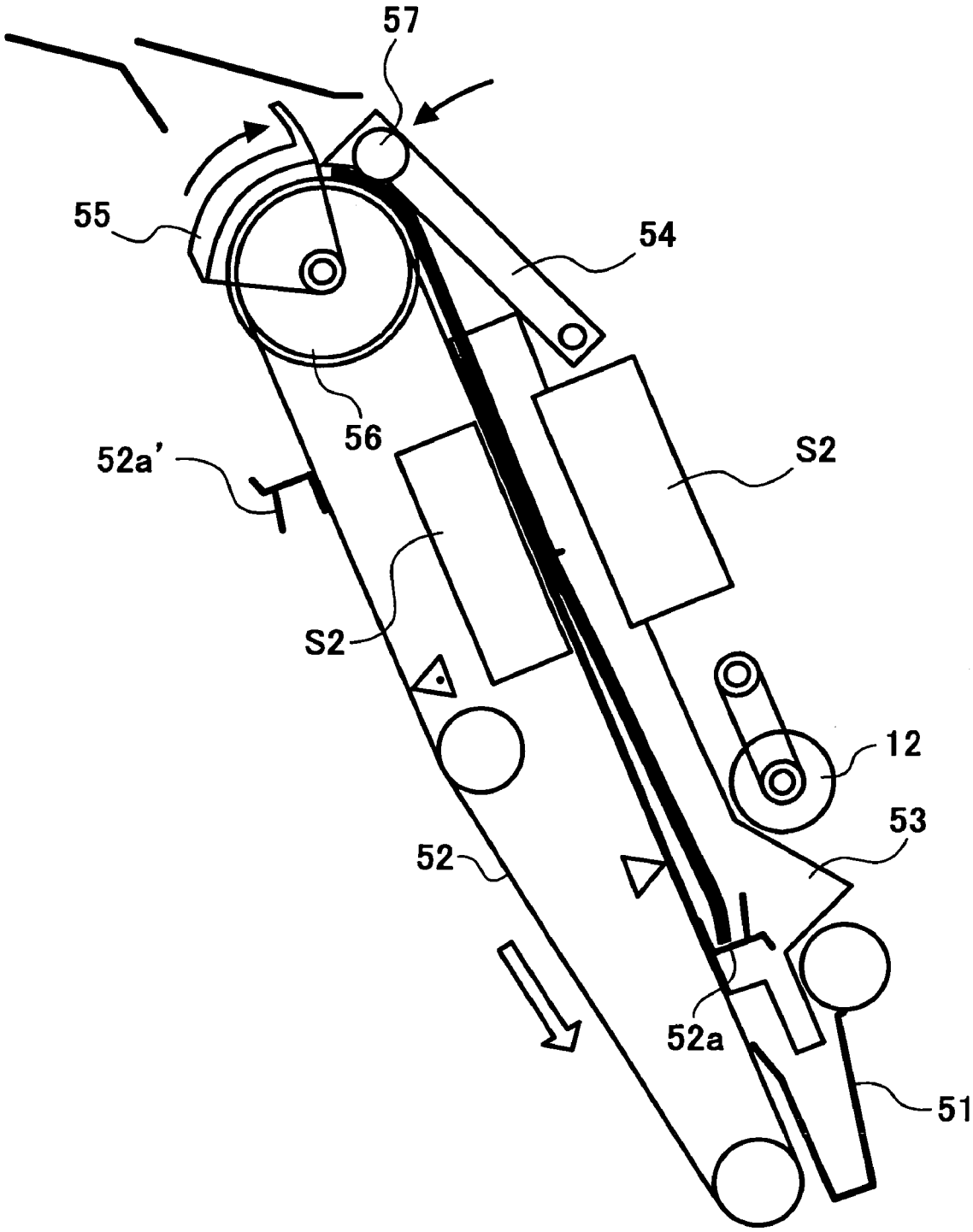
FIG. 25 shows the initial condition wherein the sheet stack steering mechanism steers a sheet stack stapled at the center on the staple tray in the center staple and fold mode.

In a center staple and bind mode, the sheets are sequentially conveyed from the path A to the staple tray F via the path D, positioned and stapled at the center on the tray F, folded on the fold tray G, and then driven out to the lower tray 203 via the path E. In this mode, the path selectors 15 and 16 both are rotated counterclockwise to unblock the route extending from the path A to the path D. Also, the guide plate 54 and movable guide plate 55 are closed, as shown in FIG. 25, guiding the stapled sheet stack to the fold tray G. The center staple and bind mode will be described with reference to FIGS. 22A through 22C.

As shown, before a sheet driven out of the image forming apparatus PR enters the finisher PD, CPU 360 causes the inlet roller pair 1 and conveyor roller pair 2 on the path A and the conveyor roller pairs 7, 9 and 10 and staple outlet roller 11 on the path D and knock roller 12 to start rotating (step S401) The CPU 360 then energizes the solenoid assigned to the path selector 15 (step S402) to thereby cause the path selector 15 to rotate counterclockwise.

Subsequently, after the belt HP sensor 311 has sensed the belt 52 at the home position, the CPU 360 drives the discharge motor 157 to move the belt 52 to the stand-by position (step S503). Also, after the jogger fence HP sensor has sensed each jogger fence 53 at the home position, the CPU 360 moves the jogger fence 53 to the stand-by position (step S504). Further, the CPU 360 moves the guide plate 54 and movable guide 55 to their home positions (steps S505).

If the inlet sensor 301 has turned on (YES, step S506) and then turned off (YES, step S507), if the staple discharge sensor 305 has turned on (YES, step S508) and if the shift outlet sensor 303 has turned on (YES, step S509), then the CPU 360 determines that a sheet is present on the staple tray F. In this case, the CPU 360 energizes the knock solenoid 170 for the preselected period of time to cause the knock roller 12 to contact the sheet and force it against the rear fences 51, thereby positioning the trailing edge of the sheet (step S510). Subsequently, the CPU 360 drives the jogger motor 158 to move each jogger fence 53 inward by the preselected distance for thereby positioning the sheet in the direction of width perpendicular to the direction of sheet conveyance and then returns the jogger fence 53 to the stand-by position (step S511). The CPU 360 repeats the step S407 and successive steps with every sheet. When the last sheet of a copy arrives at the staple tray F (YES, step S512), the CPU 360 moves the jogger fences 53 inward to the position where they prevent the edges of the sheets from being dislocated (step S513).

After the step S513, the CPU 360 turns on the discharge motor 157 to thereby move the belt 52 by a preselected amount (step S514), so that the belt 52 lifts the sheet stack to a stapling position assigned to the center staplers S2. Subsequently, the CPU 360 turns on the center staplers S2 at the intermediate portion of the sheet stack for thereby stapling the sheet stack at the center (step S515). The CPU 360 then moves the guides 54 and 55 by a preselected amount each in order to form a path directed toward the fold tray G (step S516) and causes the upper and lower roller pairs 71 and 72 of the fold tray G to start rotating (step S517). As soon as the movable rear fence 73 of the fold tray G is sensed at the home position, the CPU 360 moves the fence 73 to a stand-by position (step S518). The fold tray G is now ready to receive the stapled sheet stack.

After the step S518, the CPU 360 further moves the belt 52 by a preselected amount (step S519) and causes the discharge roller 56 and press roller 57 to nip the sheet stack and convey it to the fold tray G. After the leading edge of the stapled sheet stack has arrived at the stack arrival sensor 321 (step S520), the CPU 360 causes the fold roller pair 81 to rotate in the reverse direction (step 5521), so that the sheet stack can be conveyed downward without being folded at a portion Q (see FIG. 26). Subsequently, on the elapse of a preselected period of time in which the leading edge of the sheet stack is expected to move away from the portion Q, the CPU 360 causes the fold roller pair 81 to stop rotating (step S522) As soon as the sheet stack has been conveyed by a preselected distance, the CPU 360 causes the upper and lower roller pairs 71 and 72 to stop rotating (step S523) and then releases the lower rollers 72 from each other (step S524). Subsequently, the CPU 360 causes the fold plate 74 to start folding the sheet stack (step S525) and causes the fold roller pairs 81 and 82 and lower outlet roller pair 83 to start rotating (step S526). The CPU 360 then determines whether or not the folded sheet stack has moved away from the pass sensor 323 (steps S527 and S528). If the answer of the step S528 is YES, then the CPU 360 brings the lower rollers 72 into contact (step S529) and moves the fold plate 74 and guides 54 and 55 to their home positions (steps S530 and S531).

In the above condition, the CPU 360 determines whether or not the trailing edge of the folded sheet stack has moved away from the lower outlet sensor 324 (steps S532 and S533). If the answer of the step S533 is YES, then the CPU 360 causes the fold roller pairs 81 and 82 and lower outlet roller pair 83 to further rotate for a preselected period of time and then stop (step S534) and then causes the belt 52 and jogger fences 53 to return to the stand-by positions (steps S535 and S536). Subsequently, the CPU 360 determines whether or not the above sheet stack is the last copy of a single job to perform (step S537) If the answer of the step S537 is NO, then the procedure returns to the step S506. If the answer of the step S537 is YES, then the CPU 360 returns the belt 52 and jogger fences 53 to the home positions (steps S538 and S539). At the same time, the CPU 360 causes the inlet roller pair 1, roller pairs 2, 7, 9 and 10, staple discharge roller pair 11 and knock roller 12 to stop rotating (step S540) and turns off the solenoid assigned to the path selector 15 (step S541). As a result, all the structural parts are returned to their initial positions.

Figure 23:
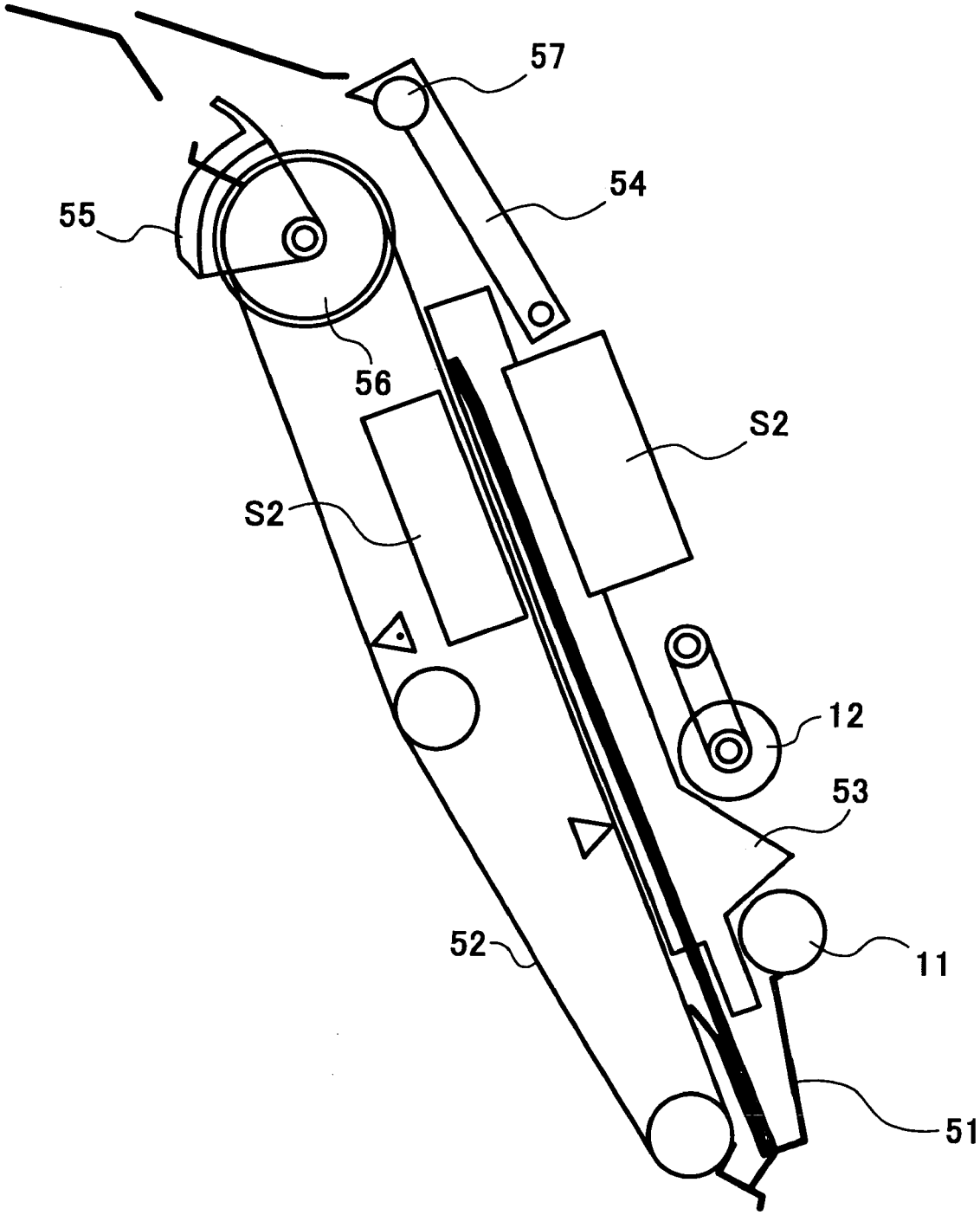
FIG. 23 shows how a sheet stack is positioned on the staple tray in the center staple and fold mode.
Figure 24:
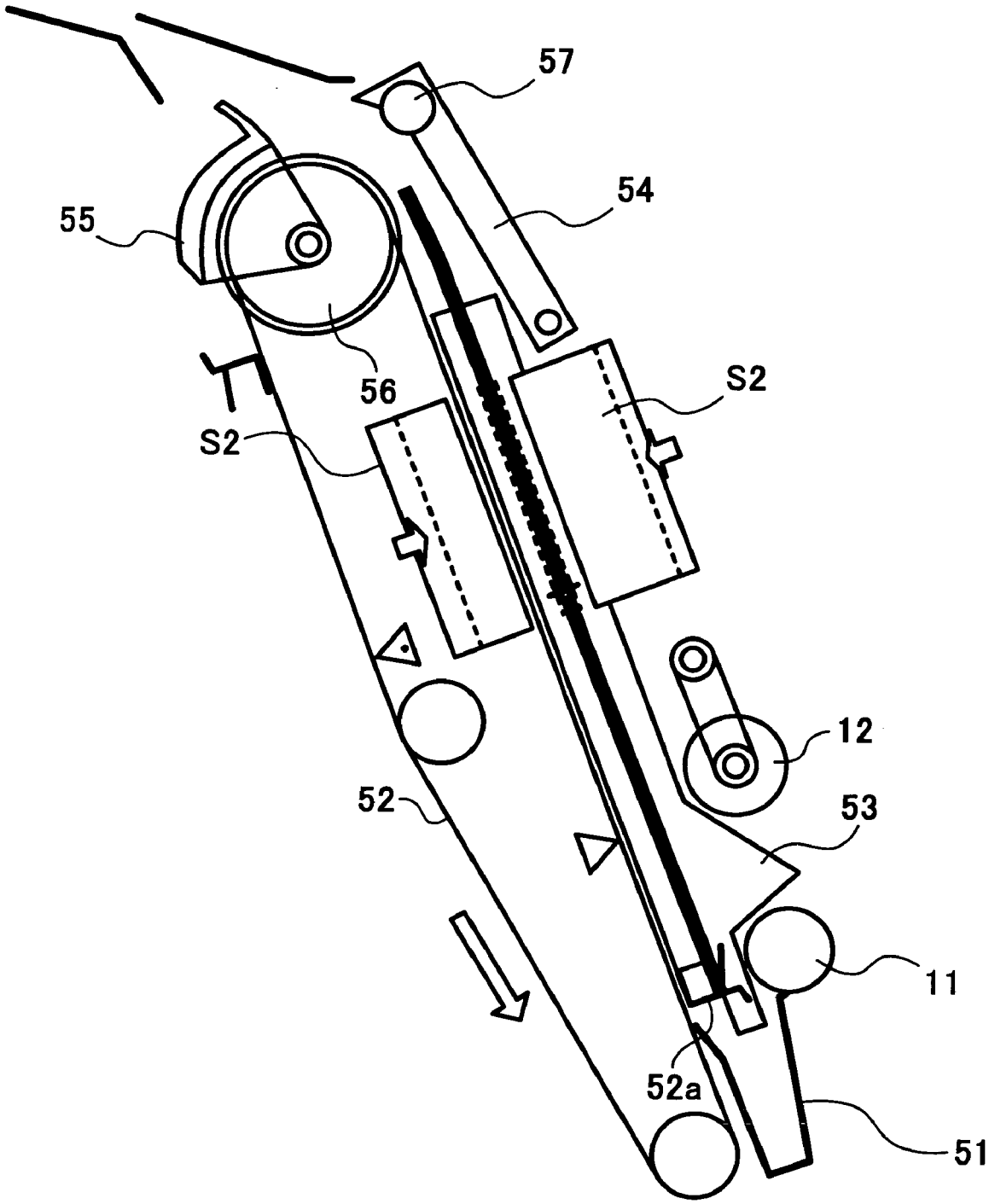
FIG. 24 shows how a sheet stack is stacked and stapled at the center on the staple tray in the center staple and fold mode.

The stapling and folding operations to be performed in the center fold mode will be described in more detail hereinafter. A sheet is steered by the path selectors 15 and 16 to the path D and then conveyed by the roller pairs 7, 9 and 10 and staple discharge roller 11 to the staple tray F. The staple tray F operates in exactly the same manner as in the staple mode stated earlier before positioning and stapling (see FIG. 23). Subsequently, as shown in FIG. 24, the hook 52*a* conveys the sheet stack to the downstream side in the direction of conveyance by a distance matching with the sheet size. After the center staplers S2 have stapled the center of the sheet stack, the sheet stack is conveyed by the hook 62*a* to the downstream side by a preselected distance matching with the sheet size and then brought to a stop. The distance of movement of the sheet stack is controlled on the basis of the drive pulses input to the discharge motor 157.

Figure 26:
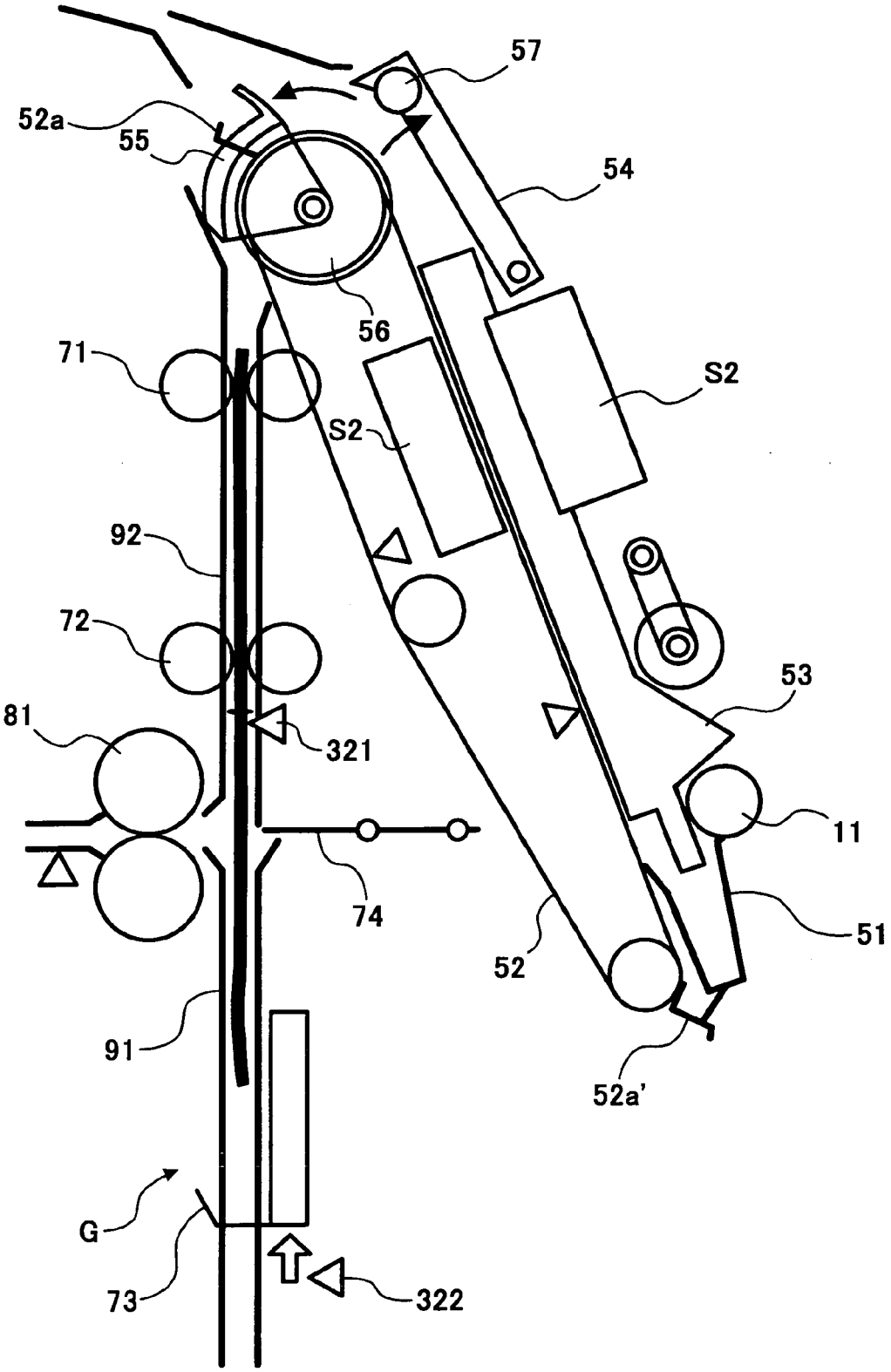
FIG. 26 shows a condition wherein the sheet stack steering mechanism has steered the sheet stack stapled in the center staple and fold mode toward a fold tray.

Subsequently, as shown in FIG. 25, the sheet stack is nipped by the discharge roller 56 and press roller 57 and then conveyed by the hook 52*a* and discharge roller 56 to the downstream side such that it passes through the path formed between the guides 54 and 55 and extending to the fold tray G. The discharge roller 56 is mounted on the drive shaft 65 associated with the belt 52 and therefore driven in synchronism with the belt 52, as stated earlier. Subsequently, as shown in FIG. 26, the sheet stack is conveyed by the upper and lower roller pairs 71 and 72 to the movable rear fence 73, which is moved from its home position to a position matching with the sheet size beforehand and held in a stop for guiding the lower edge of the sheet stack. At this instant, as soon as the other hook 52' on the belt 52 arrives at a position close to the rear fence 51, the hook 52*a* is brought to a stop while the guides 54 and 55 are returned to the home positions to wait for the next sheet stack.

Figure 27:
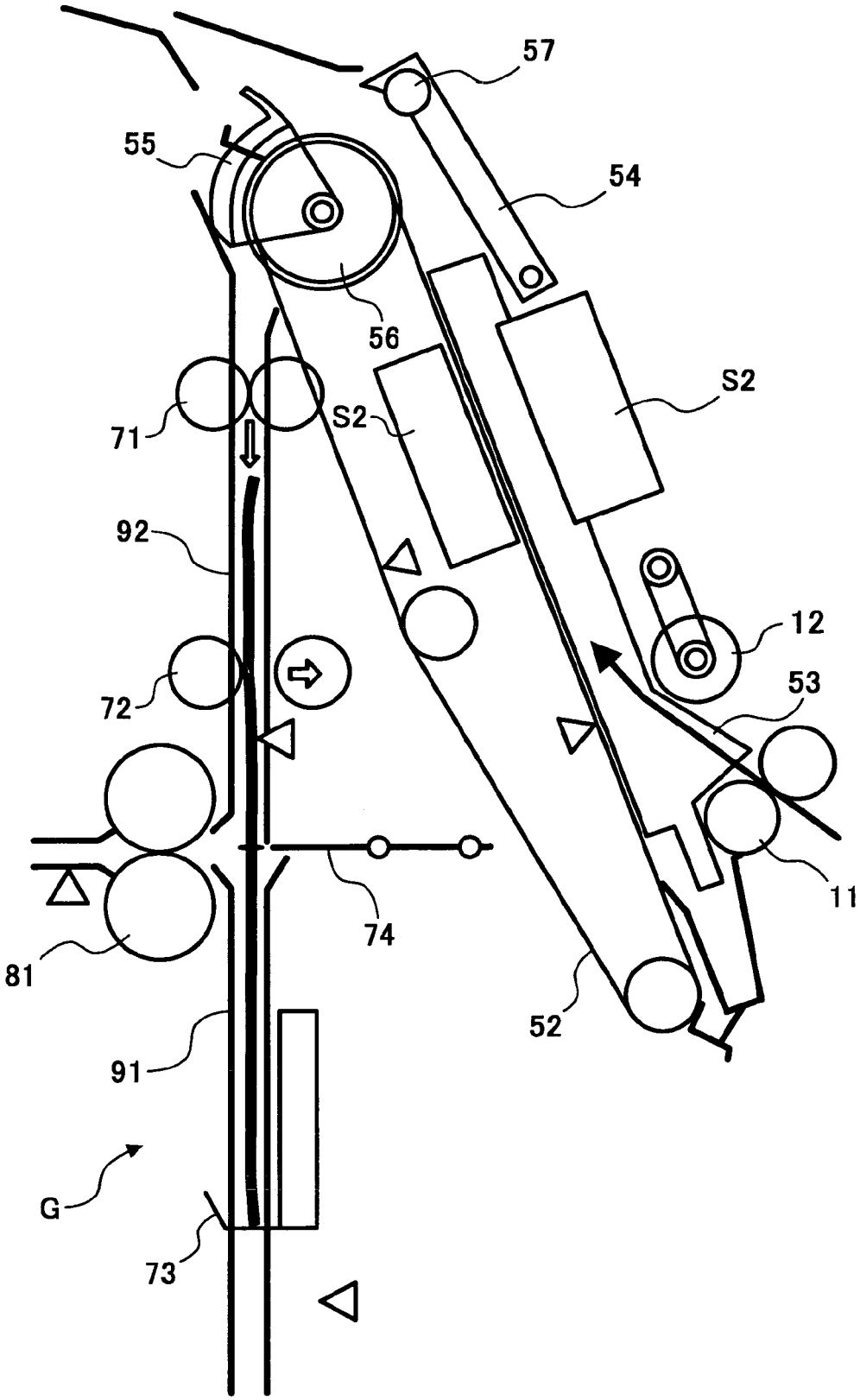
FIG. 27 shows a condition wherein the sheet stack is positioned at a fold position on the fold tray in the center staple and fold mode.
Figure 28:
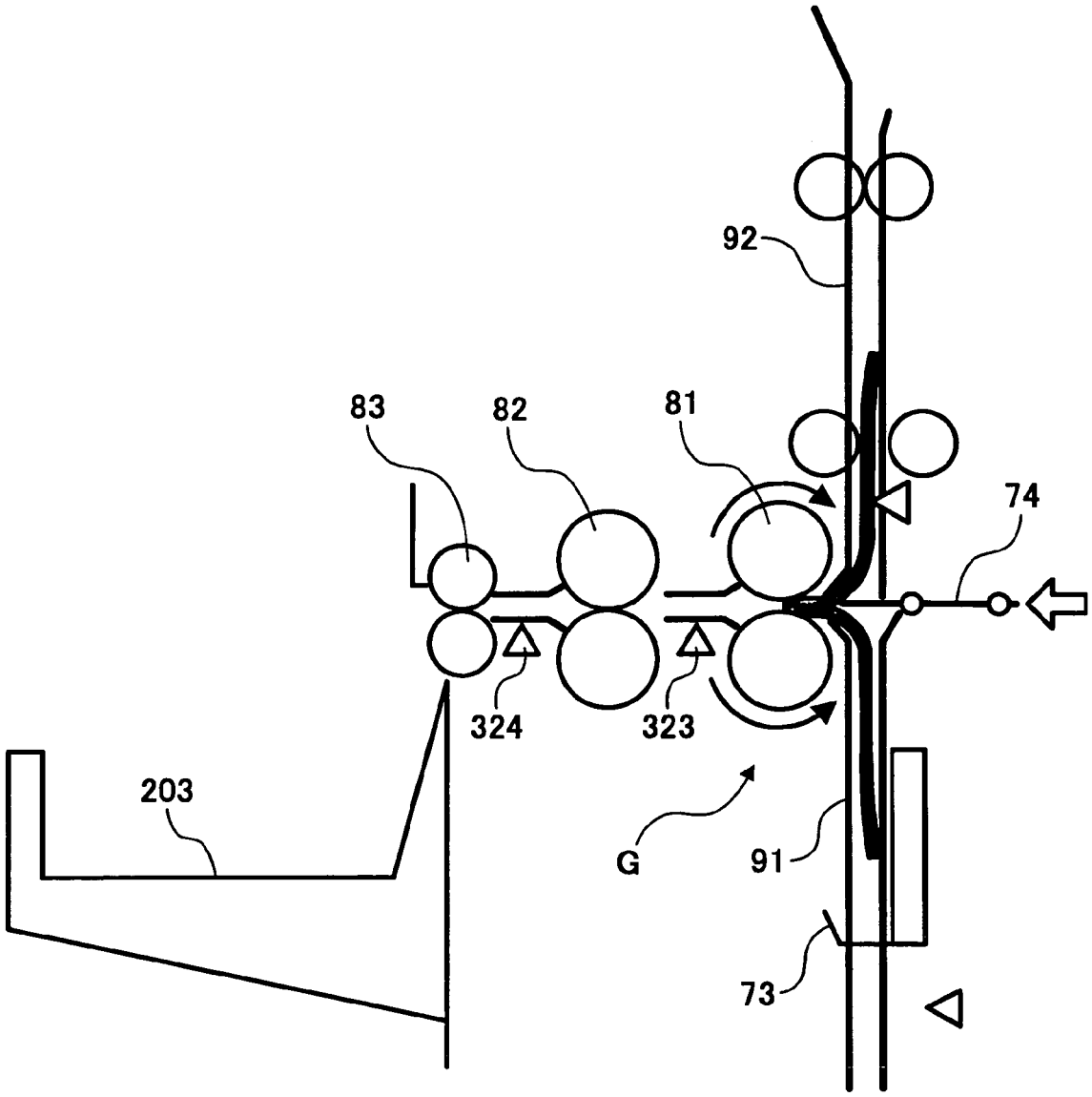
FIG. 28 shows a condition wherein a fold plate has started folding the sheet stack on the fold tray in the center staple and fold mode.

As shown in FIG. 27, the sheet stack abutted against the movable rear fence 73 is freed from the pressure of the lower roller pair 72. Subsequently, as shown in FIG. 28, the fold plate 74 pushes part of the sheet stack close to a staple toward the nip of the fold roller pair 81 substantially perpendicularly to the sheet stack. The fold roller pair 81, which is caused to rotate beforehand, conveys the sheet stack reached its nip while pressing it. As a result, the sheet stack is folded at its center.

Figure 29:
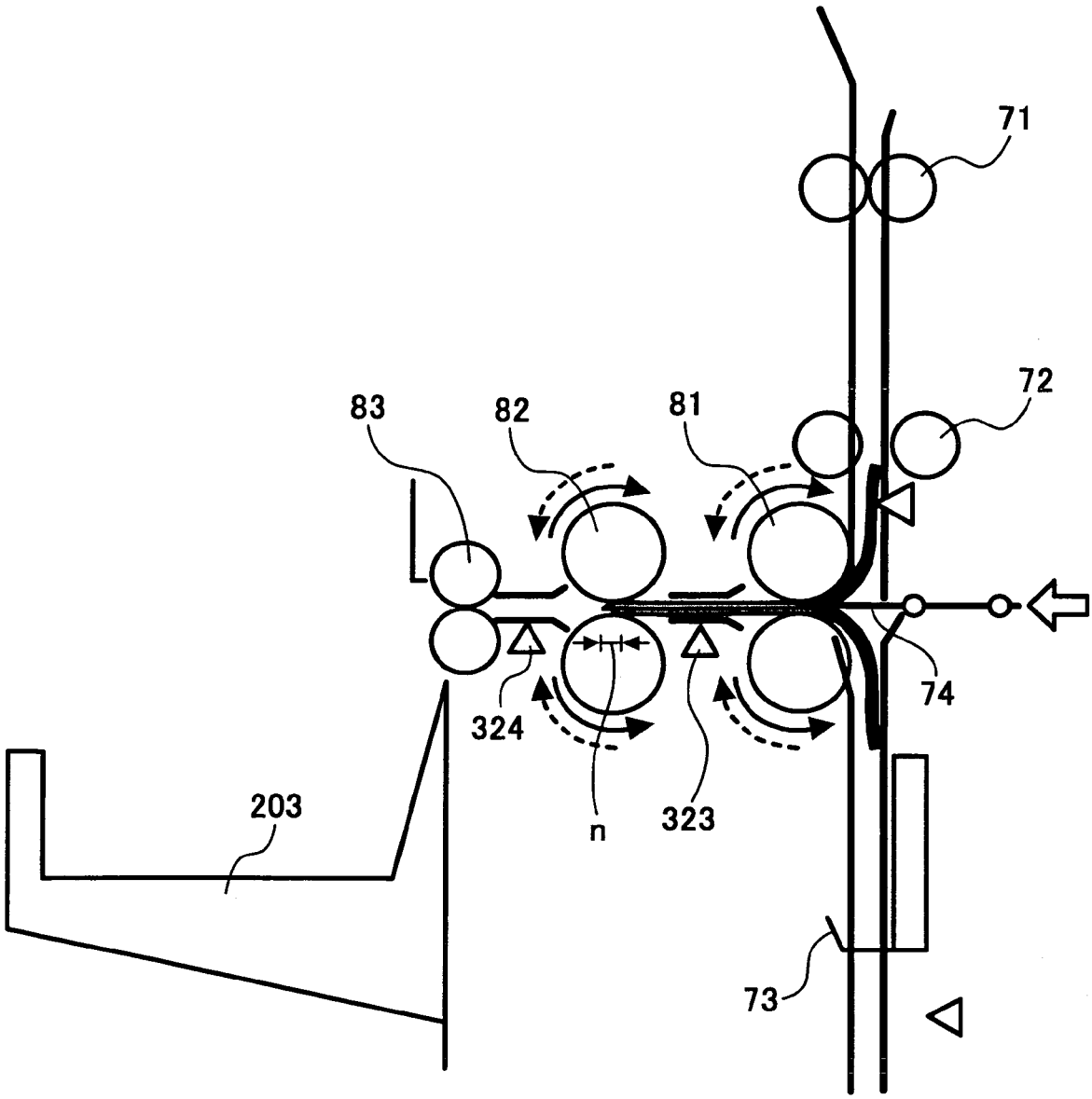
FIG. 29 shows a condition wherein after the fold plate has started folding the sheets stack on the fold tray in the center staple and fold mode, a fold roller pair at a second stage is folding the sheets stack.

As shown in FIG. 29, the leading edge of the center-folded sheet stack enters the nip of the second fold roller pair 82. At this time, the first and second fold roller pairs 81 and 82 are caused to stop rotating and then, on the elapse of a preselected period of time, resume the conveyance of the sheet stack. It is noteworthy that the preselected period of time mentioned above is variable in accordance with the number of sheets and sheet size. For example, when the number of sheets constituting a stack is relatively large, a substantial period of time elapses until the next sheet stack enters the folding section. In such a case, the above period of time may be added to the preselected period of time, so that the fold of the sheet stack can be made sharper, or more firm, without degrading the productivity of the image forming apparatus PR. Further, the fold roller pairs 81 and 82 may be repeatedly rotated in opposite directions within the preselected period of time by an amount small enough to prevent the leading edge of the sheets stack from slipping out of the nip of the fold roller pair 82, which is about several millimeters wide. This will stroke and thereby sharpen the fold of the sheet stack.

Figure 30:
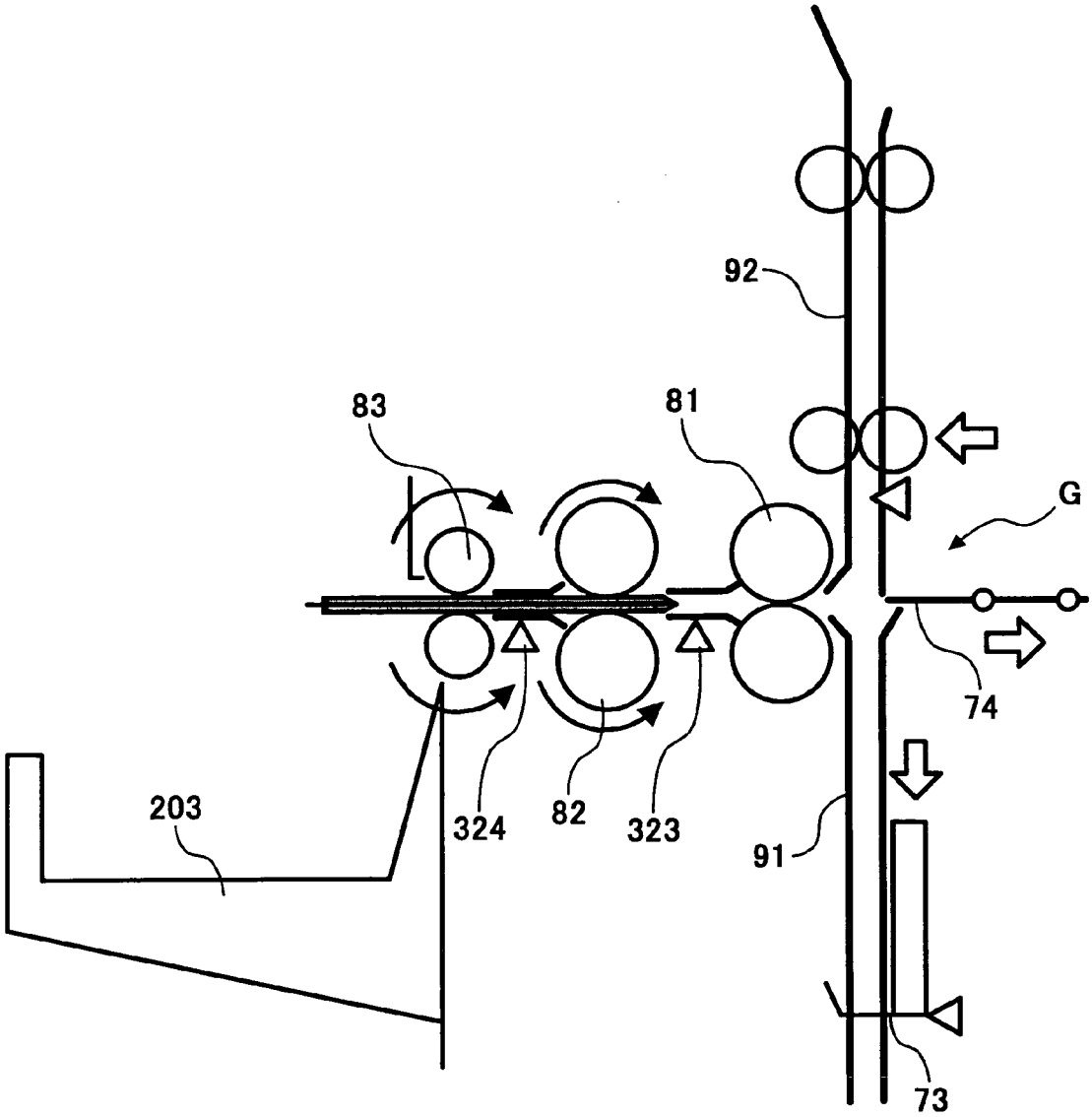
FIG. 30 shows a condition wherein the sheet stack is being driven out of the fold tray in the center staple and fold mode.

As shown in FIG. 30, the sheet stack with the fold sharpened by the fold roller pair 82 is driven out to the lower tray 203 by the lower outlet roller pair 83. At this instant, as soon as the pass sensor 323 senses the trailing edge of the sheet stack, the fold plate 74 and movable rear fence 73 are returned to their home positions while the lower roller pair 72 is released from each other so as to wait for the next sheet stack. Alternatively, the rear fence 73 may be held at the same position without being returned to the home position if the next job deals with the same sheet size and the same number of sheets.

As stated above, in the illustrative embodiment, the direction of rotation of the fold roller is switched in accordance with whether a sheet should be folded by the fold roller or whether it should be guide to a preselected position on a path before folding. It is therefore possible to guide the leading edge of a sheet stack in the direction of conveyance when the sheet stack should be introduced into the path. The illustrative embodiment therefore protects the leading edge portion of a sheet stack from bending without resorting to a shutter or similar special member, thereby insuring desirable folding and therefore desirable center stapling and folding.

More specifically, in the illustrative embodiment, the prestacking portion E is positioned on the path D, which extends to the staple tray F, and allows two or more sheets to be conveyed to the staple tray F together. Therefore, the entry of the first sheet of the next set of sheets in the stapling section can be delayed without regard to the edge/center staple mode. It follows that high productivity is achievable by the positioning and stapling time being intentionally reduced.

The comparatively short path C allows sheets to be driven out to the same tray (shift tray 202) without regard to stapling/non-stapling. Sheets can therefore be driven out in two different modes at the minimum cost.

Further, either one of the edge stapler S1 and center staplers S2, which are independent of each other, suitable for stapling is always positioned in the vicinity of the position assigned to the jogger fence 53. This successfully reduces the overall positioning and stapling time and thereby guarantees high productivity. In addition, the belt 52 and hook 52*a* can selectively move a sheet stack to the upstream side or the downstream side in the direction of conveyance, implementing the delicate adjustment of the stapling position, as desired.

Moreover, the stack moving means plays the role of an edge guide for guiding the lower edge of a sheet stack at the same time, simplifying the construction and reducing cost. In addition, the positioning position is variable in accordance with the sheet size and the number of sheets to be stapled together, so that accurate positioning and productivity are enhanced.

Second Embodiment

An alternative embodiment of the sheet finisher and image forming apparatus in accordance with the present invention will be described hereinafter. The illustrative embodiment is essentially similar to the previous embodiment except for the following.

Figure 22A:
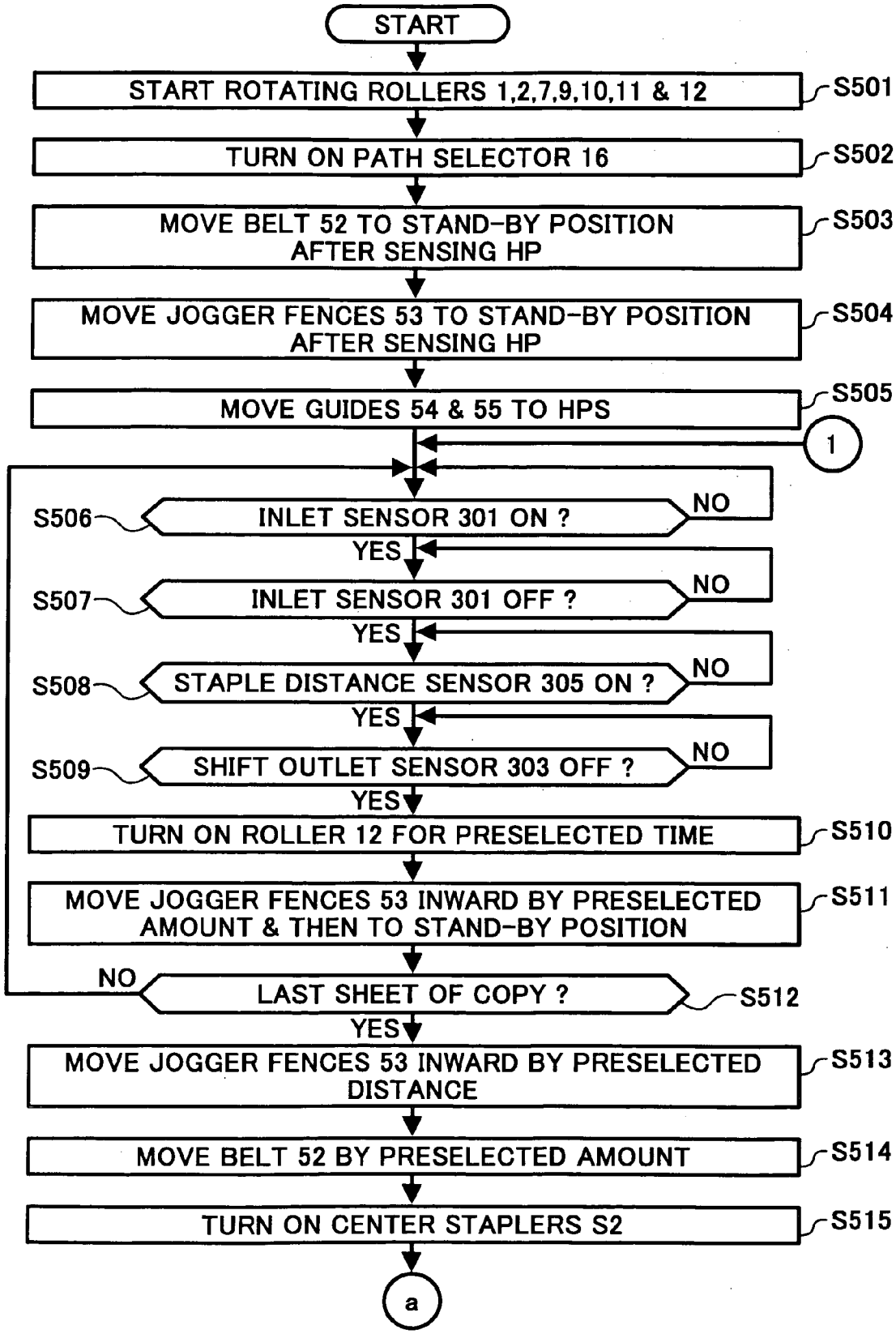
FIGS. 22A through 22C are flowcharts demonstrating a center staple mode and fold mode available with the sheet finisher.
Figure 22B:
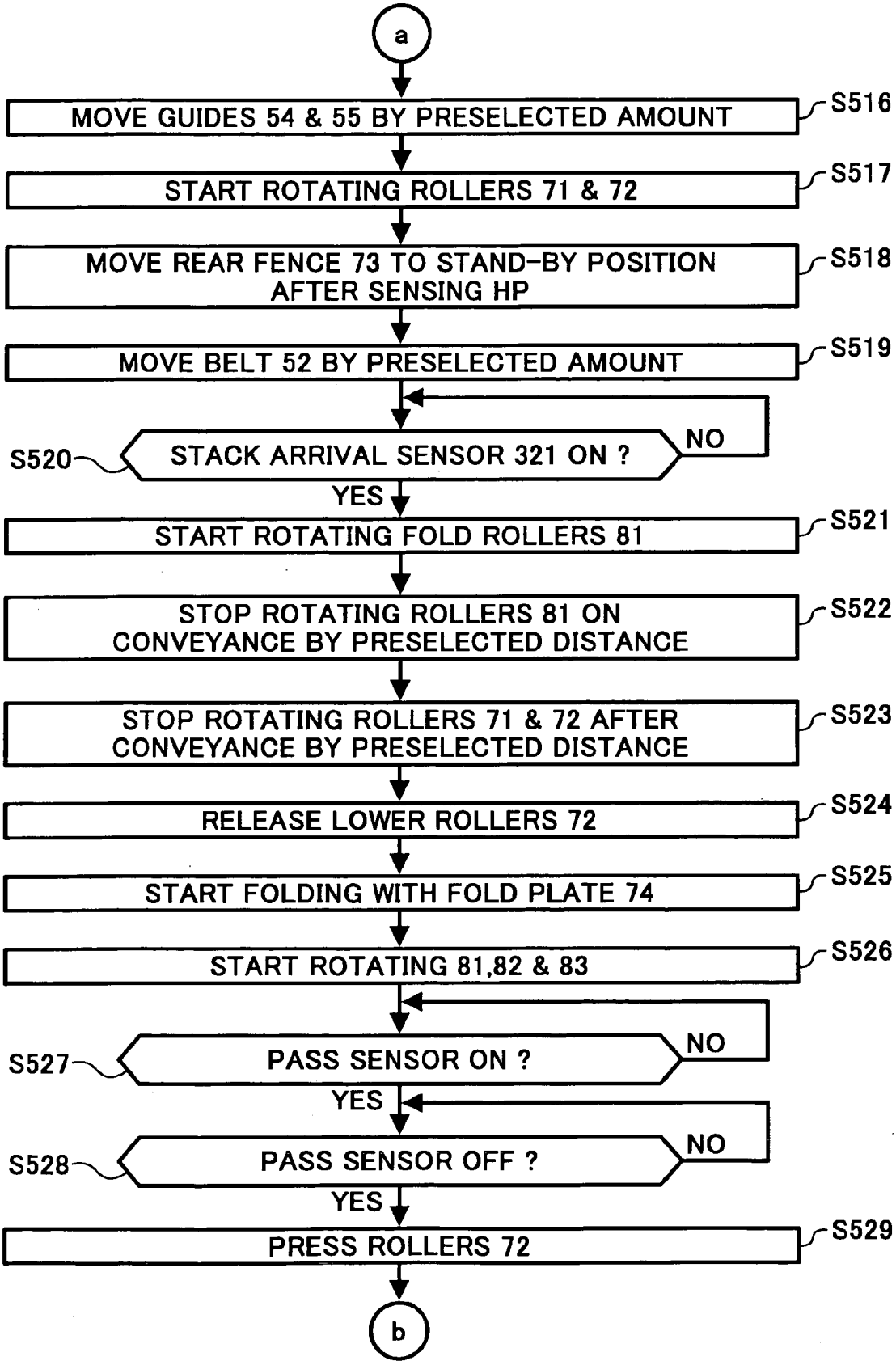
Figure 22C:
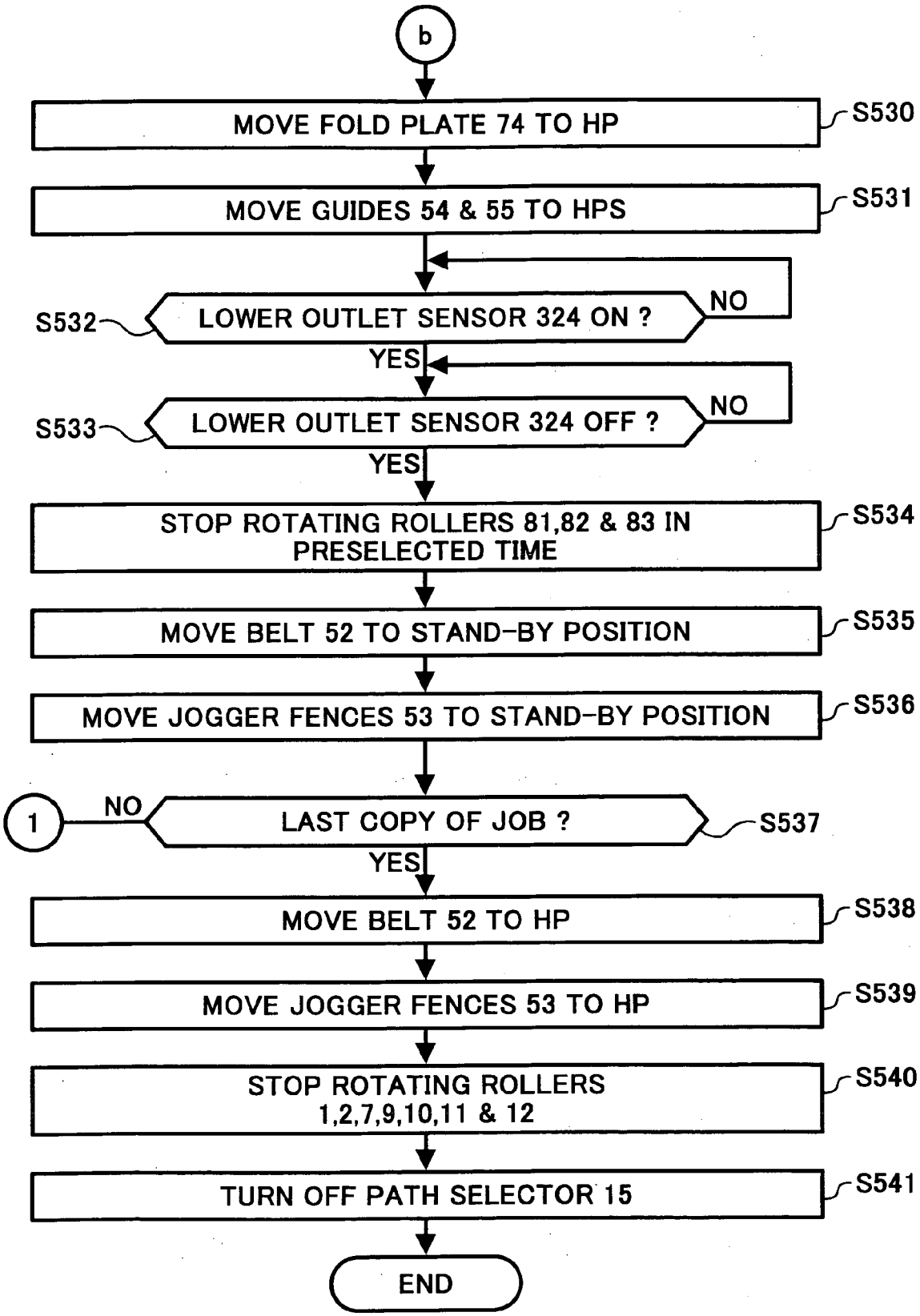

In the center staple and fold mode, the illustrative embodiment also executes the procedure shown in FIGS. 22A through 22C except for the steps S521 and S522, FIG. 22B. In the steps S527 and S528, FIG. 22B, in which the pass sensor 323 monitors the passage of the center-folded sheet stack, the illustrative embodiment executes the following processing.

Figure 31:
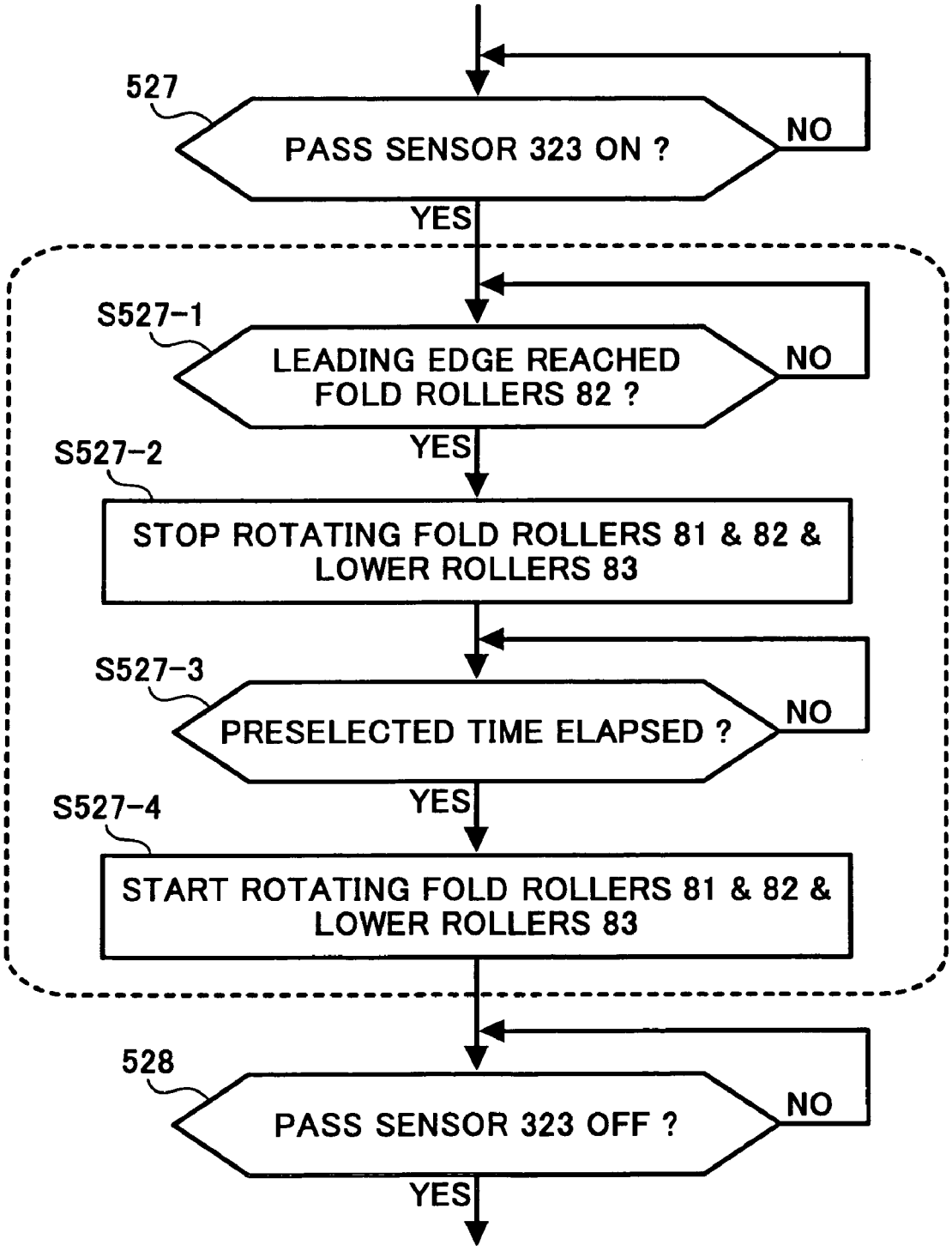
FIG. 31 is a flowchart showing how a sheet stack is positioned on the staple tray in the center staple and fold mode in accordance with a second embodiment of the present invention.

In the steps S527 and S528, the illustrative embodiment makes the fold of a sheet stack more sharp, or more firm, with a sequence of steps shown in FIG. 31. As shown, in the step S527, when the leading edge of a sheet stack moves away from the pass sensor 323, the CPU 360 determines whether or not the leading edge of the sheet stack has arrived at the fold roller pair 82 (step S527-1). If the answer of the step S527-1 is YES, then the CPU 360 causes the fold roller pairs 81 and 82 and lower outlet roller 83 to stop rotating (step S527-2). More specifically, in the step S527-1, the CPU 360 counts a period of time elapsed since the pass sensor 323 has sensed the leading edge of the sheet stack, and makes the decision on the basis of the time at which the leading edge is expected to reach the nip of the fold roller pair 82.

Figure 34:
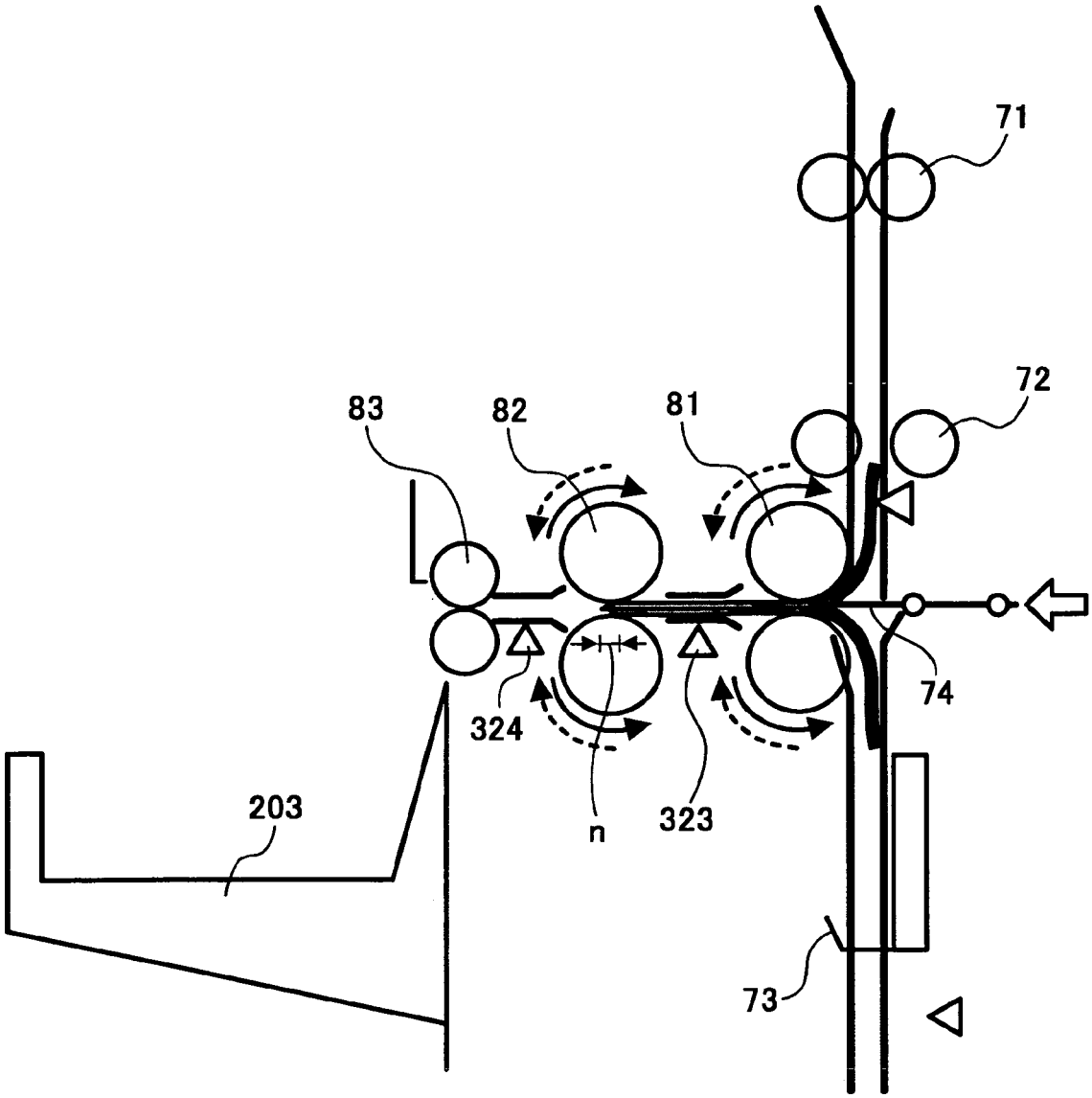
FIG. 34 shows a condition wherein after the fold plate has started folding the sheets stack on the fold tray in the center staple and fold mode, a fold roller pair at a second stage is folding the sheets stack in the second embodiment.

In the step S527-2, after the fold roller pair 82 has nipped the leading edge of the sheet stack, the CPU 360 causes both of the fold roller pairs 81 and 82 to stop rotating with the roller pair 81 nipping the intermediate portion of the sheet stack, thereby sharpening the fold of the sheet stack (see FIG. 34). Subsequently, on the elapse of a preselected period of time (YES, step S527-3), the CPU 360 causes the fold roller pairs 81 and 82 and lower outlet roller pair 83 to start rotating to thereby convey the sheet stack (step S527-4). This is followed by the step S528 and successive steps.

Figure 32:
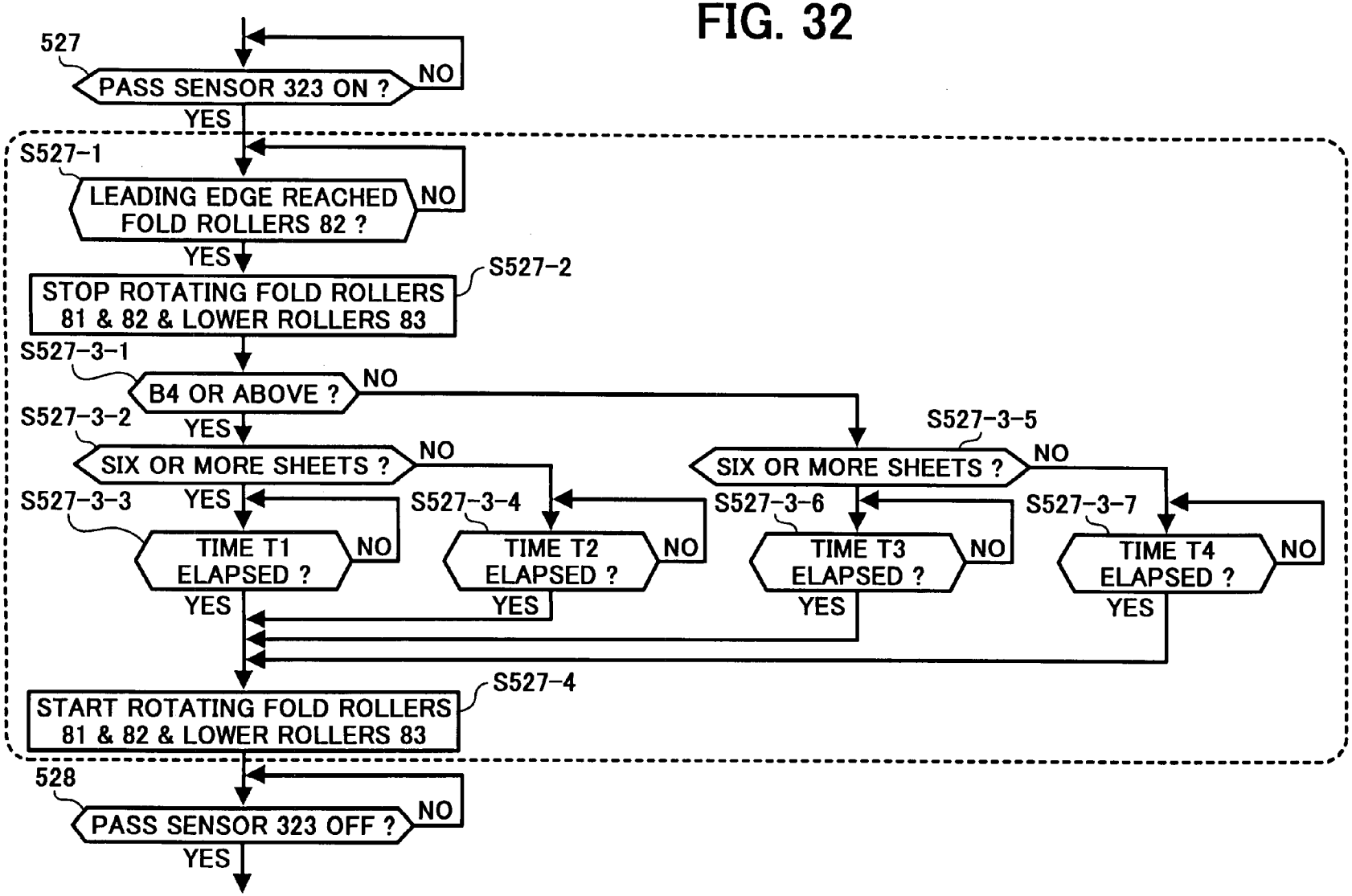
FIG. 32 is a flowchart showing how the sheet stack positioned on the staple tray is stapled at the center in the center staple and fold mode in accordance with the second embodiment.

FIG. 32 shows another specific procedure for sharpening the fold of the sheet stack. In the procedure described above, the CPU 360 causes the rollers to stop rotating by counting the preselected period of time in the step S527-3. Considering the efficiency of folding operation, the preselected period of time should preferably be varied or set in accordance with the sheet size and the number of sheets, i.e., stack thickness. For this purpose, the CPU 360 executes the procedure of FIG. 32 instead of the step S527-3 of FIG. 31.

As shown in FIG. 32, after stopping the rotation of the fold roller pairs 81 and 82 and lower outlet roller pair 83, the CPU 360 determines whether or not the size of the sheet stack is B4 or above (step S527-3-1). This decision is made on the basis of sheet size information received from the image forming apparatus PR and known beforehand. If the answer of the step S527-3-1 is YES, then the CPU 360 determines whether or not the sheet stack has six or more sheets (step S527-3-2). If the answer of the step SS27-3-2 is YES, then the CPU 360 determines whether or not a preselected period of time T1 (seconds) has elapsed (step 5527-3-3). If the answer of the step S527-3-3 is YES, then the CPU 360 again causes the fold roller pairs 81 and 82 and lower outlet roller pair 83 to rotate (step S527-4) If the answer of the step S527-3-2 is NO, then the CPU 360 executes the step S527-4 on the elapse of a preselected period of time T2 (seconds). On the other hand, if the answer of the step S527-3-1 is NO, then the CPU 360 determines whether or not the sheet stack has six or more sheets (step S527-3-5). Subsequently, the CPU 360 executes the step S527-4 on the elapse of a preselected period of time T3 (step S527-3-6) if the answer of the step S527-3-5 is YES or executes it on the elapse of a preselected period of time T4 if the answer of the step. S527-3-5 is NO.

While the periods of time T1 through T4 each are variable in accordance with the sheet size and the number of sheets, the larger the sheet size and the larger the number of sheets, the longer the period of time necessary for the next sheet stack to enter the folding section. Therefore, the period of time necessary for the next sheet stack to enter the folding section is used as a pressing time for thereby efficiency pressing the folded sheet stack without lowering productivity, i.e., without wasting time. The fold of the sheet stack is therefore sharpened and efficiently freed from a swell.

Figure 33:
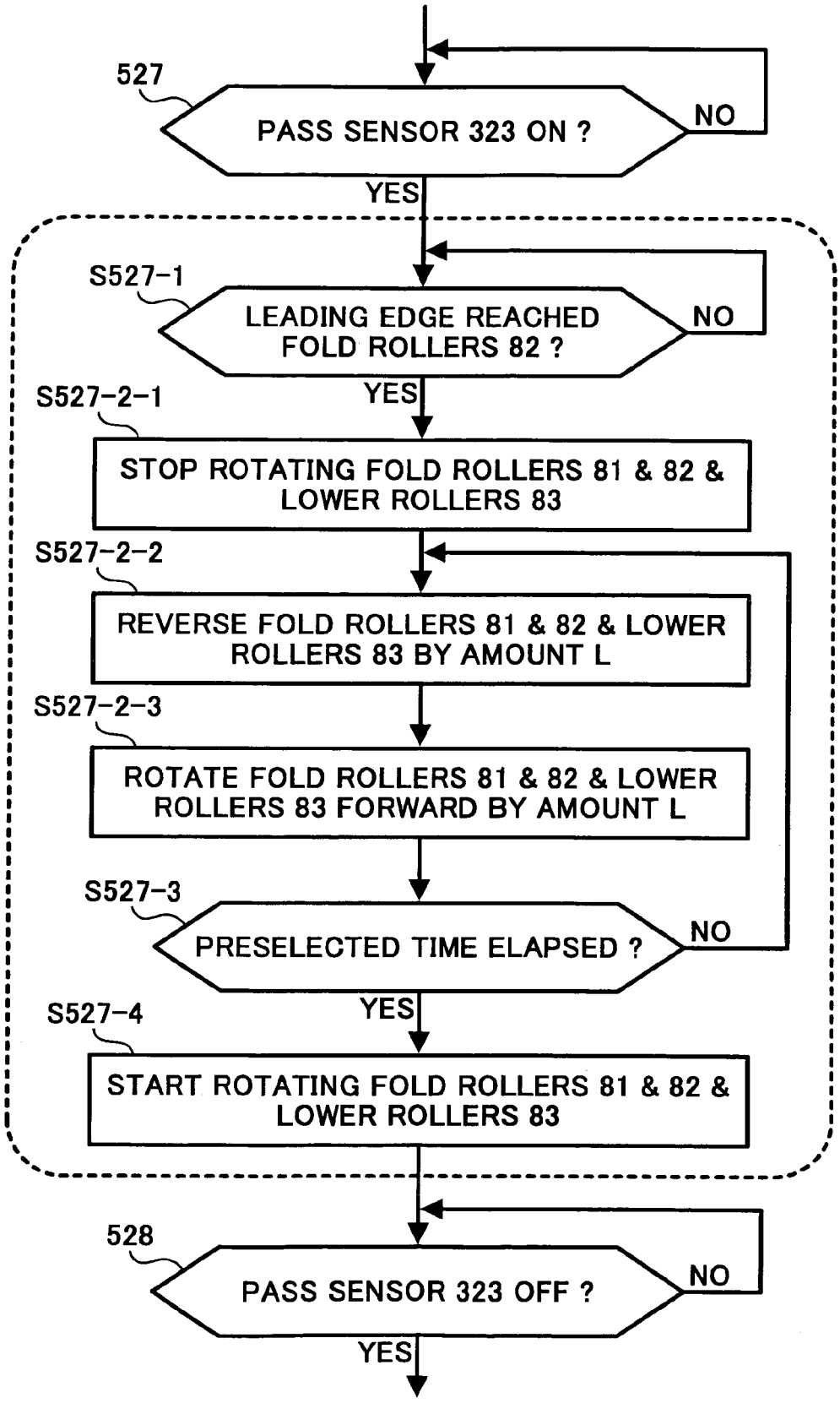
FIG. 33 is a flowchart showing how the sheet stack stapled at the center on the staple tray is steered by a steering mechanism included in the second embodiment.

FIG. 33 shows a further specific procedure for sharpening the fold of the sheet stack. In FIG. 33, steps S527-2-1 through 527-2-3 are substituted for the step S527 of FIG. 31. As shown, the CPU 360 causes the fold roller pairs 81 and 82 and lower outlet roller pair 83 to stop rotating in the step S627-2-1 and then causes them to rotate in the reverse direction by a preselected amount L in the step S627-2-2. Subsequently, the CPU 360 causes the fold roller pairs 81 and 82 and lower outlet roller pair 83 to again rotate forward by the amount L in the step S527-2-3. After the steps S527-2-2 and S527-2-3 have been repeated over the preselected period of time stated earlier, the CPU 260 causes the fold roller pairs 81 and 82 and lower outlet roller pair 83 to start rotating (step S527-4). This is followed by the step S528 and successive steps.

As stated above, within the preselected period of time for pressing the fold of the sheet stack, the procedure of FIG. 33 causes the fold roller pair 82 to repeatedly rotate in opposite directions a plurality of times by an amount small enough to prevent the leading edge of the sheet stack from slipping out of the nip of the fold roller pair 82, which is several millimeters wide. The above amount is represented by a nip length n in the direction parallel to the direction of conveyance in FIG. 34. Such stroking is also successful to make the fold of the sheet stack more firm. Further, because the leading edge of the sheet stack does not slip out of the nip of the rollers 82, part of the sheet stack around the fold is free from smears ascribable to sliding contact with the rollers 82.

It is to be noted that the duration of the reciprocating motion described with reference to FIG. 33 may also be varied in accordance with the sheet size and the number of sheets.

After the step S527-4, when the trailing edge of the sheet stack moves away from the pass sensor 323 (YES, step S528), the CPU 360 presses the lower rollers 72 against each other (step S529) and moves the fold plate 74 and guide plates 54 and 55 to their home positions (steps S530 and S531).

In the above condition, the lower outlet sensor 324 monitors the passage of the sheet stack (steps 5532 and S533). When the trailing edge of the sheet stack moves away from the lower outlet sensor 324 (YES, step S533), the CPU 360 causes the fold roller pairs 81 and 82 and lower outlet roller pair 83 to further rotate over a preselected period of time and then stop rotating (step S534). Subsequently, the CPU 360 returns the belt 52 and jogger fence 53 to their stand-by positions (steps S535 and S536) and then determines whether or not the sheet stack is the last stack to be dealt with by the job (step S537). If the answer of the step S537 is NO, then the procedure returns to the step S506. If the answer of the step S537 is YES, then the CPU 360 moves the belt 52 and jogger fence 53 to the home positions (steps S538 and S539), stops rotating the inlet roller pair 1, roller pairs 2, 7, 9 and 10, staple outlet roller pair 11, and knock roller 12 (step S540) Subsequently, the CPU 360 turns off the solenoid assigned to the path selector 15 (step S541), thereby restoring the initial condition.

The stapling and folding operations which the illustrative embodiment performs in the center staple and fold mode will be described more specifically hereinafter. As shown in FIG. 27, the rollers 72 are released from each other. Subsequently, as shown in FIG. 28, the fold plate 74 pushes the portion of the sheet stack around the staples toward the fold roller pair 81 substantially in the perpendicular direction. The fold roller pair 81 in rotation folds the sheet stack toward the center while conveying it.

As soon as the leading edge of the sheet stack enters the nip of the fold roller pair 82, the fold roller pairs 81 and 82 stop rotating and again start rotating on the elapse of a preselected period of time (corresponding to the procedure of FIG. 31). Again, the preselected period of time is variable in accordance with the sheet size and the number of sheets. More specifically, the larger the number of sheets, the longer the period of time necessary for the next sheet stack to enter the folding section; such a period of time is added to the preselected period of time (corresponding to the procedure of FIG. 32). This is also successful to efficiently press the sheet stack and therefore to sharpen the fold more without lowering the productivity of the image forming apparatus PR.

Again, within the preselected period of time, the fold roller pair 82 may be caused to repeatedly rotate in opposite directions (solid arrow and phantom arrow, FIG. 34) by an amount small enough to prevent the leading edge of the sheet stack from slipping out of the nip of the fold roller pair 82 (corresponding to FIG. 33).

As shown in FIG. 34, the sheet stack with the sharpened fold is driven out to the lower tray 203 via the lower outlet roller pair 83. At this instant, when the pass sensor 323 senses the trailing edge of the sheet stack, the fold plate 74 and movable rear fence 73 return to their home positions while the lower rollers 72 are released from each other, preparing for the next sheet stack. In desired the rear fence 73 may be held at the same position so long as the sheet size and the number of sheets to be dealt with by the next job are the same.

As stated above, the illustrative embodiment has various unprecedented advantages, as enumerated below.

(1) A fold roller pair stops the fold of a sheet stack at its nip over a preselected period of time to thereby sharpen the fold. This frees part of the sheet stack around the fold from smears ascribable to sliding contact with the roller pair, while efficiently obviating the swell of the sheets stack. This is in contrast to the conventional system in which a sheet stack is moved back and forth via the nip of a roller pair a plurality of times so as to have its fold intermittently pressed.

(2) Because the sheet stack is pressed while in a stop, it should only be nipped by the fold roller over a preselected period of time. Simple control therefore suffices for sharpening the fold.

(3) The fold of the sheet stack is pressed within the nip width of the fold roller pair parallel to the direction of conveyance. Therefore, simple control suffices for sharpening the fold if the fold roller pair is rotated in opposite directions within the above range.

(3) The duration of pressure to act on the fold of the Sheet stack is variable in accordance with the sheet size and the number of sheets constituting a stack. Therefore, by using the fact that the period of time necessary for the next sheet stack to reach a folding section increases with an increase in sheet size or the number of sheets, such a period of time can be used to press the fold. This makes it needless to add a wasteful period of time that would lower the productivity of an image forming apparatus.

Third Embodiment

Another alternative embodiment of the sheet finisher and image forming apparatus in accordance with the present invention will be described hereinafter. This embodiment is also directed mainly toward the second object and similar to the second embodiment except for the configuration and operation of the fold plate 74 and those of the fold roller pair 81. The following description will concentrate on differences between the second and third embodiments.

Figure 35:
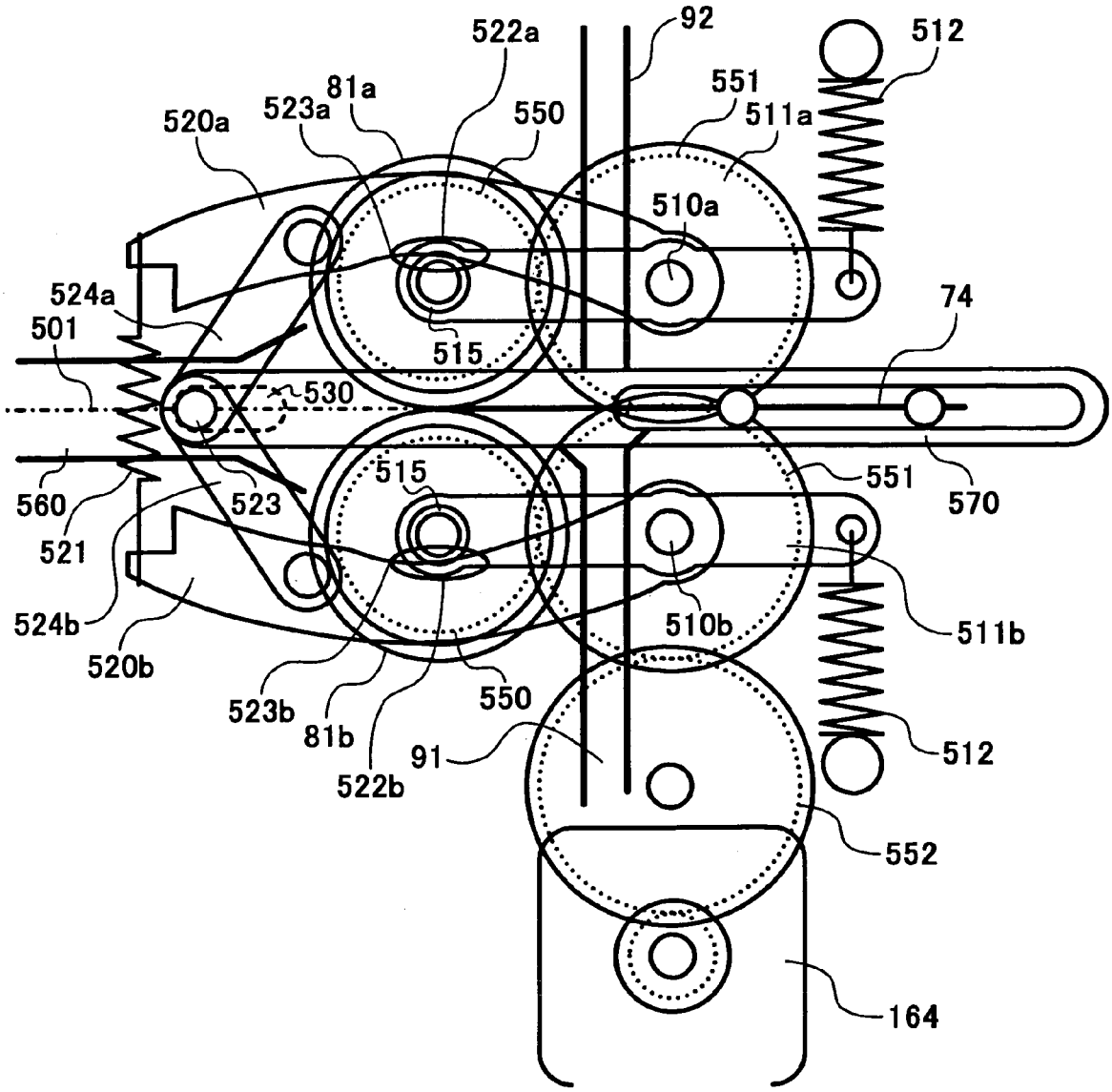
FIG. 35 shows a folding section representative of a third embodiment of the present invention in which the fold plate is held in an advanced position.
Figure 36:
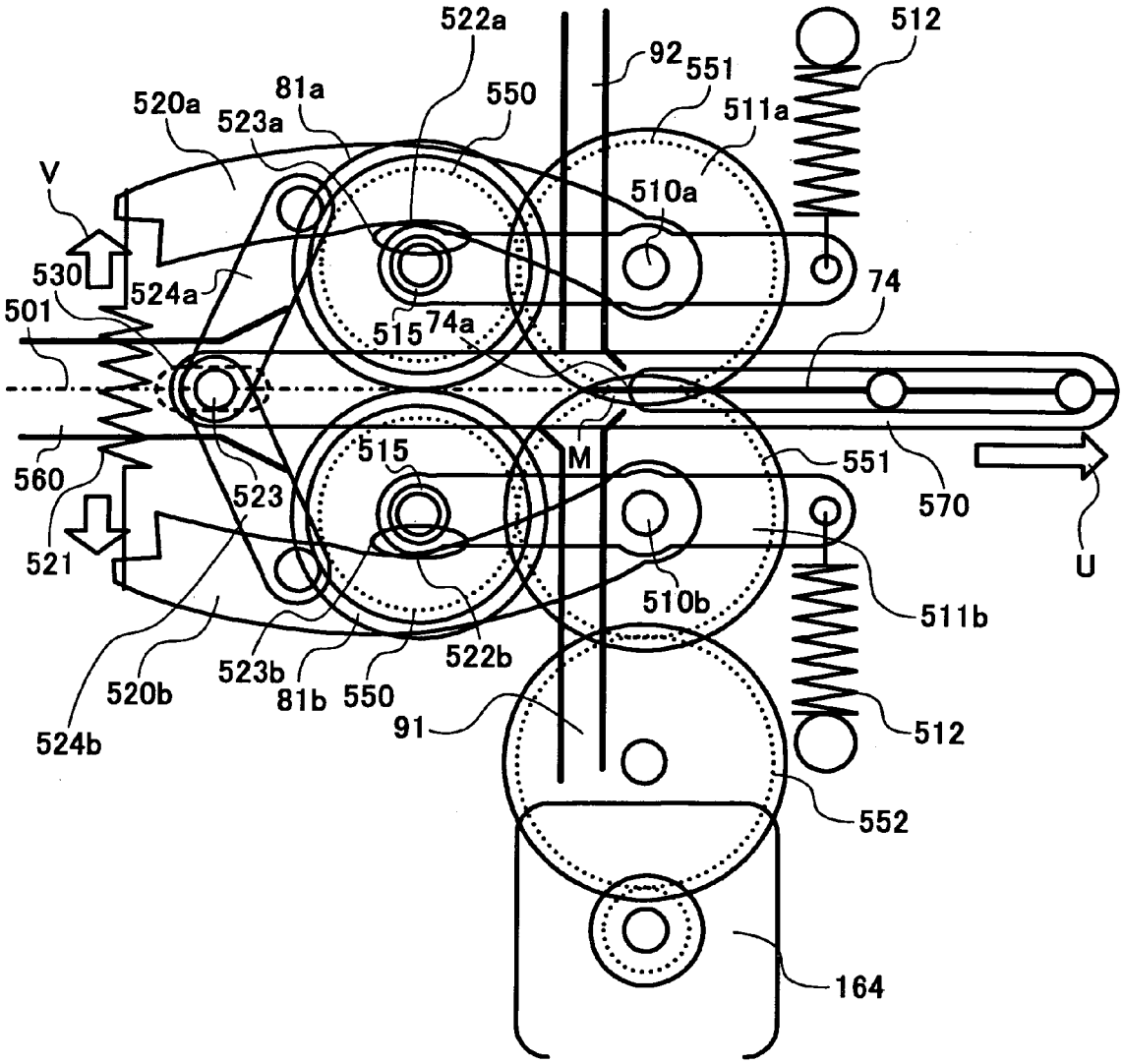
FIG. 36 is a view similar to FIG. 35, showing the fold plate in a retracted position.

FIGS. 35 and 36 show essential part of a pressure applying/canceling mechanism that allows the fold roller pair 81 (fold rollers 81*a* and 81*b*) to fold a sheet stack and is unique to the illustrative embodiment. As shown, the mechanism includes, in addition to the fold plate 74 and fold rollers 81*a* and 81*b*, angularly movable plates or first members 511*a* and 511*b*, swing arms or second members 520*a* and 520*b*, connecting members or third members 524*a* and 524*b*, first springs 512*a* and 512*b*, a second spring 521, a cancel link (or third member) 570, and a drive motor 164 assigned to the fold rollers 81*a* and 81*b*. The fold plate 74 is linearly movable back and forth, as shown in FIGS. 13 and 14. In the illustrative embodiment, the nip of the fold roller pair 81 (81*a* and 81*b*) is positioned on the locus of movement 501 of the fold plate 74.

In FIGS. 35 and 36, the various structural elements positioned above and below the locus of movement 501 are arranged substantially symmetrically to each other with respect to the locus 501 and are therefore simply distinguished from each other by suffixes a and b.

The plates 511*a* and 511*b* are angularly movably supported by fulcrums 510*a* and 510*b*, respectively, which are positioned on the front and rear side walls of the fold tray G. The swing arms 520*a* and 520*b* are respectively swingably supported by the plates 511*a* and 511*b* via bearings 515*a* and 515*b* at one end thereof. The second springs 512*a* and 512*b* respectively exert on the plates 511*a* and 511*b* pressure necessary for conveying a sheet stack at the upstream end in the direction in which the fold rollers 81*a* and 81*b* convey the sheet stack. The plates 511*a* and 511*b*, fulcrums 510*a* and 510*b*, swing arms 520*a* and 520*b* and first and second springs 512, 512*a* and 512*b* each are provided in pair on the inner surfaces of the front and rear side walls of the fold tray G, although not shown specifically. The fold rollers 81*a* and 81*b* are mounted on respective shafts expending perpendicularly to the direction of conveyance. FIGS. 35 and 36 show only the members mounted on the front side wall of the fold tray G.

At the upstream side in the direction of sheet conveyance, the first springs 512*a* and 512*b* constantly bias the plates 511*a* and 511*b*, respectively, such that their free ends tend to move toward each other. The fold rollers 81*a* and 81*b* are respectively supported by the free ends, or downstream ends, of the plates 511*a* and 511*b* via the bearings 515*a* and 515*b*.

The swing arms 520*a* and 520*b*, like the plates 511*a* and 511*b*, are respectively supported by the fulcrums 510*a* and 510*b* at their upstream ends in the direction of conveyance. The second spring 521 is anchored to the downstream ends of the swing arms 520*a* and 520*b* in the direction of conveyance at opposite ends thereof, constantly biasing the ends of the swing arms 520*a* and 520*b* toward each other. As shown in FIG. 35, the swing arms 520*a* and 520*b* are positioned above and below, respectively, the fold rollers 81*a* and 81*b*.

In the above configuration, when the bearings 515*a* and 515*b* of the fold rollers 81*a* and 81*b* are moved away from each other by a preselected distance, the bearings 515*a* and 515*b* respectively abut against the inner edges of the swing arms 520*a* and 520*b* facing each other and are therefore subject to the biasing force of the second spring 521. Before the bearings 515*a* and 515*b* abut against the above edges of the swing arms 520*a* and 520*b*, the fold rollers 81*a* and 81*b* are subject to the biasing forces of the first springs 512*a* and 512*b*.

More specifically, the bias of the second spring 521 is selected to be heavier than the bias of the first springs 512*a* and 512*b*. Therefore, when a sheet stack enters the nip between the fold rollers 81*a* and 81*b*, the comparatively light bias of the springs 512*a* and 512*b* acts on the sheet stack. Subsequently, when the bearings 515*a* and 515*b* of the fold rollers 81*a* and 81*b* abut against the swing arms 520*a* and 520*b*, respectively, the comparatively heavy bias of the spring 521 acts on the sheet stack. In this configuration, the play between the position where the fold rollers 81*a* and 81*b* contact each other and the position where the bearings 515*a* and 515*b* respectively contact the swing arms 520*a* and 520*b* plays an essential role in introducing a sheet stack to the nip between the fold rollers 81*a* and 81*b*.

The drive motor 164 assigned to the fold rollers 81*a* and 81*b* and a drive transmission mechanism associated therewith are used because the fold rollers 81*a* and 81*b* not only fold a sheet stack, but also convey it. The drive transmission mechanism is implemented as a reduction gear train including gears 552, 551*b* and 551*a* held in mesh with a gear mounted on the output shaft of the drive motor 164. The gears 551*b* and 551*a* are respectively held in mesh with gears 550*b* and 550*a*, which are respectively coaxial with the fold rollers 81*a* and 81*b*, causing the fold rollers 81*a* and 81*b* to rotate at the same speed as each other.

The cancel links 570, respectively positioned on the inner surfaces of the front and rear side walls, move back and forth along the locus 501 in interlocked relation to the fold plate 74. The release links 570 cancel the pressure acting on the fold rollers 81*a* and 81*b* by regulating the positions of the swing arms 520*a* and 520*b*. More specifically, the connecting members 524*a* and 524*b* respectively connect the swing arms 520*a* and 520*b* and a movable shaft 523 positioned downstream of the fold rollers 81*a* and 81*b* in the direction of conveyance, thereby relating the position of the cancel links 570 and swing arms 520*a* and 520*b*. In this condition, the positions of the cancel links 570 determine the timing for exerting pressure on a sheet stack and the timing for canceling it.

The movable range of the shaft 523 is determined by the dimension of a guide slot 530, which extends in parallel to the locus 501, in the direction of the locus 501. The movable range of the shaft 523 regulates the maximum gap between the fold rollers 81*a* and 81*b*. A path 560 along which a sheet stack is conveyed in a folded position is positioned such that the locus 501 is located at the center of the gap. The guide slot 530 that determines the movable range is only illustrative. Alternatively, the connecting members 524*a* and 524*b* each may be connected to the swing arm 520*a* or 520*b* by a single member, in which case the connecting portion will be implemented as a slot having a preselected dimension.

In the above configuration, the movement of the shaft 520 in the direction of sheet discharge is regulated by the dimension of the guide slot 530, so that gaps or plays 523*a* and 523*b* are available between the swing arms 520*a* and 520*b* and the bearings 515*a* and 515*b* at fold roller pressing portions 522*a* and 522*b*. In this condition, the transfer of the bias of the first spring 521 is regulated.

The second springs 512*a* and 512*b* each may be replaced with a compression spring inserted in the fold roller pressing portion 522*a* or 522*b* so as to exert the comparatively light bias. The dimension of each of the gaps 523*a* and 523*b* is determined by the position of the downstream end of the guide slot 530 in the direction of conveyance. It follows that the amount of play and the maximum gap between the fold rollers 81*a* and 81*b* are determined by the position of the slide guide 530 and the dimension of the cancel link 570 in the direction of movement.

The shaft 523 is connected to each cancel link 570, as stated earlier. Therefore, when the cancel link 570 is moved in a direction indicated by an arrow U, the swing arms 520*a* and 520*b* each swing in a direction indicated by an arrow V with the result that a space is formed between each swing arm 520*a* or 520*b* and the associated bearing 515*a* or 515*b* at the fold roller pressing portion 522*a* or 522*b*. Consequently, the transfer of the bias of the first spring 521 is canceled.

Figure 37:
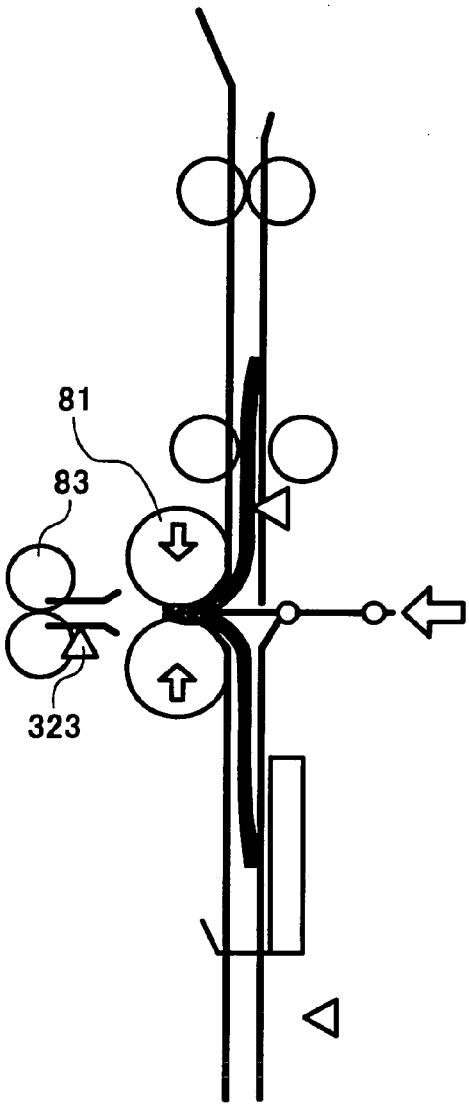
FIG. 37 shows a condition wherein the fold plate has started folding a sheet stack in the center staple and fold mode in the third embodiment.
Figure 38:
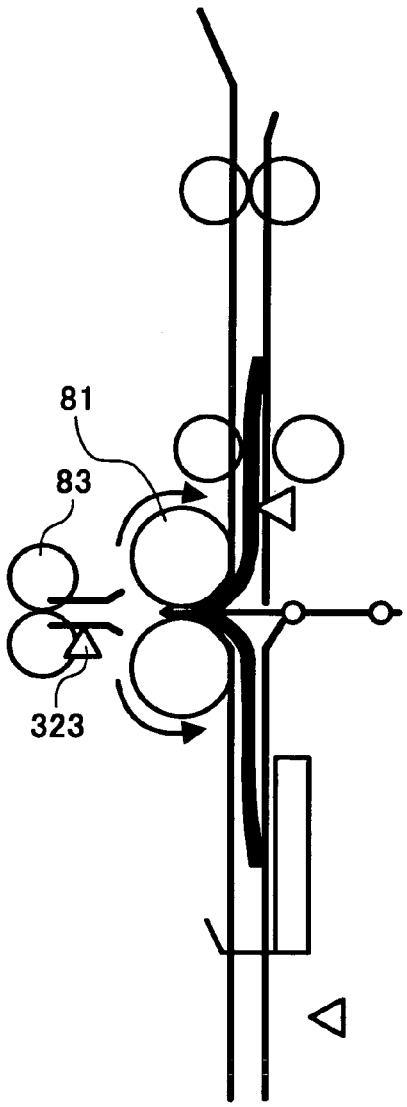
FIG. 38 shows a condition wherein a fold roller pair has started operating after the operation of the fold plate in the third embodiment.

FIGS. 37 through 44 show how the fold roller pair 81 is rotated in opposite directions to press the leading edge of a folded sheet stack a plurality of times, thereby sharpening the fold of the sheet stack. As for the operation itself, FIGS. 37 through 44 correspond to FIGS. 28, 34 and 30 of the second embodiment. As shown in FIG. 37, the fold plate 74 pushes part of a center-folded sheet stack around staples into the nip of the fold roller pair 81 in the direction perpendicular to the sheet stack. As a result, as shown in FIG. 38, the sheet stack is conveyed by the fold roller pair 81 while being folded at its center thereby.

Figure 39:
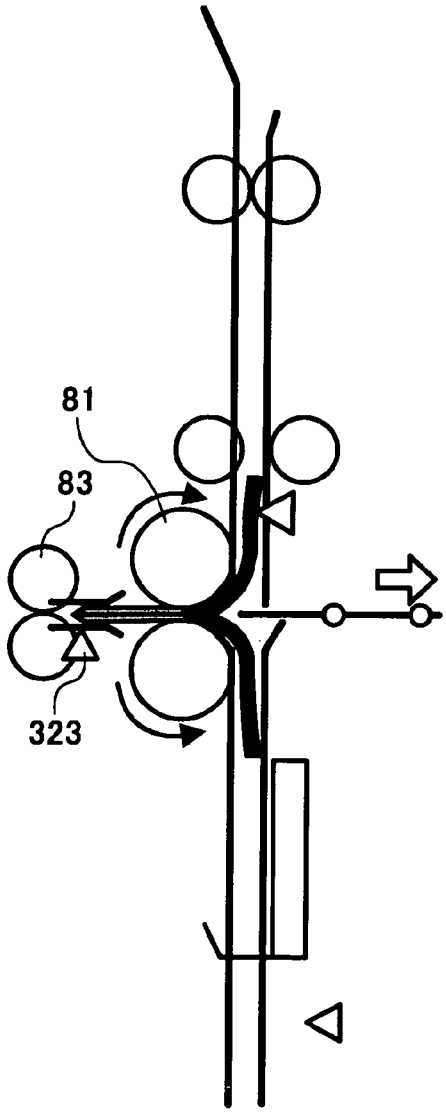
FIG. 39 shows a condition wherein the fold roller pair is rotated forward in the center staple and fold mode in the third embodiment, causing the sheet stack to reach a pass sensor.
Figure 40:
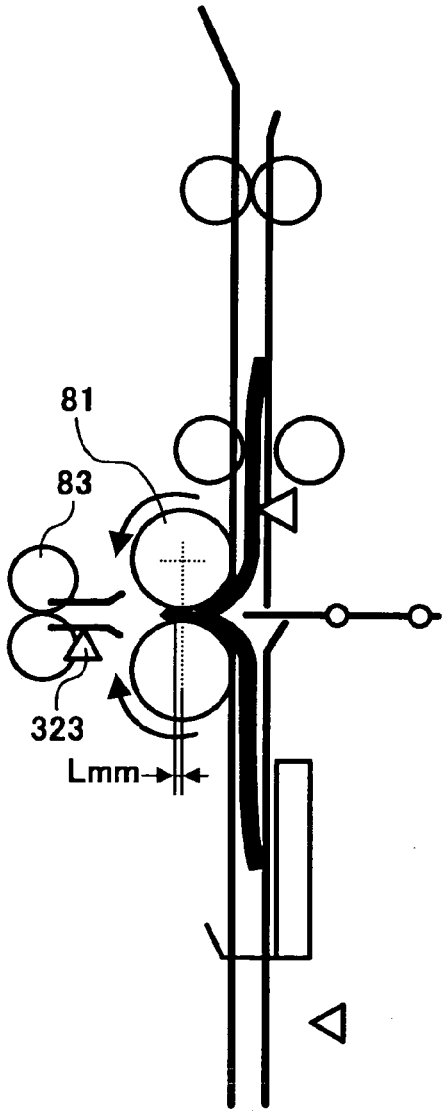
FIG. 40 shows a condition wherein the fold roller pair is rotated in the reverse direction in the third embodiment, nipping the leading edge of the sheet stack.
Figure 41:
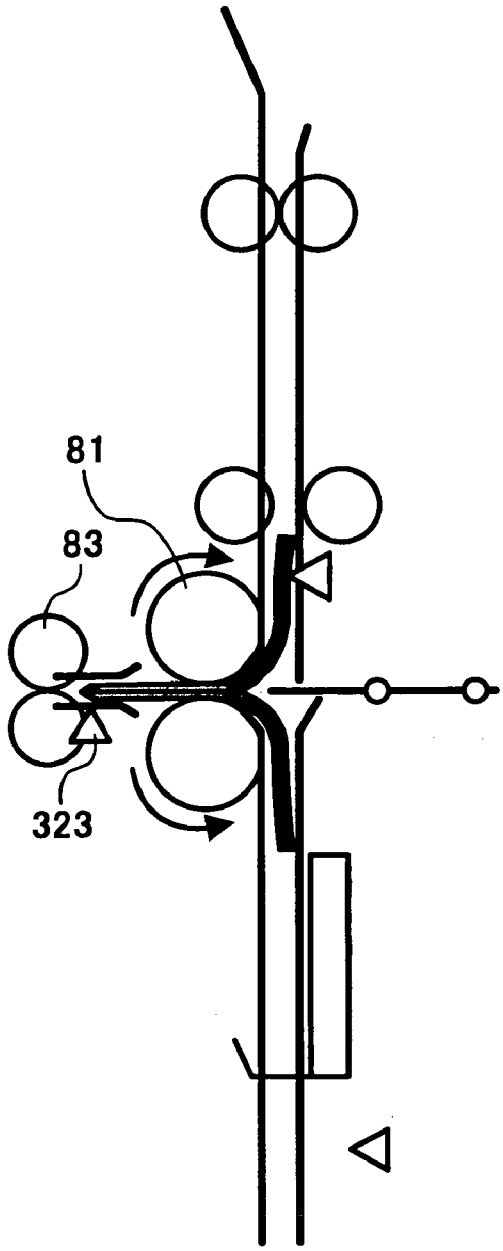
FIG. 41 shows a condition wherein the fold roller pair is again rotated forward in the third embodiment, causing the leading edge of the sheet stack to reach the pass sensor.
Figure 42:
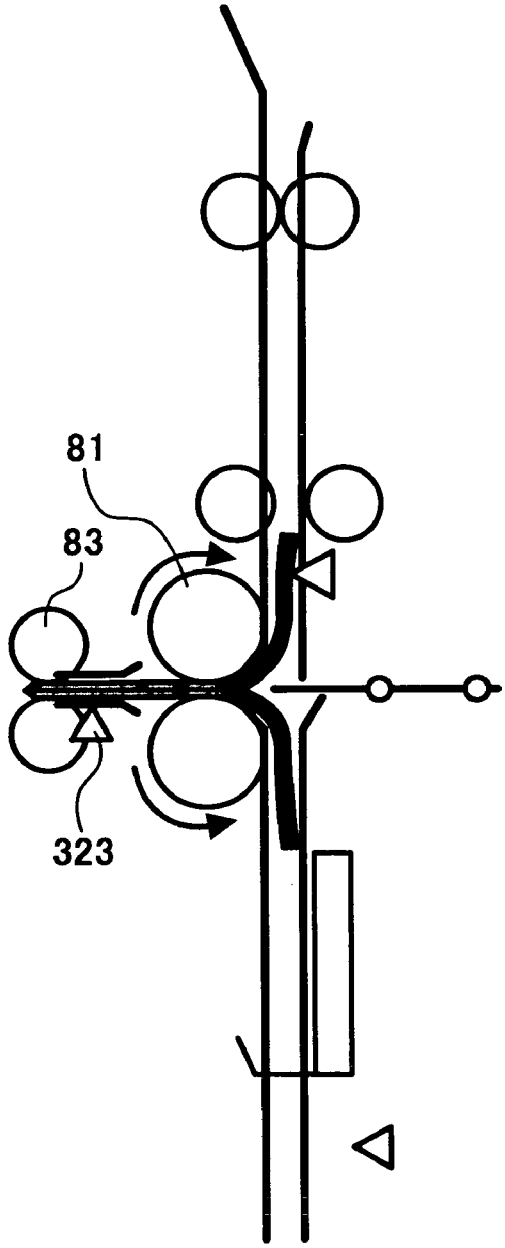
FIG. 42 shows a condition wherein the fold roller is rotated forward to discharge the sheet stack.
Figure 43:
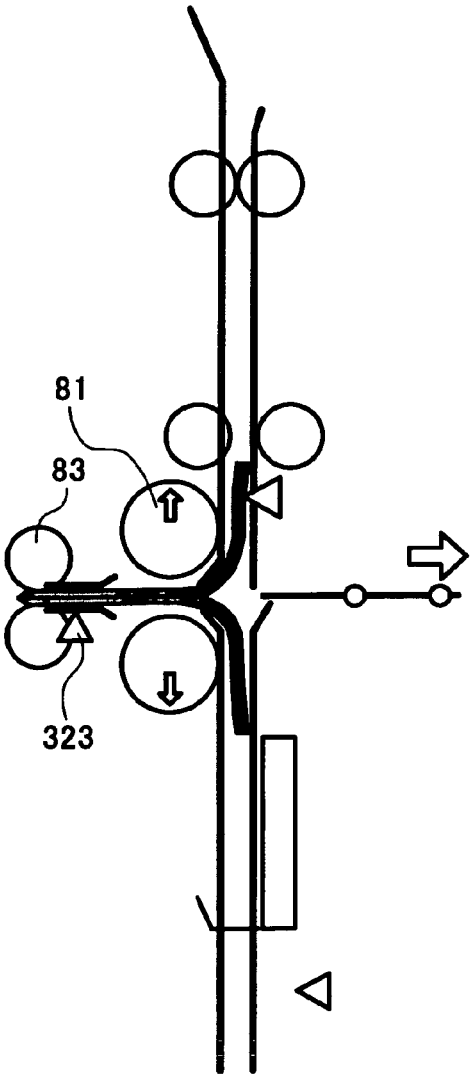
FIG. 43 shows a condition wherein a lower roller pair is discharging the sheet stack with the fold roller pair being released from the sheet stack.
Figure 44:
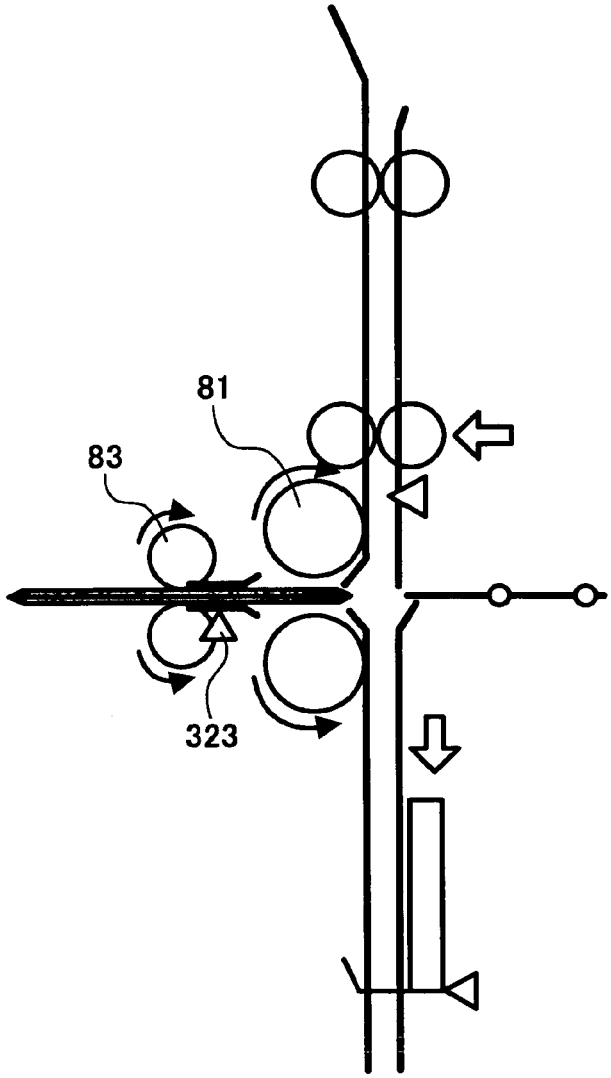
FIG. 44 shows a condition wherein the fold tray is ready to receive the next sheet stack with the previous sheet stack being discharged by the lower roller pair.
Figure 47A:
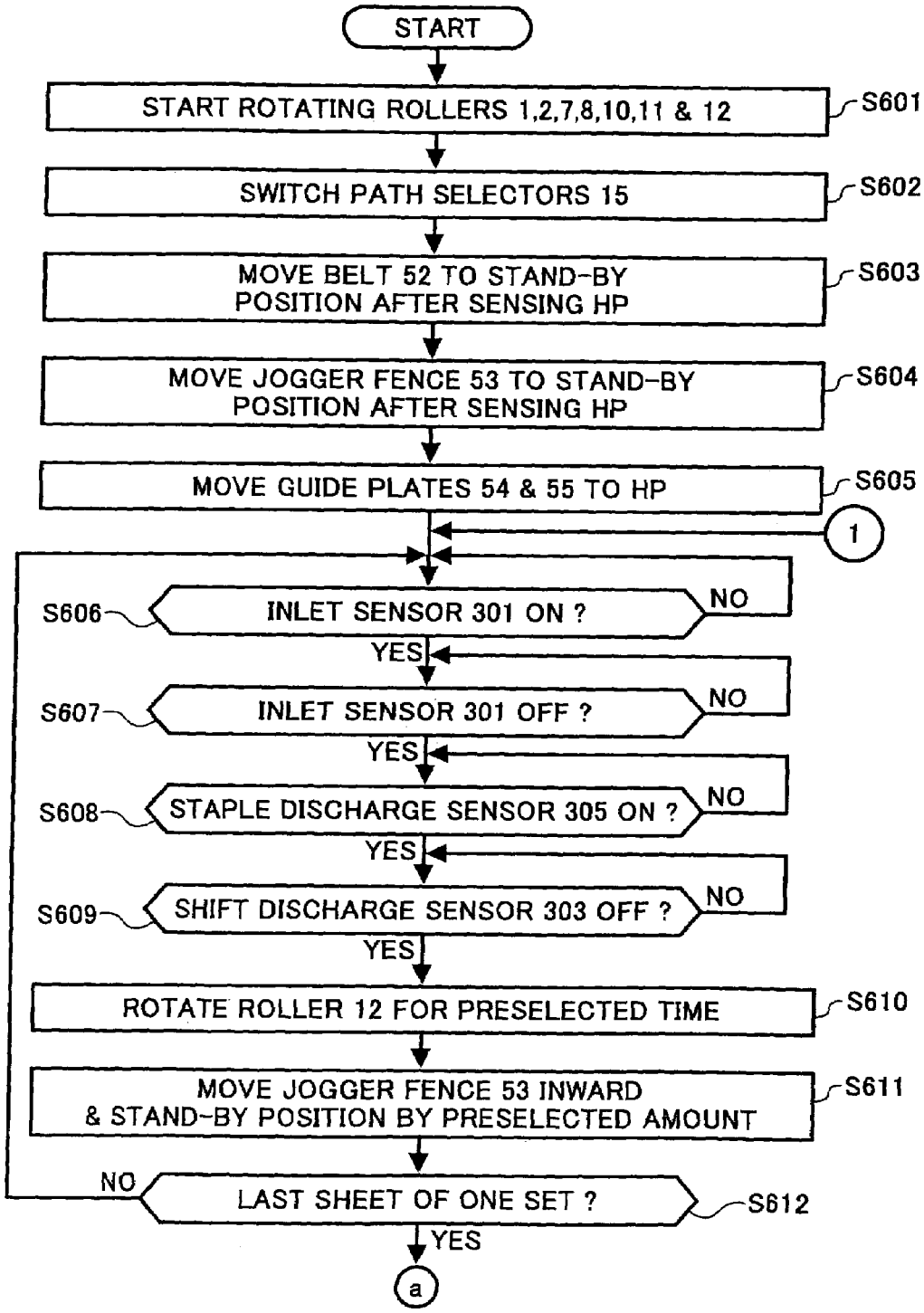
FIGS. 47A through 47D are flowcharts demonstrating a procedure to be executed by the third embodiment in the center staple and fold mode.
Figure 47B:
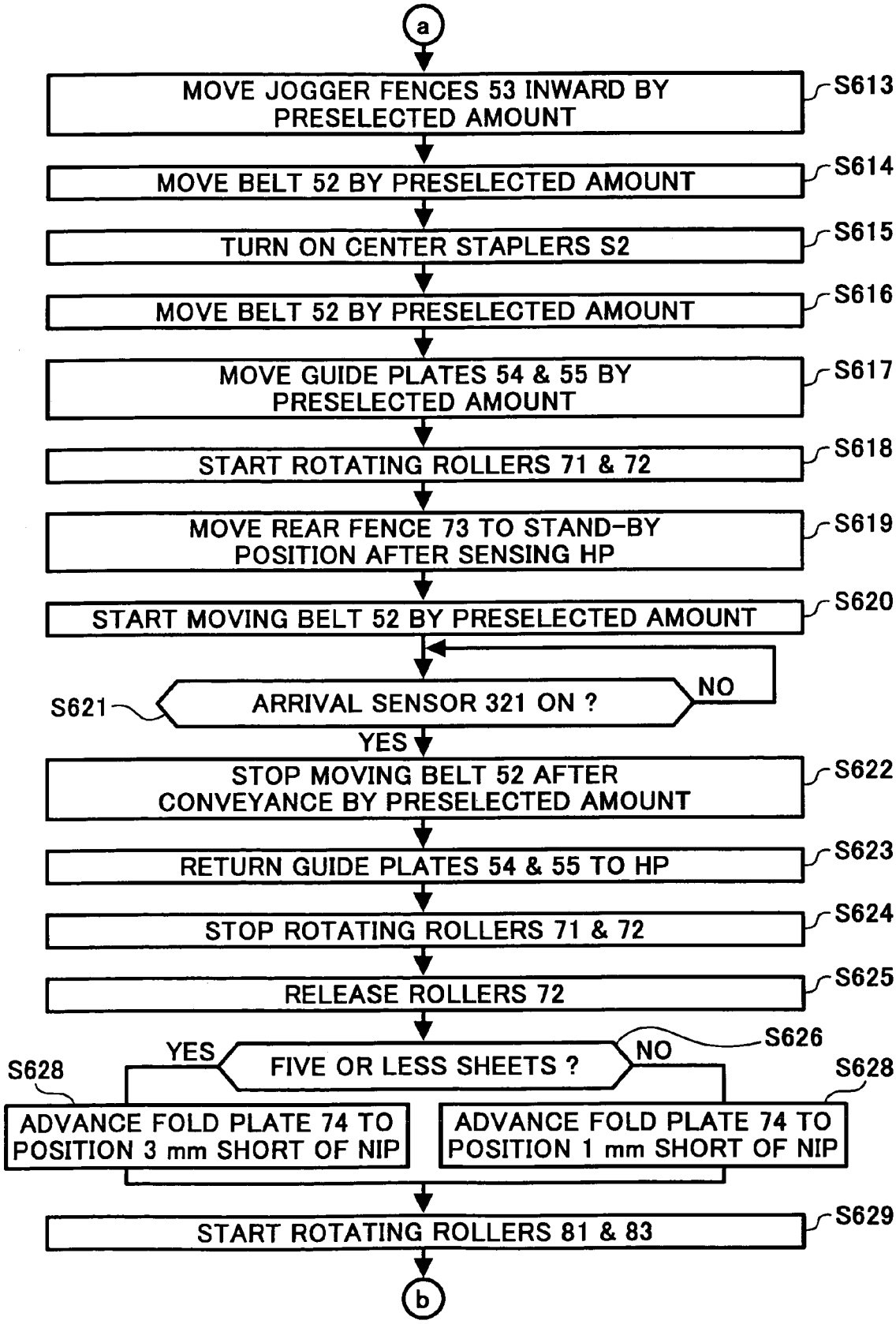
Figure 47C:
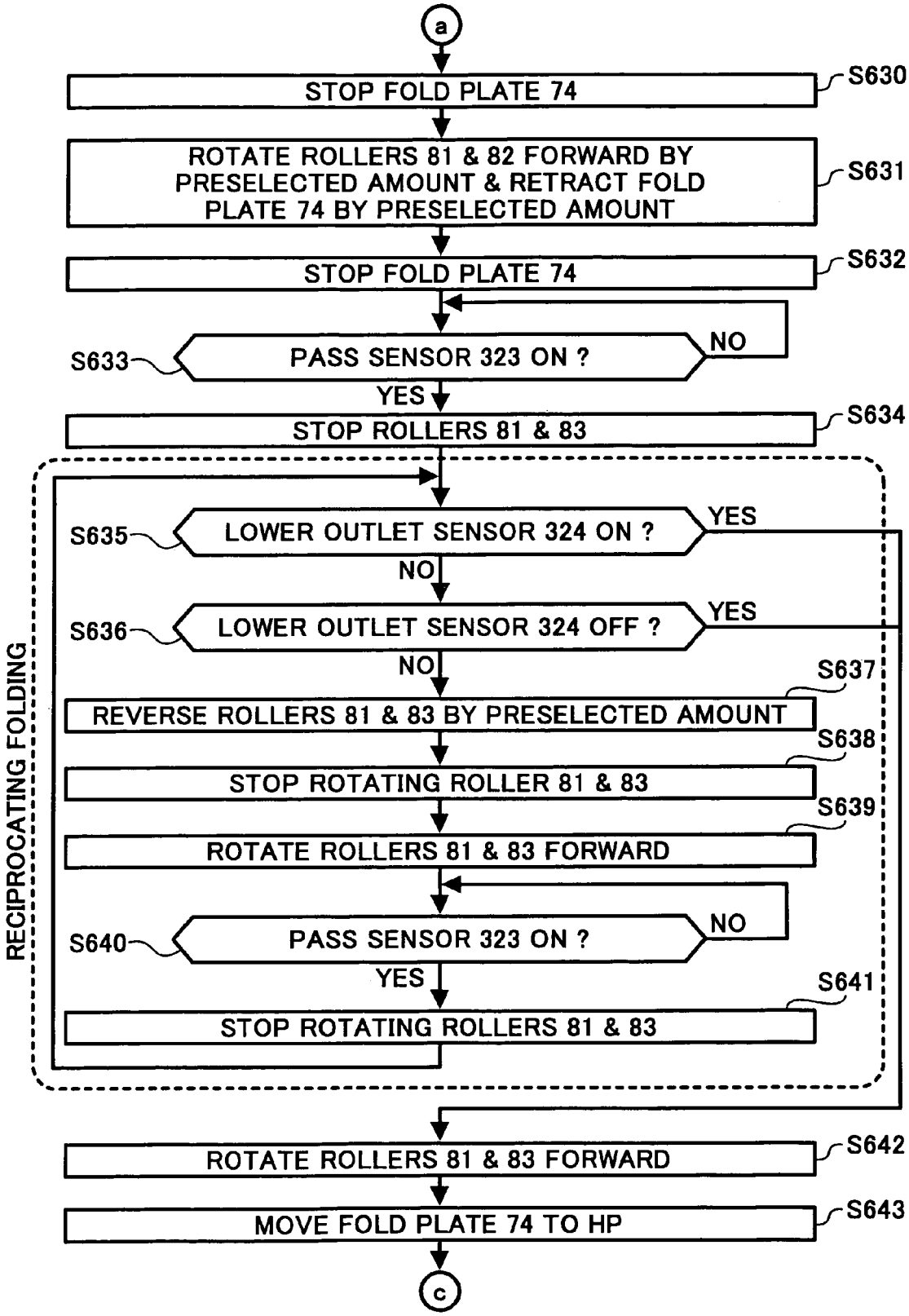
Figure 47D:
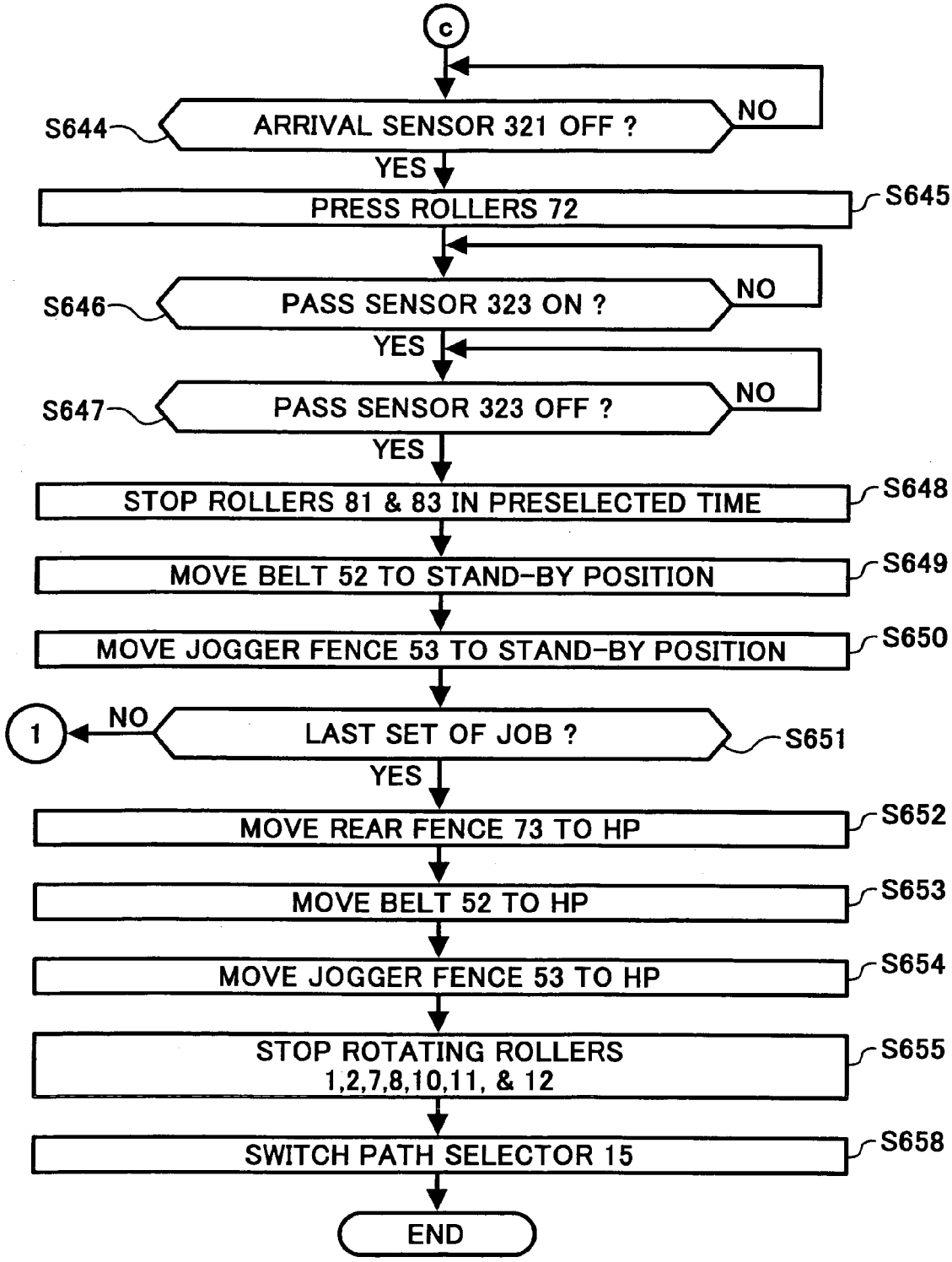

As shown in FIG. 39, when the pass sensor 323 senses the leading edge of the folded sheet stack, the fold plate 74 is retracted by a preselected distance. Subsequently, as shown in FIG. 40, the fold roller pair 81 and lower outlet roller pair 83 are caused to be rotated in the reverse direction and then stop at a position L mm spaced from the center of the nip. As shown in FIG. 41, the fold roller pair 81 and lower outlet roller pair 83 that have reached the above position are caused to rotate in the forward direction. As shown in FIG. 42, as soon as the pass sensor 323 senses the leading edge of the sheet stack, the fold roller pair 81 and lower outlet roller pair 83 are caused to stop. The fold roller pair 81 repeats the operation of FIGS. 39 through 41 in order to sharpen the fold of the sheet stack. The number of times and duration of the repetition may be manually input on an operation panel, not shown, mounted on the image forming apparatus PR or automatically set by the CPU 360 in accordance with the sheet size and the number of sheets.

The fold roller pair 81 and lower outlet roller pair 83, once stopped in the positions shown in FIG. 42, are again caused to rotate in the forward direction to thereby discharge the folded sheet stack to the lower tray 203. When the arrival sensor 321 senses the trailing edge of the sheet stack, the movable rear fence 73 is returned to the home position while the lower rollers 72 are pressed against each other, preparing for the next sheet stack. Again, the rear fence 73 may be held at the same position if the sheet size and the number of sheets to be dealt with by the next job are the same. As soon as the fold roller pair 81 and lower outlet roller pair 83 start rotating in the forward direction, the fold plate 74 is returned to the home position.

When the pass sensor 323 senses the leading edge of the folded sheet stack, the fold plate 74 is retracted by a preselected distance, as shown in FIG. 39. As shown in FIG. 45, the preselected distance of retraction is such that the leading edge of the fold plate 74 is shifted from the center of the nip of the fold roller pair 81 toward the upstream side in the direction of conveyance by X mm. Assuming that the each fold roller 81 has a radius R, then the distance X should preferably be:

$$X=(\sqrt{2}-1)R$$

The above position is derived from the relative position between the sheet stack and the fold roller pair 81 and fold plate 74 and is not limited to X mm.

To effectively sharpen the fold of a sheet stack, the rotation of the fold roller pair 81 in opposite directions, as shown in FIGS. 39 through 42, should preferably be effected by a distance of 1 mm (FIG. 40) to 50 mm (FIG. 42) from the center of the nip of the fold roller pair 81. Experiments showed that the fold a sheet stack was most effectively sharpened when the fold roller pair 81 pressed, at the center of its nip, the position of the sheet stack about 3 mm spaced from the leading edge of the fold of the innermost sheet. It is therefore preferable to move a sheet stack back and forth with its portion including the above position held at the nip. If desired, during the reciprocating movement, the fold roller pair 81 may be caused to temporarily stop rotating at the position 3 mm spaced from the leading edge of the fold and press the sheet stack over a preselected period of time. This preselected period of time may be suitably selected in accordance with the sheet size and the number of sheets.

FIG. 46B shows a sheet stack moved back and forth over the particular range mentioned above and pressed while in a stop. FIG. 46A shows a sheet stack not subjected to such a fold-sharpening procedure. It will be seen that the fold subjected to the sharpening procedure is lower in height than the fold not subjected to the same. Stated another way, the sharpening procedure makes the fold more firm and folds the highest portion of the sheet stack. This not only implements neat binding, but also allows more sheet stacks to be neatly stacked on the lower tray 203.

FIGS. 47A through 47D are flowcharts demonstrating the center staple and fold mode unique to the illustrative embodiment. As shown, when a sheet driven out of the image forming apparatus PR is about to enter the sheet finisher PD, the CPU 360, FIG. 17, causes the inlet roller pair 1, roller pair 2, roller pairs 7, 9 and 10 on the path D, staple outlet roller, pair 11 and knock roller 12 to start rotating (step S601) The CPU 360 then turns on the solenoid assigned to the path selector 15 (step S602) for thereby causing it to rotate counterclockwise.

After the belt HP sensor 311 has sensed the belt 52 has reached its home position, the CPU 360 drives the discharge motor 157 so as to move the belt 52 to the stand-by position. Also, after the jogger fence HP sensor has sensed the jogger fence 53 has been brought to its home position, the CPU 360 moves the jogger fence 53 to the stand-by position. Further, the CPU 360 moves the guide plate 54 and movable guide 55 to their home positions (steps S603 through S605). Subsequently, if the inlet sensor 301 has turned on and then turned off (steps S606 and S607), if the staple outlet sensor 305 has turned on (step S608), and if the shift outlet sensor 303 has turned off (step S609), then the CPU 360 determines that a sheet is present on the staple tray F. The CPU 360 then turns on the knock solenoid 170 over a preselected period of time to bring the knock roller 12 into contact with the sheet and then urges it toward the rear fence 51, thereby positioning the trailing edge of the sheet (step S610).

After the step S610, the CPU 360 drives the jogger motor 158 to move the jogger fence 53 inward by a preselected distance, thereby positioning the sheet in the widthwise direction. The CPU 360 then returns the jogger fence 53 to the stand-by position (step S611). As a result, the sheet on the tray F is positioned in both of the horizontal and vertical directions.

After the last sheet of a single set or copy has been positioned on the staple tray F (YES, step S612), the CPU 360 moves the jogger fence 53 inward by the preselected distance to thereby prevent the edge of the sheet stack from being dislocated (step S613). The CPU 360 then drives the discharge motor 157 in order to move the belt 52 by a preselected amount (step S614), so that the sheet stack is raised to the position where the center staplers S2 are positioned. In this condition, the center staplers S2 staple the sheet stack at the center (step S615).

Subsequently, the CPU 360 causes the belt 52 to move by a preselected amount (step S616) and moves the guide plate 54 and movable guide 55 by a preselected amount each, thereby clearing the path extending to the fold tray G (step S617). At the same time, the CPU 360 causes the upper and lower roller pairs 71 and 72 of the fold tray G to start rotating (step S618). After the movable rear fence 73 of the fold tray G has reached its home position, the CPU 360 causes it to move to the stand-by position (step S619).

After the fold tray G has been prepared for the entry of the sheet stack by the above steps, the CPU 360 causes the belt 52 to move by a preselected amount (step S520) until the sheet stack has been nipped by the discharge roller 56 and press roller 57 and conveyed toward the fold tray G thereby. After the leading edge of the sheet stack has reached the arrival sensor 321 (step 5621) and then further conveyed by a preselected distance, the CPU 360 causes the upper and lower roller pairs 71 and 72 to stop rotating (step S622) and moves the guide plates 51 and 52 to their home positions (step S623). When the sheet stack is fully conveyed by the preselected distance, the CPU 360 causes the roller pairs 71 and 72 to stop rotating for thereby interrupting the conveyance of the sheet stack (step S624). The CPU 360 then releases the lower rollers 72 from each other (step S625).

After the step S625, the CPU 360 determines the number of sheets stapled together (step S625). If the number of sheets is five or less (YES, step S626), then the CPU 360 causes the fold plate 74 to move forward to a position 3 mm short of the nip of the fold roller pair 81 while pushing the sheet stack (step S627). If the answer of the number of sheets is six or more (NO, step S626), then the CPU 360 causes the fold plate 74 to move to a position 1 mm short of the nip of the fold roller pair 81 while pressing the sheet stack (step S628). Further, the CPU 360 causes the fold roller pair 81 and lower roller pair 83 to start rotating forward (step S629) while stopping the movement of the fold plate 74 (step S630). In this condition, the CPU 360 causes the fold roller pair 81, and lower roller pair 83 to rotate forward by a preselected amount each (FIGS. 37 through 39), causes the fold plate 74 to retract by a preselected distance (step S631; FIG. 40), and then stops the movement of the fold plate 74 (step S632) with the edge of the plate 74 protruding into the path 92.

When the pass sensor 323 turns on, thereby sensing the passage of the center-folded sheet stack (step S633; FIG. 40), the CPU 360 causes the fold roller pair 81 and lower roller pair 83 to stop rotating (step S734) and then repeatedly executes the folding operation until the CPU 360 causes the fold roller pair 81 and lower roller pair 83 to start rotating forward (step S642). More specifically, the CPU 360 checks the preselected operation under way at the position upstream of the folding or the status of the arrival sensor 321 (step S635). If the preselected operation is not completed or if the arrival sensor 321 has not turned on, then the CPU 360 determines whether or not a counter, counting the reciprocating movement, has reached a preselected count. If the answer of this decision is negative, then the CPU 360 causes the fold roller pair 81 and lower roller pair 83 to rotate in the reverse direction by a preselected amount that brings the leading edge of the sheet stack to the position L mm spaced from the center of the nip shown in FIG. 40 (steps S637 and S638).

After the step S638, the CPU 360 causes the fold roller pair 81 and lower roller pair 83 to start rotating forward (step S639) and then causes them to stop rotating when the leading edge of the sheet stack moves away from the pass sensor 323 (YES, step S640). Thereafter, the steps S635 through S641 are repeated. When the preselected operation under way at the upstream side ends or the arrival sensor 321 turns on (YES, step S635) and if the counter reaches the preselected count (YES, step S636), the CPU 360 causes the fold roller pair 81 and lower roller pair 83 to rotate forward (step S642) and returns the fold plate 74 to the home position (step S643). As soon as the arrival sensor 321 turns off (YES, step S644), the CPU 360 presses the lower rollers 72 against each other to thereby prepare them for the entry of the sheet stack (step S645).

In the above condition, the pass sensor 323 monitors the passage of the sheet stack (steps S646 and S647). When the trailing edge of the sheet stack moves away from the pass sensor 323 (YES, step S647), the CPU 360 causes the fold roller pair 81 and lower roller pair 83 to further rotate over a preselected period of time and then stop (step S648). The CPU 360 then moves the belt 52 and jogger fence 63 to their stand-by positions (steps S 649 and S650). Subsequently, the CPU 360 determines whether or not the sheet stack is the last set or copy to be dealt with by the job (step S651). If the answer of the step S651 is NO, then the CPU 360 returns to the step S606. If the answer of the step S651 is YES, then the CPU 360 returns the movable rear fence 73, belt 52 and jogger fence 53 to their home positions (steps S652, S653 and S654), causes the inlet roller pair 1, roller pairs 2, 7, 9 and 10, staple outlet roller pair 11 and knock roller 12 to stop rotating (step S655), and turns off the solenoid assigned to the path selector 15 (step S656). This is the end of the procedure shown in FIGS. 47A through 47D.

As stated above, the illustrative embodiment has various advantages, as enumerated below.

(1) A single fold roller pair 81, which is rotated in opposite directions, suffices for sharpening the fold of a sheet stack. In addition, the rotation of the fold roller pair 81 occurs within the range of the nip to thereby prevent a sheet stack from moving away from the nip, so that the fold can be sharpened by simple control.

(2) The user can select a desired degree of fold sharpening in accordance with the sheet size and the number of sheets constituting a single stack. This insures an attractive bound sheet stack.

(3) Only the portion relating to fold sharpening is caused to move back and forth, allowing the fold to be most efficiently sharpened.

(4) The rotation of the fold roller pair 81 is controlled on the basis of the output of the pass sensor 323, preventing errors in conveyance length from accumulating. This allows only the target range of the sheet stack to be accurately pressed and therefore promotes efficient sharpening.

(5) The fold roller pair 81 is rotated in the reverse direction at least once, so that the minimum degree of sharpening is achievable without regard to the number of sheets. It follows that the bound sheet stack is attractive without regard to the number of sheets constituting it.

(6) Even if the fold of the sheet stack slips out of the nip of the fold roller pair 81 when the roller pair 81 is reversed, the fold plate held at the stand-by position catches the sheet stack. Therefore, only if the fold roller pair 81 is again rotated forward, the fold of the sheet stack can again easily enter the nip of the roller pair 81 in a short period of time without jamming the path.

Various modifications will become possible for those skilled in the art after receiving the teachings of the present disclosure without departing from the scope thereof.

What is claimed is:

1. A folding device comprising:

a fold roller pair for folding a sheet or a sheet stack conveyed thereto; and a controller configured to cause said fold roller pair to move back and forth while nipping a folded portion of the sheet or a folded portion of the sheet stack at a nip for thereby continuously exerting a pressure on said folded portion;

wherein said fold roller pair is repeatedly rotated in opposite directions within a preselected period of time by an amount small enough to maintain the folded portion in the nip of the fold roller pair, for thereby sharpening a fold of the sheet or a fold of the sheet stack.

2. The folding device as claimed in claim 1, wherein said controller causes said fold roller pair to stop rotating over a preselected period of time while holding the folded portion at the nip.

3. The folding device as claimed in claim 2, wherein said controller sets the preselected period of time in accordance with a sheet size and a number of sheets constituting the sheet stack.

4. A folding device comprising:

a fold roller pair for folding a sheet or a sheet stack conveyed thereto; and a controller configured to control rotation of said fold roller pair in opposite directions in accordance with a condition in which the sheet or the sheet stack is processed at a position upstream of a folding section in a direction of sheet conveyance;

wherein said fold roller pair is repeatedly rotated in opposite directions within a preselected period of time by an amount small enough to maintain a folded portion of the sheet or the sheet stack in a nip of the fold roller pair, for thereby sharpening a fold of the sheet or a fold of the sheet stack.

5. A folding device comprising:

a fold roller pair for folding a sheet or a sheet stack conveyed thereto; and a controller configured to control rotation of said fold roller pair in opposite directions in accordance with a condition of the sheet or a condition of the sheet stack sensed at a position upstream of a folding section in a direction of sheet conveyance;

wherein said fold roller pair is repeatedly rotated in opposite directions within a preselected period of time by an amount small enough to maintain a folded portion of the sheet or the sheet stack in a nip of the fold roller pair, for thereby sharpening a fold of the sheet or stack.

6. A folding device comprising:

a fold roller pair for folding a sheet or a sheet stack conveyed thereto; and a control setting configured to set a number of times by which said fold roller pair rotates in opposite directions;

wherein said fold roller pair is rotated in opposite directions for thereby sharpening a fold of the sheet or a fold of the sheet stack.

7. A folding device for folding a sheet or a sheet stack conveyed thereto with a fold roller pair and sharpening a fold of said sheet or a fold of said sheet stack by causing said fold roller pair to rotate in opposite directions, said folding device comprising:

a controller configured to control rotation of said fold roller pair in opposite directions in accordance with processing effected at a position upstream of a folding section in a direction of sheet conveyance; and a control setting configured to set a number of times by which said fold roller pair rotates in opposite directions;

wherein said controller interrupts, whether or not said fold roller pair has completed the number of times of rotation set by said control setting, the rotation of said fold roller pair in accordance with the processing effected at said position and then begins discharging the sheet or the sheet stack.

8. A folding device for folding a sheet or a sheet stack conveyed thereto with a fold roller pair and sharpening a fold of said sheet or a fold of said sheet stack by causing said fold roller pair to rotate in opposite directions, said folding device comprising:

a controller configured to control rotation of said fold roller pair in opposite directions in accordance with processing effected at a position upstream of a folding section in a direction of sheet conveyance; and a control setting configured to set a number of times by which said fold roller pair rotates in opposite directions;

wherein said controller interrupts, whether or not said fold roller pair has completed the number of times of rotation set by said control setting, the rotation of said fold roller pair in accordance with a condition of the sheet or a condition of the sheet stack sensed at said position and then begins discharging the sheet or the sheet stack.

9. A folding device comprising:

a fold roller pair for folding a sheet or a sheet stack conveyed thereto; and a control setting configured to set an amount by which said fold roller pair rotates in opposite directions;

wherein said fold roller pair is repeatedly rotated in opposite directions within a preselected period of time by an amount small enough to maintain a folded portion of the sheet or the sheet stack in a nip of the fold roller pair, for thereby sharpening a fold of the sheet or a fold of the sheet stack.

10. The folding device as claimed in claim 9, wherein said control setting varies the amount in accordance with a number of sheets stapled together.

11. The folding device as claimed in claim 10, wherein said control setting reduces the amount if the number of sheets is small or increases said amount if said number of sheets is large.

12. A folding device for folding a sheet or a sheet stack conveyed thereto with and a fold roller pair and sharpening a fold of said sheet or a fold of said sheet stack by causing said fold roller pair to rotate in opposite directions, said folding device comprising:

a drive configured to selectively cause said fold plate to advance or retract; and a controller configured to control said drive such that after said fold plate has advanced to push the sheet or the sheet stack into a nip of said fold roller pair, a leading edge of said fold plate remains at a preselected stand-by position protruded into a conveyance path while maintaining a gap between said leading edge and said fold roller pair.

13. A folding device comprising:

a fold roller pair for folding a sheet or a sheet stack conveyed thereto; and a controller configured to cause, before discharging the sheet or the sheet stack, said fold roller pair to repeatedly rotate in opposite directions within a preselected period of time by an amount small enough to maintain a folded portion of the sheet or the sheet stack in a nip of the fold roller pair.

14. In a sheet finisher comprising a folding device, said folding device comprising:

a fold roller pair for folding a sheet or a sheet stack conveyed thereto; and a controller configured to cause said fold roller pair to move back and forth while nipping a folded portion of the sheet or a folded portion of the sheet stack at a nip for thereby continuously exerting a pressure on said folded portion;

wherein said fold roller pair is repeatedly rotated in opposite directions within a preselected period of time by an amount small enough to maintain the folded portion in the nip of the fold roller pair, for thereby sharpening a fold of the sheet or a fold of the sheet stack.

15. In a sheet finisher comprising a folding device, said folding device comprising:

a fold roller pair for folding a sheet or a sheet stack conveyed thereto; and a controller configured to control rotation of said fold roller pair in opposite directions in accordance with a condition in which the sheet or the sheet stack is processed at a position upstream of a folding section in a direction of sheet conveyance;

wherein said fold roller pair is repeatedly rotated in opposite directions within a preselected period of time by an amount small enough to maintain a folded portion of the sheet or the sheet stack in a nip of the fold roller pair, for thereby sharpening a fold of the sheet or a fold of the sheet stack.

16. In a sheet finisher comprising a folding device, said folding device comprising:

a fold roller pair for folding a sheet or a sheet stack conveyed thereto; and a controller configured to control rotation of said fold roller pair in opposite directions in accordance with a condition of the sheet or a condition of the sheet stack sensed at a position upstream of a folding section in a direction of sheet conveyance;

wherein said fold roller pair is repeatedly rotated in opposite directions within a preselected period of time by an amount small enough to maintain a folded portion of the sheet or the sheet stack in a nip of the fold roller pair, for thereby sharpening a fold of the sheet or a fold of the sheet stack.

17. In a sheet finisher comprising a folding device, said folding device comprising:

a fold roller pair for folding a sheet or a sheet stack conveyed thereto; and a control setting configured to set a number of times by which said fold roller pair rotates in opposite directions;

wherein said fold roller pair is rotated in opposite directions for thereby sharpening a fold of the sheet or a fold of the sheet stack.

18. In a sheet finisher comprising a folding device for folding a sheet or a sheet stack conveyed thereto with a fold roller pair and sharpening a fold of said sheet or a fold of said sheet stack by causing said fold roller pair to rotate in opposite directions, said folding device comprising:

a controller configured to control rotation of said fold roller pair in opposite directions in accordance with processing effected at a position upstream of a folding section in a direction of sheet conveyance; and a control setting configured to set a number of times by which said fold roller pair rotates in opposite directions;

wherein said control means interrupts, whether or not said fold roller pair has completed the number of times of rotation set by said control setting, the rotation of said fold roller pair in accordance with the processing effected at said position and then begins discharging the sheet or the sheet stack.

19. In a folding device for folding a sheet or a sheet stack conveyed thereto with a fold roller pair and sharpening a fold of said sheet or a fold of said sheet stack by causing said fold roller pair to rotate in opposite directions, said folding device comprising:

a controller configured to control rotation of said fold roller pair in opposite directions in accordance with processing effected at a position upstream of a folding section in a direction of sheet conveyance; and a control setting configured to set a number of times by which said fold roller pair rotates in opposite directions;

wherein said controller interrupts, whether or not said fold roller pair has completed the number of times of rotation set by said control setting, the rotation of said fold roller pair in accordance with a condition of the sheet or a condition of the sheet stack sensed at said position and then begins discharging the sheet or the sheet stack.

20. In a sheet finisher comprising a folding device, said folding device comprising:

a fold roller pair for folding a sheet or a sheet stack conveyed thereto; and a control setting configured to set an amount by which said fold roller pair rotates in opposite directions;

wherein said fold roller pair is repeatedly rotated in opposite directions within a preselected period of time by an amount small enough to maintain a folded portion of the sheet or the sheet stack in a nip of the fold roller pair for thereby sharpening a fold of the sheet or a, fold of the sheet stack.

21. In a sheet finisher comprising a folding device for folding a sheet or a sheet stack conveyed thereto with a fold roller pair and sharpening a fold of said sheet or a fold of said sheet stack by causing said fold roller pair to rotate in opposite directions, said folding device comprising:

a drive configured to selectively cause said fold plate to advance or retract; and a controller configured to control said drive such that after said fold plate has advanced to push the sheet or the sheet stack into a nip of said fold roller pair, a leading edge of said fold plate remains at a preselected stand-by position protruded into a conveyance path while maintaining a gap between said leading edge and said fold roller pair.

22. In a sheet finisher comprising a folding device, said folding device comprising:

a fold roller pair for folding a sheet or a sheet stack conveyed thereto; and a controller configured to cause, before discharging the sheet or the sheet stack, said fold roller pair to repeatedly rotate in opposite directions within a preselected period of time by an amount small enough to maintain a folded portion of the sheet or the sheet stack in a nip of the fold roller pair.

23. An image forming system comprising:

an image forming apparatus for forming a toner image on a sheet; and a sheet finisher mounted on or operatively connected to said image forming apparatus;

said sheet finisher comprising:

a folding device, said folding device comprising:

a fold roller pair for folding a sheet or a sheet stack conveyed thereto; and a controller configured to cause said fold roller pair to move back and forth while nipping a folded portion of the sheet or a folded portion of the sheet stack at a nip for thereby continuously exerting a pressure on said folded portion;

wherein said fold roller pair is repeatedly rotated in opposite directions within a preselected period of time by an amount small enough to maintain the folded portion in the nip of the fold roller pair, for thereby sharpening a fold of the sheet or a fold of the sheet stack.

24. An image forming system comprising:

an image forming apparatus for forming a toner image on a sheet; and a sheet finisher mounted on or operatively connected to said image forming apparatus;

said sheet finisher comprising a folding device comprising:

a fold roller pair for folding a sheet or a sheet stack conveyed thereto; and a controller configured to control rotation of said fold roller pair in opposite directions in accordance with a condition in which the sheet or the sheet stack is processed at a position upstream of a folding section in a direction of sheet conveyance;

wherein said fold roller pair is repeatedly rotated in opposite directions within a preselected period of time by an amount small enough to maintain a folded portion of the sheet or the sheet stack in a nip of the fold roller pair, for thereby sharpening a fold of the sheet or a fold of the sheet stack.

25. An image forming system comprising:

an image forming apparatus for forming a toner image on a sheet; and a sheet finisher mounted on or operatively connected to said image forming apparatus;

said sheet finisher comprising a folding device comprising:

a fold roller pair for folding a sheet or a sheet stack conveyed thereto; and a controller configured to control rotation of said fold roller pair in opposite directions in accordance with a condition of the sheet or a condition of the sheet stack sensed at a position upstream of a folding section in a direction of sheet conveyance;

wherein said told roller pair is repeatedly rotated in opposite directions within a preselected period of time by an amount small enough to maintain a folded portion of the sheet or the sheet stack in a nip of the fold roller pair for thereby sharpening a fold of the sheet or a fold of the sheet stack.

26. An image forming system comprising:

an image forming apparatus for forming a toner image on a sheet; and a sheet finisher mounted on or operatively connected to said image forming apparatus;

said sheet finisher comprising a folding device comprising:

a fold roller pair for folding a sheet or a sheet stack conveyed thereto; and a control setting configured to set a number of times by which said fold roller pair rotates in opposite directions;

wherein said fold roller pair is rotated in opposite directions for thereby sharpening a fold of the sheet or a fold of the sheet stack.

27. An image forming system comprising:

an image forming apparatus for forming a toner image on a sheet; and a sheet finisher mounted on or operatively connected to said image forming apparatus;

said sheet finisher comprising a folding device for folding a sheet or a sheet stack conveyed thereto with a fold roller pair and sharpening a fold of said sheet or a fold of said sheet stack by causing said fold roller pair to rotate in opposite directions, said folding device comprising:

a controller configured to control rotation of said fold roller pair in opposite directions in accordance with processing effected at a position upstream of a folding section in a direction of sheet conveyance; and a control setting configured to set a number of times by which said fold roller pair rotates in opposite directions;

wherein said controller interrupts, whether or not said fold roller pair has completed the number of times of rotation set by said control setting, the rotation of said fold roller pair in accordance with the processing effected at said position and then begins discharging the sheet or the sheet stack.

28. An image forming system comprising:

an image forming apparatus for forming a toner image on a sheet; and a sheet finisher mounted on or operatively connected to said image forming apparatus;

said sheet finisher comprising a folding device for folding a sheet or a sheet stack conveyed thereto a fold roller pair and sharpening a fold of said sheet or a fold of said sheet stack by causing said fold roller pair to rotate in opposite directions, said folding device comprising:

a controller configured to control rotation of said fold roller pair in opposite directions in accordance with processing effected at a position upstream of a folding section in a direction of sheet conveyance; and a control setting configured to set a number of times by which said fold roller pair rotates in opposite directions;

wherein said controller interrupts, whether or not said fold roller pair has completed the number of times of rotation set by said control setting, the rotation of said fold roller pair in accordance with a condition of the sheet or a condition of the sheet stack sensed at said position and then begins discharging the sheet or the sheet stack.

29. An image forming system comprising:

an image forming apparatus for forming a toner image on a sheet; and a sheet finisher mounted on or operatively connected to said image forming apparatus;

said sheet finisher comprising a folding device comprising:

a fold roller pair for folding a sheet or a sheet stack conveyed thereto; and a control setting configured to set an amount by which said fold roller pair rotates in opposite directions;

wherein said fold roller pair is repeatedly rotated in opposite directions within a preselected period of time by an amount small enough to maintain a folded portion of the sheet or the sheet stack in a nip of the fold roller pair, for thereby sharpening a fold of the sheet or a fold of the sheet stack.

30. An image forming system comprising:

an image forming apparatus for forming a toner image on a sheet; and a sheet finisher mounted on or operatively connected to said image forming apparatus;

said sheet finisher comprising a folding device for folding a sheet or a sheet stack conveyed thereto with a fold roller pair and sharpening a fold of said sheet or a fold of said sheet stack by causing said fold roller pair to rotate in opposite directions, said folding device comprising:

a drive configured to selectively cause said fold plate to advance or retract; and a controller configured to control said drive such that after said fold plate has advanced to push the sheet or the sheet stack into a nip of said fold roller pair, a leading edge of said fold plate remains at a preselected stand-by position protruded into a conveyance path while maintaining a gap between said leading edge and said fold roller pair.

31. An image forming system comprising:

an image forming apparatus for forming a toner image on a sheet; and a sheet finisher mounted on or operatively connected to said image forming apparatus;

said sheet finisher comprising a folding device comprising:

a fold roller pair for folding a sheet or a sheet stack conveyed thereto; and a controller configured to cause, before discharging the sheet or the sheet stack, said fold roller pair to repeatedly rotate in opposite directions within a preselected period of time by an amount small enough to maintain a folded portion of the sheet or the sheet stack in a nip of the fold roller pair.

32. A sheet finisher comprising:

a folding device configured to fold a sheet carrying an image formed thereon, said folding device comprising a fold roller pair for folding said sheet being passed through a nip of said fold roller pair, and a drive configured to cause said fold roller pair to rotate; and a controller configured to control said drive;

wherein said controller switches a direction of rotation of said fold roller pair in accordance with whether the sheet should be folded by said fold roller pair or whether said sheet should be guided to a preselected position on a conveyance path before being folded.

33. The sheet finisher as claimed in claim 32, further comprising:

a first discharge path via which a sheet stack is directly discharged;

a steering device branching off said first discharge path for steering the sheet stack by a preselected angle toward said conveyance path; and a second discharge path for discharging the sheet stack folded by said fold roller pair on said conveyance path.

34. The sheet finisher as claimed in claim 32, further comprising an adjusting device configured to adjust a position where said fold roller pair pushes the sheet stack into the nip of said fold roller pair, said adjusting device setting said preselected position.

35. The sheet finisher as claimed in claim 34, further comprising:

a first discharge path via which a sheet stack is directly discharged;

a steering device branching off said first discharge path for steering the sheet stack by a preselected angle toward said conveyance path; and a second discharge path for discharging the sheet stack folded by said fold roller pair on said conveyance path.

36. An image forming system comprising;

a sheet finisher;

image forming means for forming a toner image on a sheet in accordance with image data; and a sheet feeder configured to feed the sheet to said image forming means;

said sheet finisher comprising:

a folding device configured to fold a sheet carrying an image formed thereon, said folding device comprising a fold roller pair for folding said sheet being passed through a nip of said fold roller pair, and a drive configured to cause said fold roller pair to rotate; and a controller configured to control said drive;

wherein said controller switches a direction of rotation of said fold roller pair in accordance with whether the sheet should be folded by said fold roller pair or whether said sheet should be guided to a preselected position on a conveyance path before being folded.

37. The system as claimed in claim 36, wherein said sheet finisher further comprises:

a first discharge path via which a sheet stack is directly discharged;

a steering device branching off said first discharge path for steering the sheet stack by a preselected angle toward said conveyance path; and a second discharge path for discharging the sheet stack folded by said fold roller pair on said conveyance path.

38. The system as claimed in claim 36, wherein said sheet finisher further comprises an adjusting device configured to adjust a position where said fold roller pair pushes the sheet stack into the nip of said fold roller pair, said adjusting device setting said preselected position.

39. The system as claimed in claim 38, wherein said sheet finisher further comprises:

a first discharge path via which a sheet stack is directly discharged;

a steering device branching off said first discharge path for steering the sheet stack by a preselected angle toward said conveyance path; and a second discharge path for discharging the sheet stack folded by said fold roller pair on said conveyance path.

40. A folding device comprising:

a fold roller pair for folding a sheet or a sheet stack conveyed thereto;

a controller configured to cause said fold roller pair to stop rotating while nipping a folded portion of the sheet or a folded portion of the sheet stack at a nip for thereby continuously exerting a pressure on said folded portion;

wherein said controller causes said fold roller pair to stop rotating over a preselected period of time while holding the folded portion at the nip.

41. The folding device as claimed in claim 40, wherein said controller sets the preselected period of time in accordance with a sheet size and a number of sheets constituting the sheet stack.

* * * * *

UNITED STATES PATENT AND TRADEMARK OFFICE

CERTIFICATE OF CORRECTION

PATENT NO. : 7,137,944 B2
APPLICATION NO. : 11/130118
DATED : November 21, 2006
INVENTOR(S) : Suzuki et al.

It is certified that error appears in the above-identified patent and that said Letters Patent is hereby corrected as shown below:

On the title page, Item (30), the Foreign Application Priority Data information is incorrect. Item (30) should read:

-- (30) Foreign Application Priority Data

Jan. 10, 2002 (JP) .....2002-003650
Jan. 25, 2002 (JP) .....2002-017527
Dec. 3, 2002 (JP) .....2002-351507 --

Signed and Sealed this

Sixth Day of February, 2007

JON W. DUDAS
*Director of the United States Patent and Trademark Office*